US005332035A

United States Patent [19]

Schultz et al.

[11] Patent Number: 5,332,035

[45] Date of Patent: Jul. 26, 1994

[54] SHUT-IN TOOLS

[75] Inventors: Roger L. Schultz, Richardson; Craig L. Zitterich, Corinth; Harold K. Beck, Copper Canyon; William L. Bohan, Garland, all of Tex.

[73] Assignee: Halliburton Company, Houston, Tex.

[21] Appl. No.: 69,351

[22] Filed: May 27, 1993

Related U.S. Application Data

[60] Division of Ser. No. 868,832, Apr. 14, 1992, Pat. No. 5,234,057, which is a continuation-in-part of Ser. No. 730,211, Jul. 15, 1991, abandoned.

[51] Int. Cl.[5] ..... E21B 47/06; E21B 43/12; E21B 34/10; E21B 49/08

[52] U.S. Cl. ..... 166/53; 166/64; 166/65.1; 166/66.4; 166/250; 166/264; 364/422

[58] Field of Search ..... 166/53, 250, 264, 373, 166/65.1, 66.4; 175/48, 45, 24, 25, 40; 73/151, 154, 155; 364/422

[56] References Cited

U.S. PATENT DOCUMENTS

| | | | |
|---|---|---|---|
| 3,233,674 | 2/1966 | Leutwyler | 166/63 |
| 4,078,620 | 3/1978 | Westlake et al. | 175/48 |
| 4,307,395 | 12/1981 | Standish | 340/870.11 |
| 4,347,900 | 9/1982 | Barrington | 166/380 |
| 4,375,164 | 3/1983 | Dodge et al. | 73/154 |
| 4,375,239 | 3/1983 | Barrington et al. | 166/336 |
| 4,378,850 | 4/1983 | Barrington | 166/373 |
| 4,407,017 | 9/1983 | Zhilikov et al. | 175/24 X |
| 4,426,882 | 1/1984 | Skinner | 73/155 |
| 4,468,665 | 8/1984 | Thawley et al. | 340/856 |
| 4,483,187 | 11/1984 | Maddock, Jr. | 73/151 |
| 4,664,602 | 5/1987 | Gordon | 166/53 X |
| 4,689,744 | 8/1987 | Zeller et al. | 364/422 |
| 4,712,613 | 12/1987 | Nieuwstad | 166/53 |
| 4,718,011 | 1/1988 | Patterson, Jr. | 364/422 |
| 4,733,233 | 3/1988 | Grosso et al. | 73/155 X |
| 4,796,699 | 1/1989 | Upchurch | 166/250 |
| 4,854,397 | 8/1989 | Warren et al. | 175/26 |
| 4,856,595 | 8/1989 | Upchurch | 166/374 |
| 4,866,607 | 9/1989 | Anderson et al. | 364/422 |
| 4,896,722 | 1/1990 | Upchurch | 166/250 |
| 4,915,168 | 4/1990 | Upchurch | 166/250 |
| 5,056,600 | 10/1991 | Surjaatmadja et al. | 166/373 |
| 5,058,674 | 10/1991 | Schultz et al. | 166/264 |
| 5,101,907 | 4/1992 | Schultz et al. | 166/319 X |
| 5,103,906 | 4/1992 | Schultz et al. | 166/264 |

FOREIGN PATENT DOCUMENTS

| | | |
|---|---|---|
| 0370606A2 | 5/1990 | European Pat. Off. . |
| 0466472A2 | 1/1992 | European Pat. Off. . |
| 0482748A1 | 4/1992 | European Pat. Off. . |
| WO92/19842 | 11/1992 | European Pat. Off. . |

OTHER PUBLICATIONS

Exhibit A–"Otis Products and Services" catalog, published by Otis Engineering Corporation of Dallas, Tex., pp. 92–103, Sep. 1989.

Exhibit B–Brochure entitled "The Omega Shut In Tool" of Omega Developing & Engineering, Ltd. (Undated and not admitted to be prior art).

*Primary Examiner*—Stephen J. Novosad

*Attorney, Agent, or Firm*—Tracy W. Druce; Lucian Wayne Beavers

[57] ABSTRACT

A downhole shut-in tool includes in one aspect a pilot valve which when opened places a differential pressure across a piston which in turn operably engages a shut-in valve element to close the shut-in tool. An electronic timer assembly and electric drive motor are provided for controlling the action of the pilot valve. The drive motor is controlled by a load sensor which senses that the motor has stalled when an actuator engages a movement limiting abutment. In another aspect a pilot valve is provided which can selectively communicate the pressure differential across the piston so as to repeatedly open and close the shut-in valve element. Efficient methods of drawdown and buildup testing using such an automated multiple operating shut-in tool are provided. Associated automated sampling tools are also disclosed.

12 Claims, 30 Drawing Sheets

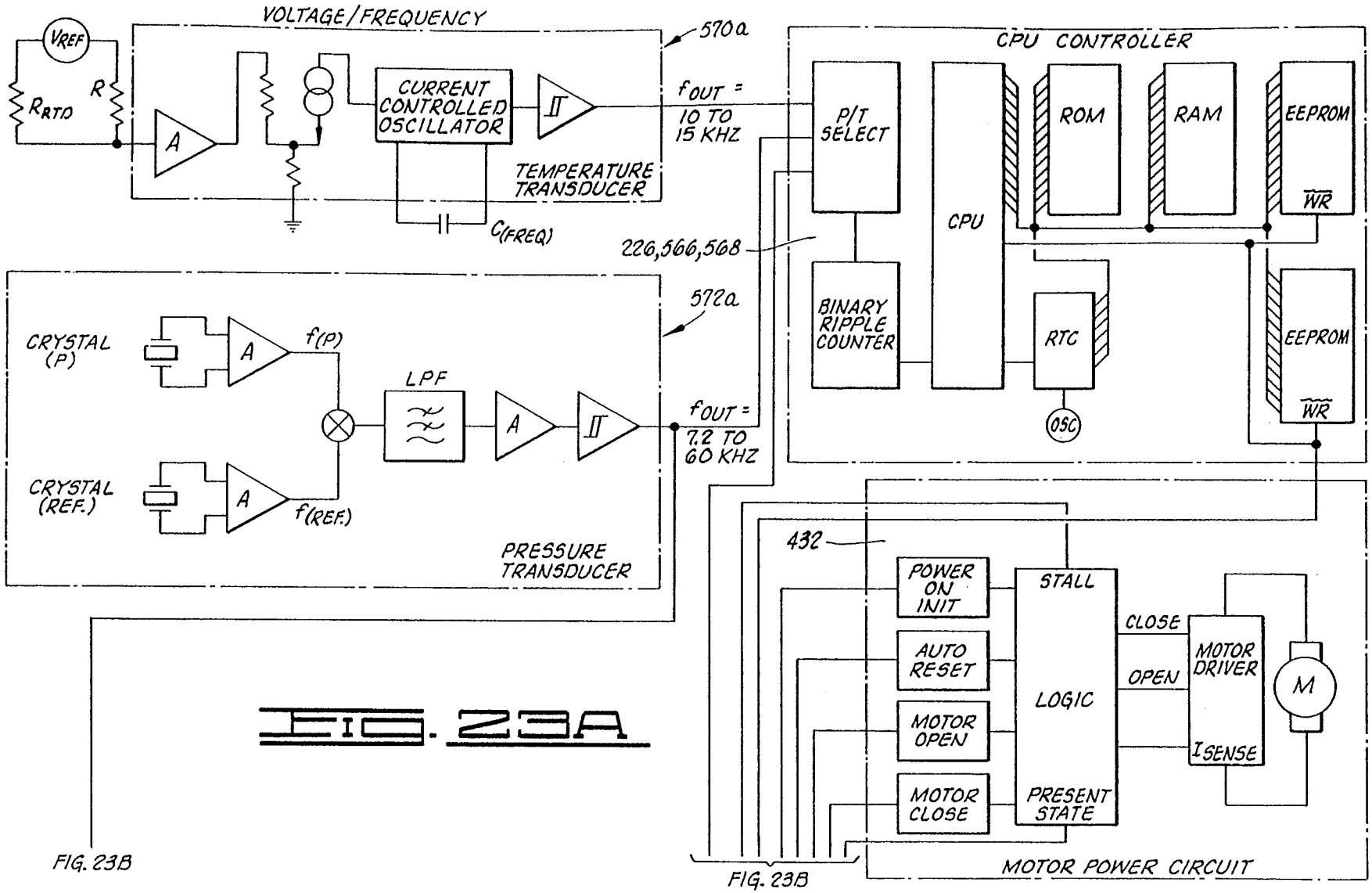
CPU CONTROLLER
EEPROM
WR
EEPROM
WR
RAM
ROM
RTC
OSC
CPU
P/T SELECT
BINARY RIPPLE COUNTER
MOTOR POWER CIRCUIT
M
MOTOR DRIVER
I SENSE
CLOSE
OPEN
STALL
LOGIC
PRESENT STATE
POWER ON INIT
AUTO RESET
MOTOR OPEN
MOTOR CLOSE
432
FIG. 23B
570a
$f_{OUT}$ = 10 TO 15 KHZ
226,566,568
572a
$f_{OUT}$ = 7.2 TO 60 KHZ
VOLTAGE/FREQUENCY
TEMPERATURE TRANSDUCER
CURRENT CONTROLLED OSCILLATOR
C(FREQ)
PRESSURE TRANSDUCER
LPF
f(P)
f(REF.)
CRYSTAL (P)
CRYSTAL (REF.)
VREF
R
RRTD
FIG. 23A
FIG. 23B

SHUT-IN TOOLS

This is a divisional of copending U.S. application(s) Ser. No. 07/868,832 filed on Apr. 14, 1992, now U.S. Pat. No. 5,234,057, which was a continuation-in-part of U.S. Ser. No. 07/730,211 filed on Jul. 15, 1991 now abandoned.

BACKGROUND OF THE INVENTION

1. Field of the Invention.

The present invention relates generally to downhole shut-in tools, to methods using such shut-in tools, to various control systems therefor and related devices used therewith.

2. Description of the Prior Art.

Drawdown and buildup tests are often performed on production wells at regular intervals to monitor the performance of the producing formations in the well. A typical test setup usually includes a downhole closure valve, i.e. a shut-in valve, which is placed in the well and manipulated by slick line. There is usually a pressure recording gauge below the downhole shut-in valve which records the pressure response of the formation being tested as the valve is opened and closed. The formation is allowed to flow for a sufficient length of time to insure that it is drawn down to a desired level. After this drawdown period is complete, the shut-in valve is used to shut in the well. The formation pressure is allowed to buildup for a sufficient interval of time to allow it to reach a desired level, before another drawdown period is started. The entire process is then sometimes repeated immediately to acquire more pressure data from another drawdown/buildup test.

As mentioned, shut-in valves of the prior art have typically been actuated by mechanical means and particularly by means of mechanical actuators lowered on a slick line.

SUMMARY OF THE INVENTION

The present invention provides numerous substantial improvements in shut-in valves.

In a first aspect of the invention, an improved shut-in valve is disclosed which utilizes a pilot valve to direct a pressure differential across a piston which in turn closes the shut-in valve, so that the force for closing the shut-in valve is provided by the pressure differential which is defined between a low pressure zone of the tool and the higher pressure well fluid contained in the production tubing.

In a second aspect of the invention an improvement is provided in the context of an electric timer and control system which opens the pilot valve after a predetermined time delay. The electric timer and control system is also applicable to other types of downhole tools, such as for example a sampler tool like that shown in U.S. patent application Ser. No. 07/602,840 of Schultz et al. entitled Well Bore Fluid Sampler, filed Oct. 24, 1990, now U.S. Pat. No. 5,058,674, the details of which are incorporated herein by reference.

In another aspect of the invention the pilot valve can selectively communicate high and low pressure zones to opposite sides of an actuating piston so as to repeatedly open and close a device.

In another aspect of the invention a pressure differential between the interior of a production tubing string and a low pressure zone defined in the tool can be selectively applied across an actuating piston to open and close a shut-in valve.

In yet another aspect of the invention a method of efficient drawdown and buildup testing of a completed producing well is provided. Drawdown and/or buildup periods of the testing are monitored to determine when a downhole parameter such as pressure has stabilized, and then the position of the shut-in tool is automatically changed so as to minimize the time required to conduct drawdown and buildup testing.

In yet another aspect of the invention the control of the automated shut-in tool is provided by a microprocessor based programmed processor means.

In another aspect of the invention, the control of the automated shut-in tool, or other downhole device, is provided by a controller that can effectively detect different points on a pressure buildup and drawdown curve, or other monitored parameter that changes over time, and different time periods during which the monitored parameter is within a selected range of a prior value of the parameter.

In still another aspect of the invention an automated sampling device is provided which cooperates with the automated shut-in tool to take samples at preferred times during the drawdown/buildup test sequence.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 6 is a block diagram of the control system.

FIG. 16 is a flow chart illustrating the functions performed by the electronic control package of the automated shut-in tool of FIGS. 10A–10H.

FIGS. 23A and 23B include a schematic diagram of a hardware-implemented controller that can be used to automatically control a downhole apparatus, such as a shut-in tool or a sampler tool.

DETAILED DESCRIPTION OF THE PREFERRED EMBODIMENTS

Figure 7:
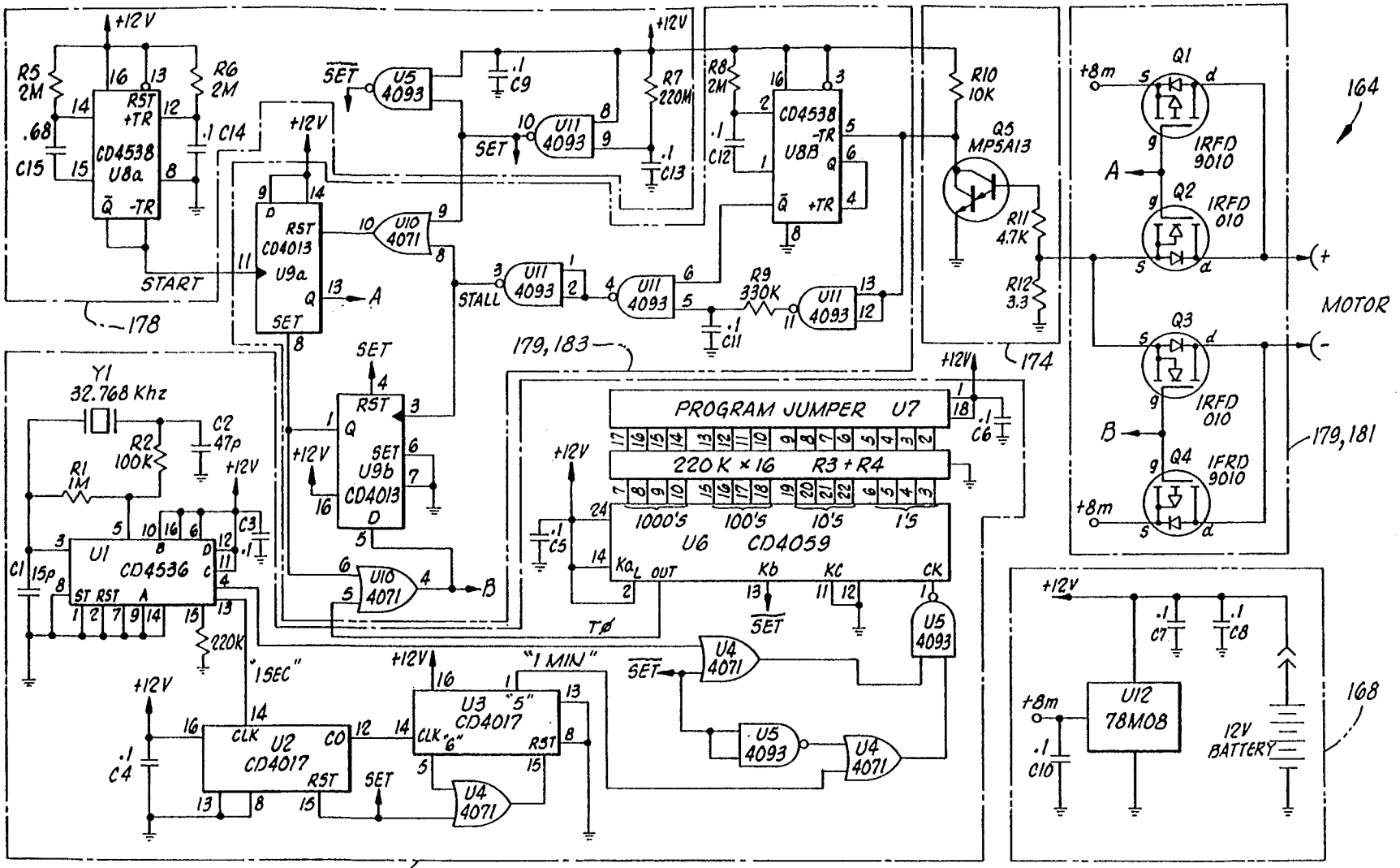
FIG. 7 is a schematic circuit diagram implementing the block diagram of FIG. 6.

The first three sections of this disclosure under the headings "Single Action Shut-In Tool", "Summary of Operation of Single Action Shut-In Tool" and "Detailed Operation of Circuitry of FIG. 7" describe the subject matter of FIGS. 1–7 as was previously set forth in U.S. application Ser. No. 07/730,211 filed Jul. 15, 1991, now abandoned, entitled SHUT-IN TOOL WITH ELECTRIC TIMER, of which the present application is a continuation-in-part. The remaining portions of the application describe the multiple shut-in tool and associated sampler and recorder/master controller of FIGS. 8–24.

Single Action Shut-In Tool

Figure 1A:
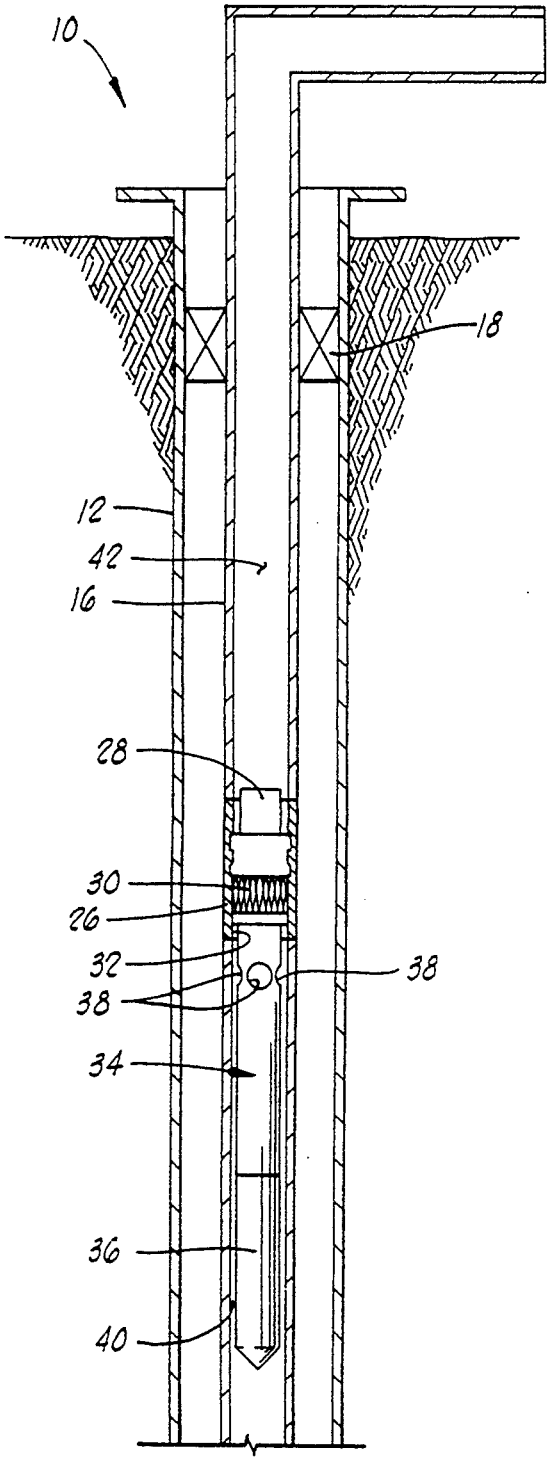
FIGS. 1A–1B comprise a schematic elevation sectioned view of a single action shut-in tool in place in a production tubing string of a well.
Figure 1B:
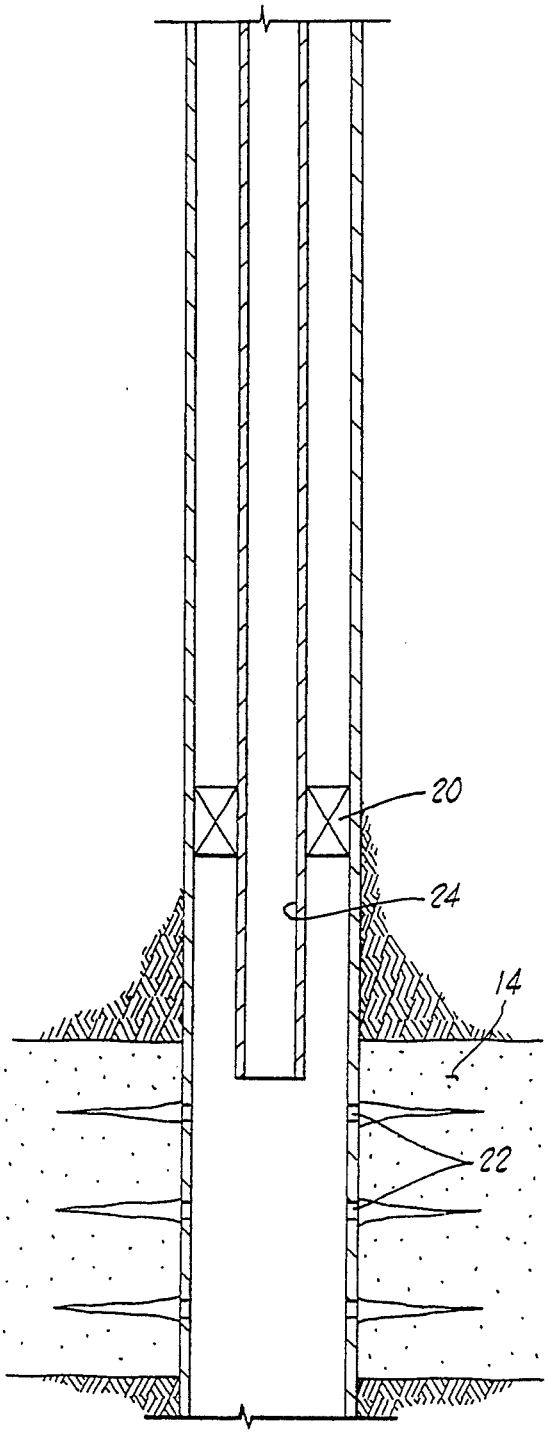

Referring now to the drawings, and particularly to FIGS. 1A–1B, an oil well is there shown and generally designated by the numeral 10. The well 10 is defined by a casing 12 disposed in a bore hole which intersects a subterranean hydrocarbon producing formation 14. A production tubing string 16 is in place within the well casing 12 and is sealed against the casing 12 by upper and lower packers 18 and 20. A plurality of perforations 22 extend through the casing 12 to communicate the interior of the casing 12, and a lower interior 24 of the production tubing string 16 with the subsurface formation 14, so that well fluids such as hydrocarbons may flow from the formation 14 through the perforations 22 and up through the production tubing string 16.

A landing nipple 26 is made up in the production tubing string 16 before the production tubing string 16 is placed within the well 10. A landing locking tool 28, also referred to as a lock mandrel 28, is shown in place locked within the landing nipple 26. The landing locking tool 28 carries packing 30 which seals within a seal bore 32 of landing nipple 26.

The shut-in valve apparatus 34 is connected to the landing locking tool 28 and suspended thereby from the landing nipple 26. A pressure recording apparatus 36 is connected to the lower end of the shut-in valve apparatus 34.

The shut-in valve apparatus 34 has a plurality of flow ports 38 defined through the housing thereof as seen in FIG. 1A. When the shut-in valve apparatus is in an open position, well fluids can flow from the formation 14 up through the interior 24 of production tubing string 16 as seen in FIG. 1B, then up through an annular space 40 defined between the production tubing string 16 and each of the shut-in valve apparatus 34 and pressure recording apparatus 36, then inward through the flow ports 38 and up through an inner bore of the shut-in valve apparatus 34 and the landing locking tool 28 up into an upper interior portion 42 of production tubing string 16 which carries the fluid to the surface. When the flow port means 38 of shut-in valve apparatus 34 is closed, no such flow is provided and the fluids in subsurface formation 14 are shut in so that they cannot flow up through the production tubing string 16 past the landing nipple 26.

The landing nipple 26 and landing locking tool 28 are themselves a part of the prior art and may for example be an Otis ® X ® landing nipple and lock mandrel as is available from Otis Engineering Corp. of Dallas, Texas.

The landing locking tool 28 with the attached shut-in valve apparatus 34 and pressure recording apparatus 36 is lowered down into the production string 16 on a slick line (not shown) and locked in place in the landing nipple 26 when it is desired to run a drawdown/buildup test. After the test is completed, the slick line is again run into the well and reconnected to the landing locking tool 28 in a known manner to retrieve the landing locking tool 28 with the attached shut-in valve apparatus 34 and pressure recording apparatus 36.

Referring now to FIGS. 2A–2E an elevation section view is thereshown of the shut-in tool apparatus 34.

The shut-in valve apparatus 34 includes a housing assembly 44 extending from an upper end 46 to a lower end 48. The housing assembly 44 includes from top to bottom a plurality of housing sections which are threadedly connected together. Those housing sections include an upper housing adaptor 50, a ported housing section 52, a shear pin housing section 54, an intermediate housing section 56, an intermediate housing adaptor 58, an air chamber housing section 60, a pilot valve housing section 62, a guide housing section 64, a control system housing section 66, and a lower housing adaptor 68.

The housing 44 has a housing bore 70 generally defined longitudinally through the upper portions thereof. The flow ports 38 previously mentioned are disposed in the ported housing section 52 seen in FIG. 2A and communicate the housing bore 70 with the annular space 40 of interior 24 of production tubing string 16.

The upper housing adaptor 50 has internal threads 72 for connection to the landing locking tool 28. The lower housing adaptor 68 includes a threaded extension 74 for connection to the pressure recording apparatus 36.

Figure 2A:
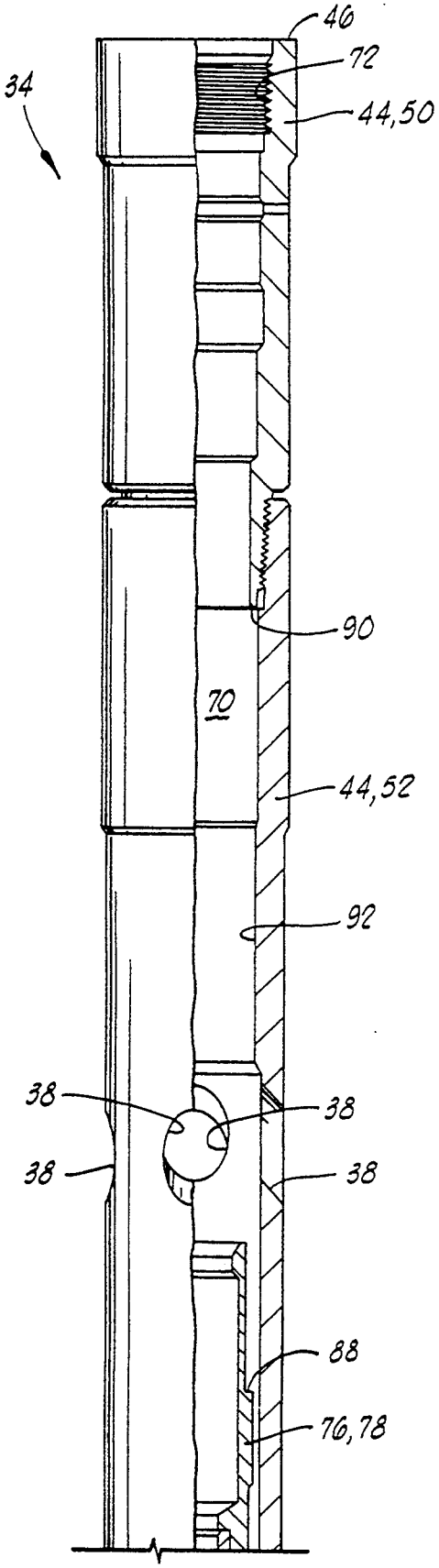
FIGS. 2A–2E comprise an elevation partially sectioned view of the single action shut-in tool of FIG. 1A.
Figure 2B:
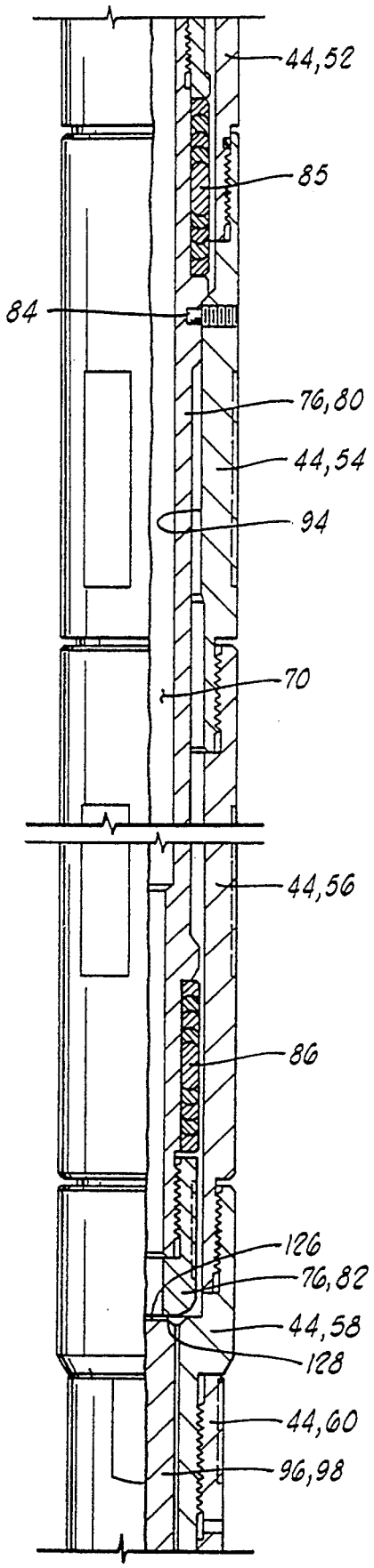

As seen in FIGS. 2A–2B, a shut-in valve assembly 76 comprised of upper portion 78, intermediate portion 80, and lower portion 82 is slidably received within the housing bore 70 below the flow ports 38. Shear pin means 84 initially holds the shut-in valve assembly 76 in its open position as seen in FIGS. 2A–2B. The shut-in valve assembly 76 carries upper and lower packings 85 and 86, respectively, of such a size as to seal the housing bore 70 above and below flow ports 38 when the shut-in valve assembly 76 is moved upward to a closed position as further described below. When the shut-in valve assembly 76 is moved upward to its closed position, the shear pin means 84 will shear and the shut-in valve assembly 76 will move upward until an upward facing shoulder 88 thereof engages a lower end 90 of the upper housing adaptor 50 thus stopping upward movement of the shut-in valve assembly 76 in a position defined as a closed position. When the shut-in valve assembly 76 is in that closed position, the upper and lower packings 85 and 86 will be sealingly received within housing bore portions 92 and 94, respectively.

A differential pressure actuating piston 96 has an elongated upper portion 98 and an enlarged lower end portion 100. The enlarged lower end portion 100 carries a sliding O-ring seal and backup ring assembly 102 which is sealingly slidingly received within a bore 104 of air chamber housing section 60. The elongated upper portion 98 of differential pressure actuating piston 96 is closely received within a lower bore 106 of intermediate housing adaptor 58 with an O-ring seal 108 being provided therebetween. Thus a sealed annular chamber 110 is defined between upper seal 108 and lower seal 102, and between the elongated upper portion 98 of differential actuating piston 96 and the bore 104 of air chamber housing section 60. This sealed chamber 110 is referred to as an air chamber 110 or low pressure zone 110 and is preferably filled with air at substantially atmospheric pressure upon assembly of the tool at the surface.

A pilot valve port 112 is defined through the side wall of pilot valve housing section 66 and communicates the interior 24 of production tubing string 16 with a passageway 114 which extends upward and communicates with a lower end 116 of the differential pressure actuating piston 96.

The differential pressure actuating piston 96 can be described as having first and second sides 118 and 116. The first side 118 is the annular area defined on the upper end of enlarged portion 100 and has an area defined between seals 108 and 102. The first side 118 is in communication with the low pressure air chamber 110.

A pilot valve element 120 is slidably disposed in housing 44 and carries a pilot valve seal 122 which in a first position of the pilot valve element 120 is sealingly received within a lower bore 124 of air chamber housing section 60 to isolate the lower end 116 of actuating piston 96 from the pilot valve port 112.

In a manner further described below, the pilot valve element 120 can be moved downward relative to housing 44 to move the seal 122 out of bore 124 thus communicating pilot valve port 112 with the lower end 116 of differential pressure actuating piston 96 so that a pressure differential between the well fluid within production tubing string 16 and the low pressure zone 110 acts upwardly across the differential area of actuating piston 96 to move the same upwards within housing 44. As the differential pressure actuating piston 96 moves upward, its upper end 126 engages a lower end 128 of shut-in valve assembly 76. The shear pin means 84 will then be sheared and the differential pressure actuating piston 96 will move upward pushing the shut-in valve assembly 76 upward until its shoulder 88 engages lower end 90 of upper housing adaptor 50 thus defining a second position of the actuating piston 98 corresponding to the closed position of the shut-in valve assembly 76.

Located below the pilot valve element 120 are a number of components which collectively can be referred to as an actuator apparatus 130 for a downhole tool and particularly as an actuator apparatus 130 for opening the pilot valve 120 of the shut-in valve apparatus 34.

The actuator apparatus 130 includes a mechanical actuator means 132 for actuating or opening the pilot valve 120. The actuator apparatus 130 also includes an electric motor drive means 134 operably associated with the mechanical actuator means 132 for moving the mechanical actuator means 132.

The mechanical actuator means 132 includes a lead screw 136 defined on a rotating shaft 138 of electric motor drive means 134. Mechanical actuator means 132 also includes a threaded sleeve 140 which is reciprocated within a bore 142 of guide housing section 64 as the lead screw 136 rotates within a threaded inner cylindrical surface 144 of sleeve 140. Mechanical actuator means 132 can also be described as including a lower extension 135 of the pilot valve 120 and an annular flange 137 extending radially outward therefrom.

Sleeve 140 has a radially outward extending lug 146 received within a longitudinal slot 148 defined in a lower portion of the guide housing section 64, so that the sleeve 140 can slide within guide housing section 64, but cannot rotate therein. Similarly, the sleeve 140 has a slot 150 defined therein within which is received a lug 152 attached to the lower extension 135 pilot valve element 120. Thus, a lost motion connection is provided between the sleeve 140 and the pilot valve element 120. Further, the threaded engagement between sleeve 140 and the lead screw 136 translates rotational motion of the shaft 148 into linear motion of the sleeve 140 which is in turn relayed to the pilot valve element 120.

Figure 2C:
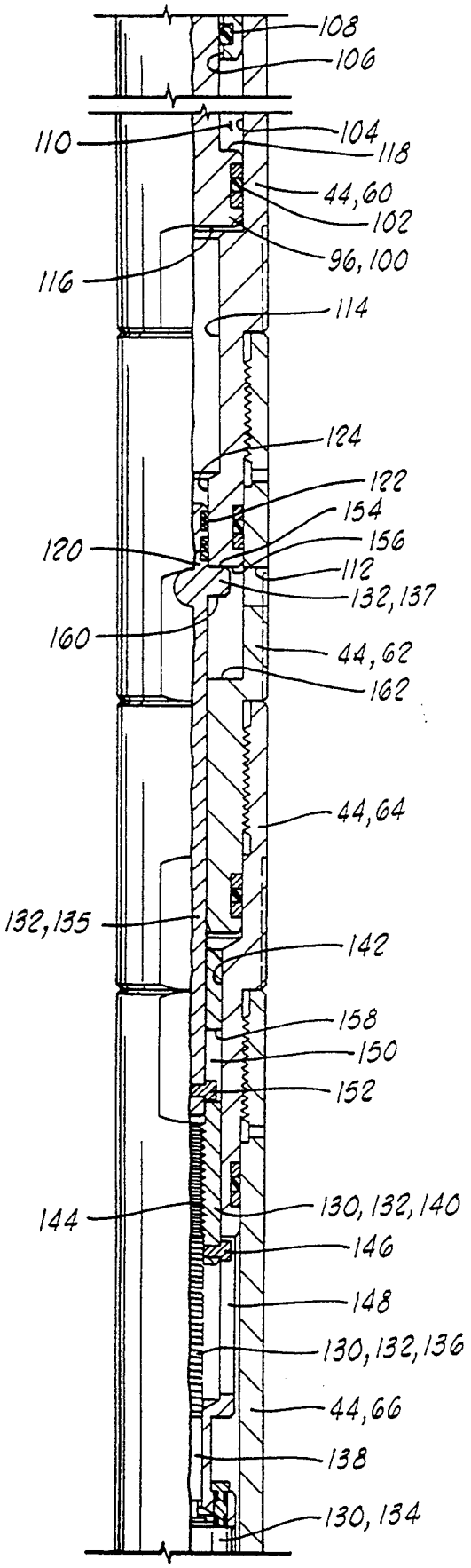
Figure 2D:
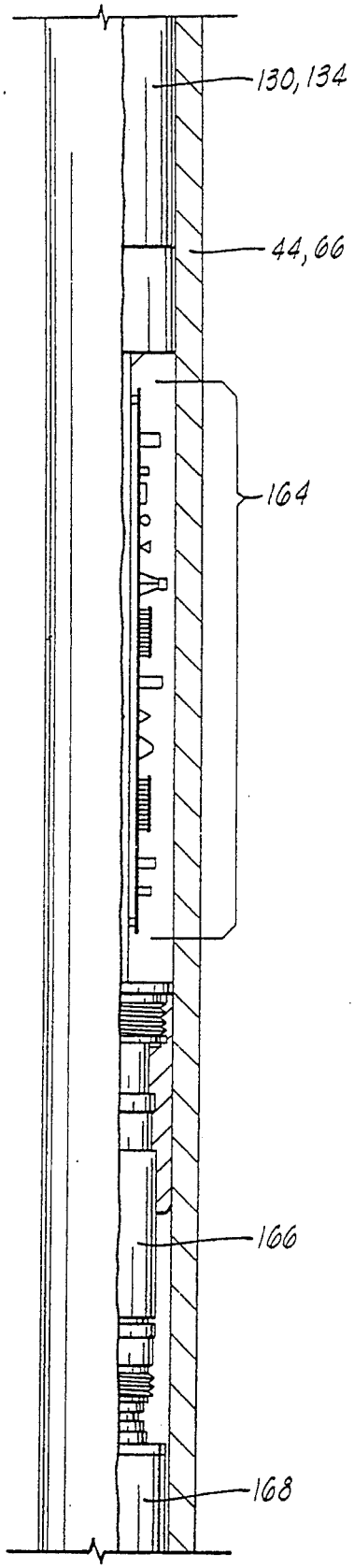
Figure 2E:
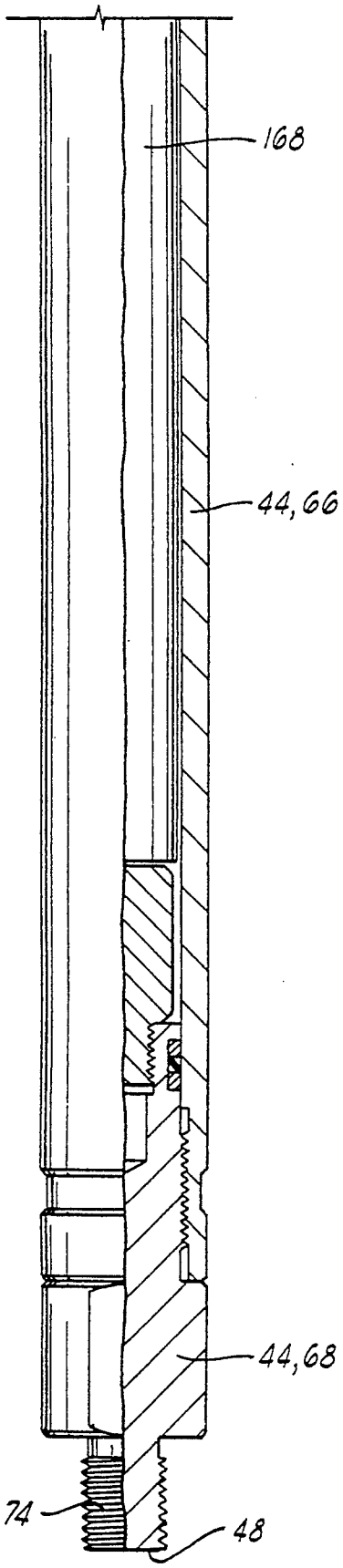

In FIG. 2C, the components just described are illustrated in their initial or first position wherein the pilot valve element 120 is closed, and more particularly, where an annular shoulder 154 of flange 137 is abutted against a first abutment 156 of housing 44 which is defined by a lower end 156 of the air chamber housing section 60.

In the view of FIG. 2C, the shaft 138 and lead screw 136 have been rotated to move the sleeve 140 upward until the lower end of slot 150 engages lug 152 which in turn then caused pilot valve element 120 to move upward until shoulder 154 abutted first abutment 156 of housing 44.

The abutment 156 may be generally described as a first abutment means 156 for abutting the mechanical actuator means 132 to limit movement thereof and thereby define a first position of the mechanical actuator means 132 corresponding to a closed position of the pilot valve 120.

As will be further described below, in a subsequent operation the electric motor drive means 134 will be run in a reverse direction so as to rotate the lead screw 136 in a reverse direction and cause the sleeve 140 to move downward in housing 44. The sleeve 44 will move downward until the upper end 158 of slot 150 engages the lug 152 thus pulling pilot valve element 120 downward until lower annular shoulder 160 abuts a second upward facing abutment 162 of the housing 44. The upward facing second abutment 162 can be generally described as a second abutment means for abutting the mechanical actuator means 132 and defining a second position thereof corresponding to the open position of pilot valve element 120.

Figure 3:
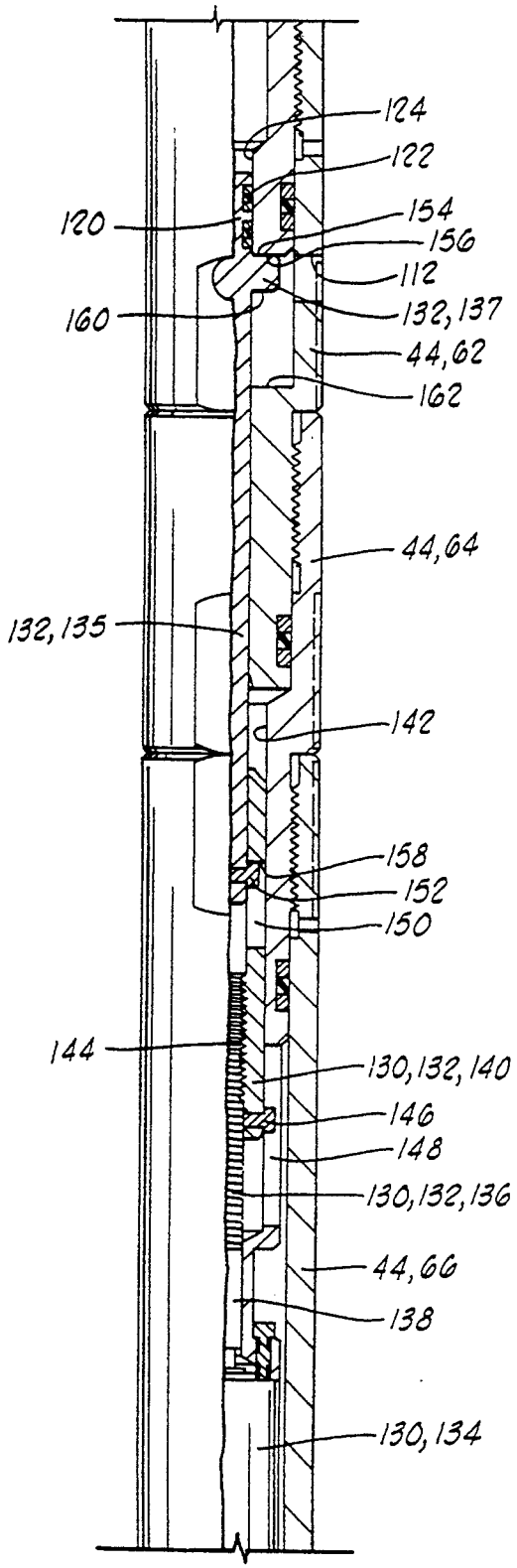
FIGS. 3 and 4 are illustrations similar to FIG. 2C showing sequential positions of the actuating apparatus of FIGS. 2A–2E as the pilot valve means is opened.
Figure 4:
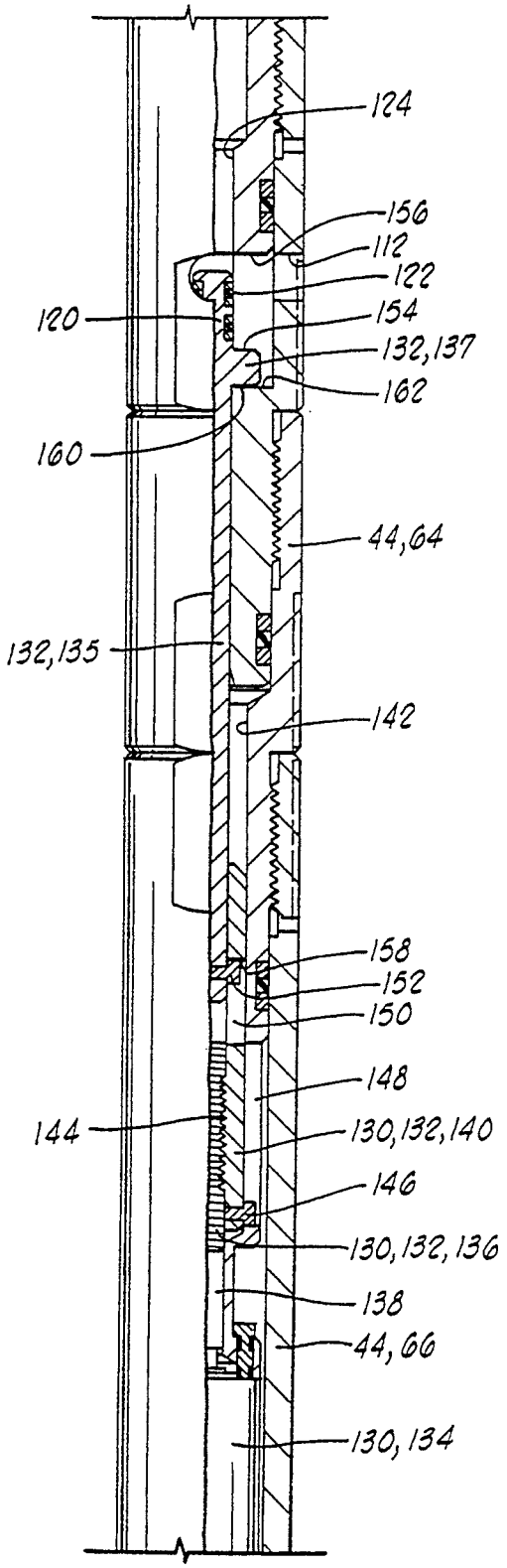

FIGS. 3 and 4 are similar to FIG. 2C and they illustrate the movement of the mechanical actuator means 132 from its first or closed position of FIG. 2C through an intermediate position in FIG. 3 to its second or open position in FIG. 4.

In FIG. 3, the sleeve 140 has moved downward until the upper end 158 of slot 150 engages lug 152 so that further movement of the sleeve 140 will pull the pilot valve element 120 downward.

FIG. 4 shows the sleeve 140 having moved downward to its fullest extent thus pulling the pilot valve element 120 completely open, with the shoulder 160 abutting the second abutment 162.

The electric motor drive means 134 includes a gear reducer (not shown). Connected to the lower end of the electric motor drive means 134 is an electronics package or control system 164. Below that is an electrical connector 166 which connects an electrical battery power supply 168 with the control system 164.

Figure 5:
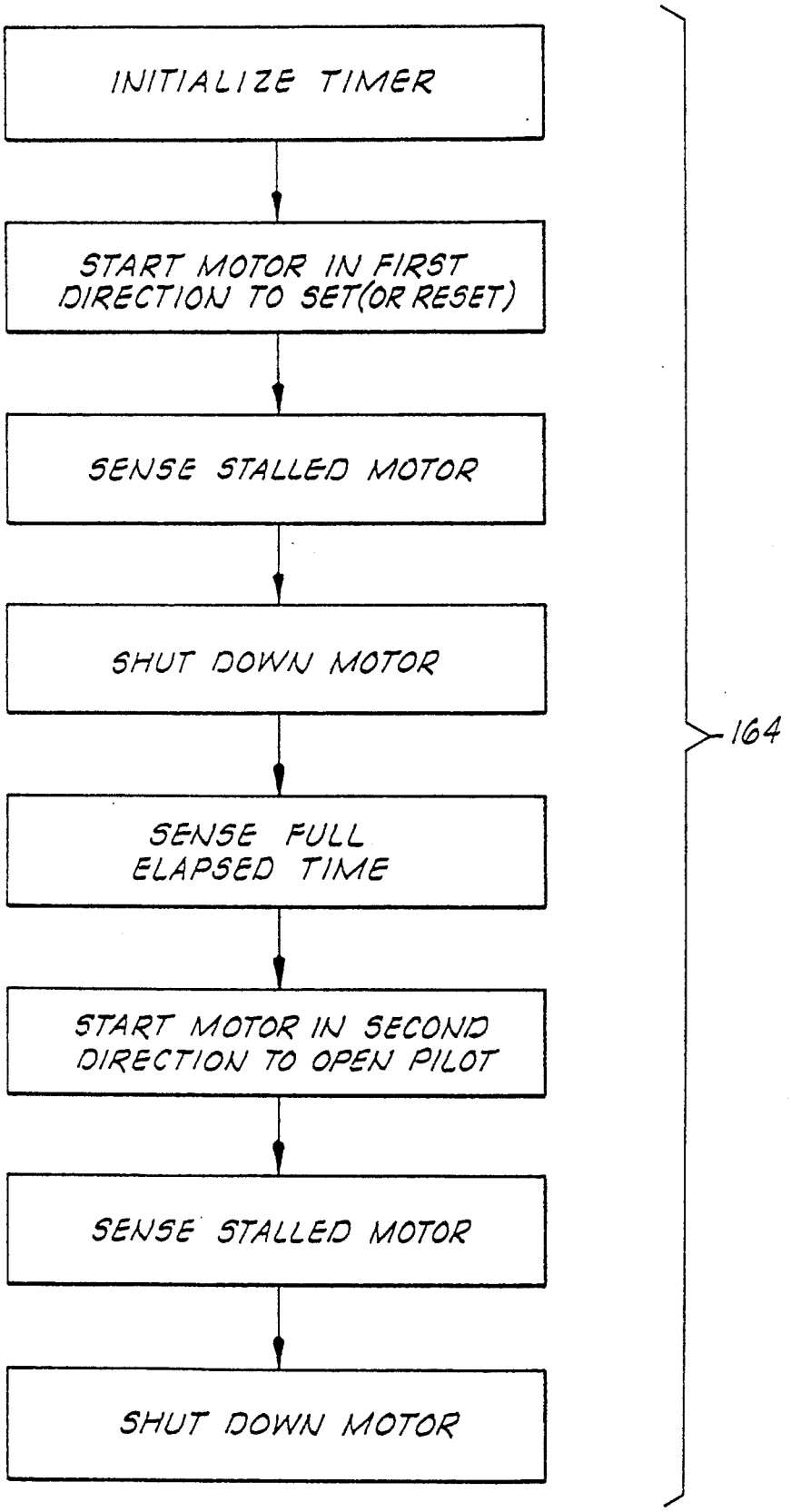
FIG. 5 is a sequential function listing for the operations carried out by the control system for the apparatus of FIGS. 2A–2E.
Figure 5:
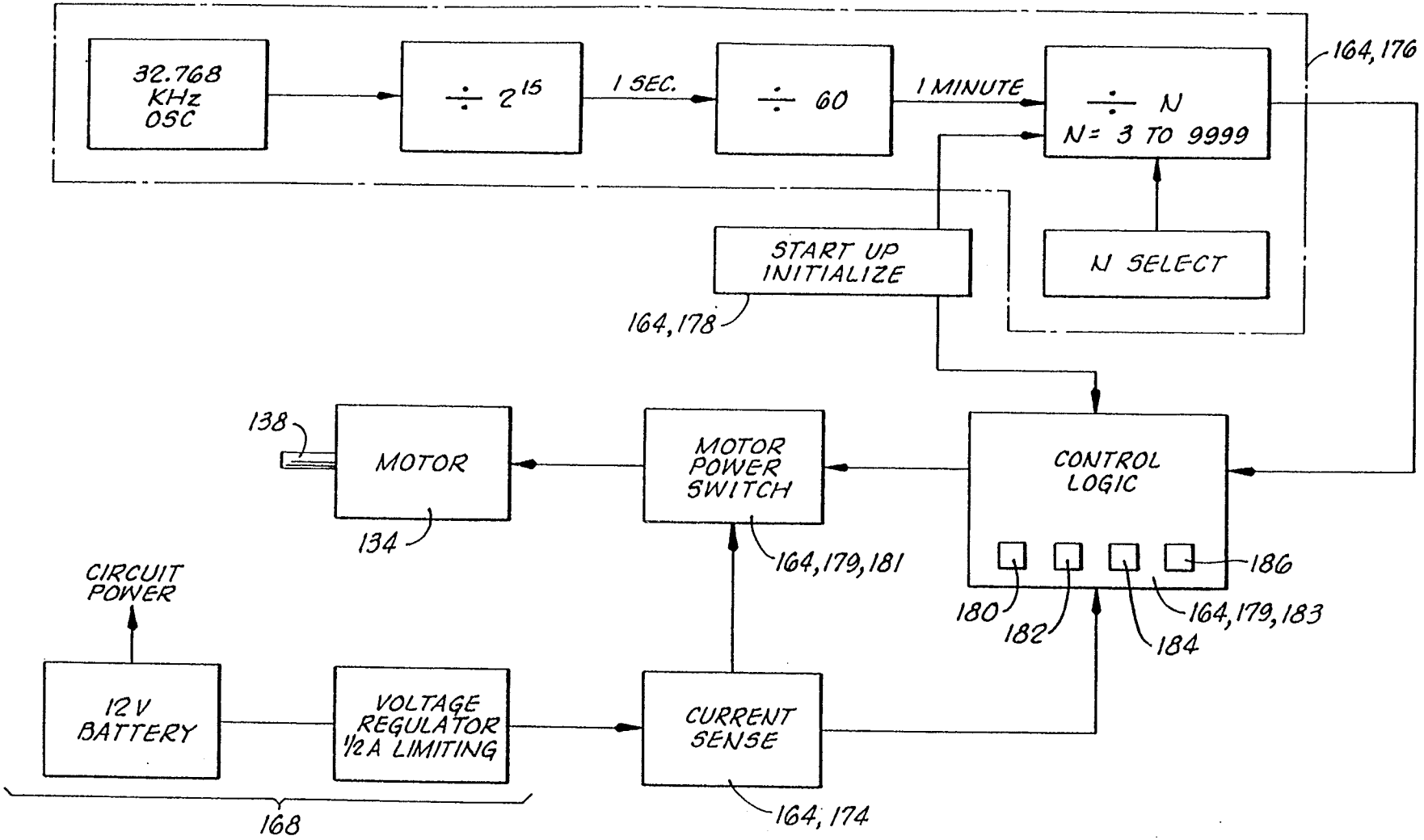

The electric motor 134, control system 164, and power supply 168 are schematically illustrated in the block diagram of FIG. 6. FIG. 5 is a sequential function listing which represents the operating steps performed by the control system 164. It will be appreciated that the control system 164 may be microprocessor based, or may be comprised of hard wired electric circuitry.

As described above, as the electric motor drive means 134 drives the mechanical actuator means 132 in either direction, the mechanical actuator means 132 will ultimately run up against an abutment means which prevents further movement thereof. When this occurs, the shaft 138 of electric motor drive means 134 can no longer rotate and the electric motor drive means 134 is stalled. When the electric motor drive means 134 stalls it will draw an increased current from electronics package 164 which controls the flow of current from power supply 168 to the electric motor drive means 134.

The control system 164 includes a load sensing means 174 for sensing an increased load on the electric motor drive means 134, and preferably for sensing an increased current draw thereof, when the mechanical actuator means 132 abuts an abutment so that further motion thereof is prevented. The control means 164 provides a means for controlling the electric motor drive means 134 in response to the load sensing means 174 as is further described below with reference to FIGS. 5, 6 and 7.

The control system 164 further includes a timer means 176 for providing a time delay before the drive means 134 moves the mechanical actuator means 132 to open the pilot valve 120.

The control system 164 further includes a start-up initialize means 178 for setting and/or resetting the timer means 176 and starting a timing period thereof upon assembly of the apparatus 34 as further described below.

The control system 164 also includes a power switching means 179 which includes motor power switching circuit 181 and control logic circuit 183.

The start-up initialize means 178 also activates a first start-up means 180 of power switching means 179 for starting the electric motor drive means moving in a first direction so as to move the sleeve 140 upward to the position shown in FIG. 2C wherein the shoulder 154 is abutted with first abutment 156. The load sensing means 174 operates a first shut-down means 182 of power switching means 179 for shutting down the electric motor drive means 134 when it stalls out in the position of FIG. 2C.

The power switching means 179 further includes a second start-up means 184 for starting up the electric motor drive means 134 to run in a second direction so as to move the sleeve 140 downward after a time delay programmed into the timer means 176 has elapsed. A second shut-down means 186 shuts off the electric motor drive means 134 in response to a signal from the load sensing means 174 indicating that the drive motor 134 has again stalled out when the mechanical actuator means 132 has engaged the second abutment 162.

The start-up and shut-down means 180, 182, 184 and 186 are provided by various combinations of logic states A and B of the detailed circuitry shown in FIG. 7. Those logic states are further described below.

Summary of Operation of Single Action Shut-In Tool

The general operation of the control system 164 is best described with reference to the sequential function listing of FIG. 5.

When the apparatus 34 is first assembled at the surface before it is placed within the production tubing string 16, the initial connection of the power supply 168 to the control system 164 by connector 166 starts a series of operations represented in FIG. 5. First the timer 176 is reset (see SET and SET in the FIG. 7 embodiment) and then starts running. It will be appreciated that the timer 176 is previously set (see Program Jumper of FIG. 7) for a predetermined time delay which is needed before the shut-in tool apparatus is to be actuated. This time delay must be sufficient to allow the shut-in tool apparatus 34 to be placed in the production tubing string 16 as shown in FIGS. 1A–1B and for the flow of production fluid up through the production fluid string 16 to reach a steady state at which point it is ready to be shut in so that the shut-in pressure test can be conducted.

Additionally, upon initial connection of the control system 164 to the power supply 168, the first start-up means 80 starts the electric motor drive means 134 running in a first direction so as to move the sleeve 140 upward (A=logic 1 and B=logic 0 in FIG. 7 embodiment).

When the mechanical actuator means 132 engages the first abutment 156 the load sensor 174 will sense that the motor 134 has stalled, and the first shut-down means 182 will then shut down the electric motor 134 (A=logic 0 and B=logic 0 in FIG. 7 embodiment).

Nothing further will happen until the timer means 176 generates a command signal indicating that the full time delay programmed therein has elapsed. In response to that command signal, the control system 164, and particularly the second start-up means 184 thereof will cause the electric motor drive means 134 to start up in the opposite direction from which it originally turned so as to cause the sleeve 140 to be moved downward thus pulling the pilot valve element 120 to an open position (A=logic 0 and B=logic 1 in FIG. 7 embodiment).

This will continue until the mechanical actuator means 132 abuts the second abutment 162 at which time the motor 134 will again stall. The load sensor 174 will again sense that the motor 134 has stalled, and in response to a signal from the load sensor 174 the second shut-down means 186 will shut down the electric motor drive means 134 (A=logic 1 and B=logic 1 in FIG. 7 embodiment).

Thus the pilot valve 120 will remain in an open position which allows the pressure differential between the production fluid and the low pressure zone 110 to move the differential pressure actuating piston 96 upwardly thus moving the shut-in valve element assembly 76 upwardly to close the flow ports 38 thus shutting in the well.

After the well is shut in, the pressure will rise and that pressure rise will be monitored and recorded as a function of time by the pressure recording apparatus 36 in a well known manner.

Subsequently, a retrieving tool (not shown) is run into the production string 36 and engages the locking landing tool 28 to retrieve the locking landing tool 28, shut-in tool apparatus 34, and pressure recording apparatus 36 from the well.

After the shut-in valve apparatus 34 is retrieved from the well, it can be reset so as to be subsequently run back into the well very simply. All that is necessary is for the power supply 168 to be disconnected from control system 164, and then subsequently reconnected-When the power supply 168 is reconnected to the control system 164 the timer 176 will be reset, the motor 134 will be started up in a first direction so as to move the mechanical actuator means 132 and the pilot valve element 120 back to the closed position of FIG. 2C, and then the other steps illustrated in FIG. 5 will be performed in sequence. Of course it is necessary for the shut-in valve apparatus 34 and particularly the shut-in valve assembly 76 to be manually reset and for the shear pins 84 to be replaced therein.

The use of the load sensing means 174 to sense the position of the electric motor drive means 134 and particularly of the mechanical actuator means 132 replaces limit switches which are typically used to determine such positions. As will be appreciated by those skilled in the art, limit switches are often unreliable in operation, and further take significant room in the assembly.

Additionally, the use of limit switches requires that fairly close tolerances be kept on the various mechanical components to insure that the limit switch will in fact be actuated when the mechanical components reach their desired locations. These close mechanical tolerances are eliminated by use of the present system which merely provides the abutments 156 and 162 which rigidly limit the movement of the moving mechanical parts. This allows relatively loose tolerances to be used on the various mechanical parts since they need only be sized so as to insure that the abutments will in fact be engaged.

Detailed Operation Of Circuitry Of FIG. 7

The following is a description of the operation of the preferred circuitry for control system 164 shown in FIG. 7. FIG. 7 is a circuit diagram implementing the block diagram of FIG. 6. Functional portions of the circuitry corresponding to the block diagram of FIG. 6 are enclosed in phantom lines and like reference numerals indicate like elements.

At the application of power, a positive going pulse of about 20 Ms is generated by the NAND gate UII (pin 10). This pulse is labeled SET, and it is used to initialize the flip flop U9, and the counter-dividers U2 and U3. The SET pulse is inverted by U5, which creates $\overline{SET}$. $\overline{SET}$ is used with the gating arrangement U4 and U5, and the U6 configure line "Kb", to provide preset requirements for U6, the divide by N counter. During this first 20 mS, U9, U2 and U3 are initialized, and U6 is loaded with the desired delay count, selected by the program jumper U7. The oscillator, U1 and Y1, is allowed to start running immediately at power up, because its 32 kHz output is required during the first 20 mS, again for preset requirements of U6. The timer system, U1, U2, U3 and U6 begins to count down at the end of the SET pulse.

The one-shot U8*a* provides a greater than one second delay from power up before issuing a START signal. This was done to allow the circuitry to be initialized and stabilized before the motor load is connected. At START, the flip flop U9*a* produces a high at A, which starts the motor reversing. This mode gives the operator easy means to initialize the valve assembly when readying the tool for a job.

At the end of valve travel, a mechanical stop is encountered, which causes the motor to stall, causing an increase in motor current. This current increase becomes sufficient at a point to cause transistor Q5 to switch on, generating a trigger for the one-shot U8*b*. U8*b* along with the three NAND gates U11, form a timed event qualifier, which requires that the stall indication from Q5 be present for at least 200 mS (approximately), before a STALL pulse will be generated. This prevents the system from stalling from start-up surges, or other brief load surges. The first legitimate STALL resets U9*a*, bringing A low, and removing power from the motor.

The timer continues to count down until Tϕ occurs, which brings B high, and starts the motor in the forward direction to open the pilot valve assembly 120. Again valve travel continues until a mechanical stop is encountered, which again generates a STALL pulse. This second STALL pulse clocks the high level at B through the flip flop U9*b*, which latches into a condition with its Q output high. This also provides a high to the set input of U9*a*, which causes its Q output also to latch high. This gives a high level at both A and B, and again removes power from the motor.

The system remains in this state until power is removed, and reapplied. The states of the A and B outputs resulting from the foregoing are as follows:

| Event | A | B | Motor |
|---|---|---|---|
| SET | 0 | 0 | Off |
| START | 1 | 0 | Reverse (close pilot valve 120) |
| STALL | 0 | 0 | Off |
| Tϕ | 0 | 1 | Forward (open pilot valve 120) |
| STALL | 1 | 1 | Off |

Multiple Action Shut-In Tool

Figure 8A:
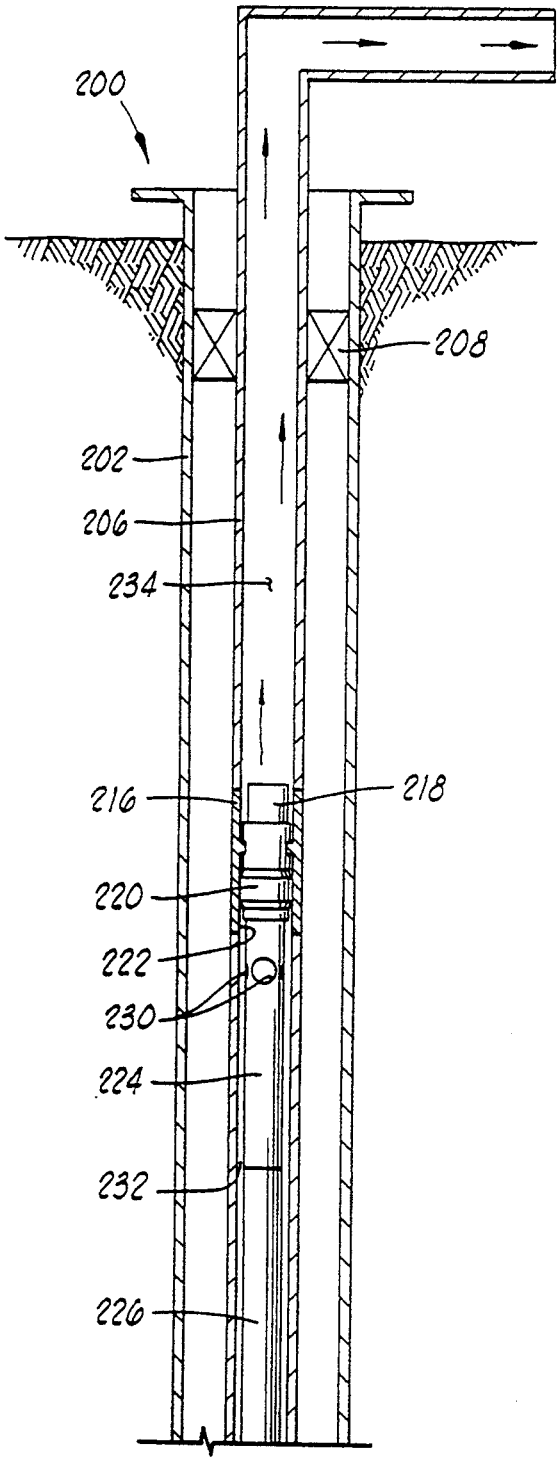
FIGS. 8A–8B comprise a schematic elevation sectioned view of a multiple action shut-in tool and an associated downhole recorder/master controller, and sampling apparatus in place in a production tubing string of a well.
Figure 8B:
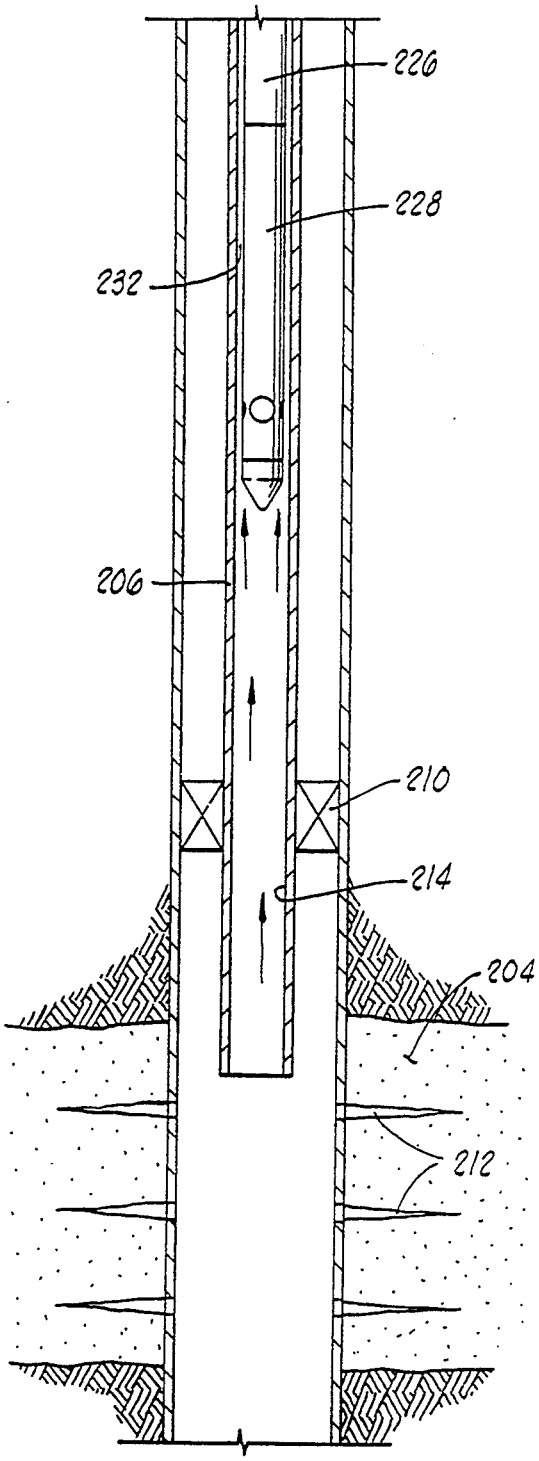

FIGS. 10A–10H illustrate a multiple action shut-in tool which can be repeatedly opened and closed to perform multiple drawdown and buildup tests. FIGS. 8A–8B schematically illustrate such a multiple shut-in tool and associated apparatus in place in a production tubing string of a well generally designated by the numeral 200.

The well 200 is defined by a casing 202 disposed in a bore hole which intersects the subterranean hydrocarbon producing formation 204. A production tubing string 206 is in place within the well casing 202 and is sealed against the casing 202 by upper and lower packers 208 and 210. A plurality of perforations 212 extend through the casing 202 to communicate the interior of the casing 202, and a lower interior 214 of the production tubing string 206 with the subsurface formation 204, so that well fluids such as hydrocarbons may flow from the formation 204 through the perforations 212 and up through the production tubing string 206.

A landing nipple 216 is made up in the production tubing string 206 before the production tubing string 206 is placed within the well 200. A landing locking tool 218 also referred to as a lock mandrel 218 is shown in place locked within the landing nipple 216. The lock mandrel 218 carries packing 220 which seals within a seal bore 222 of landing nipple 216.

A multiple shut-in valve apparatus 224 is connected to the lock mandrel 218 and suspended thereby from the landing nipple 216. An electronic master controller and pressure and temperature recording apparatus 226 is connected to the lower end of shut-in tool 224. An automatically controlled fluid sampling apparatus 228 is connected below the recorder/master controller 226.

The shut-in tool 224 has a plurality of flow ports 230 defined through the housing thereof as seen in FIG. 8A. When the shut-in tool 224 is in an open position, well fluid can flow from the formation 204 up through the interior 214 of production tubing string 206 as seen in FIG. 8B, then up through an annular space 232 defined between the production tubing string 206 and each of the shut-in tool 224, recorder/master controller 226, and sampler 228, then inward through flow ports 230 and up through an inner bore of the shut-in tool 224 and lock mandrel 218 up into an upper interior portion 234 of production tubing string 206 which carries the fluid to the surface. When the flow ports 230 of shut-in tool 224 are closed, no such flow is provided and the fluids in subsurface formation 204 are shut in so that they cannot flow up through the production tubing string 206 past the landing nipple 216.

The landing nipple 216 and lock mandrel 218 are themselves a part of the prior art and may for example be an Otis® X® landing nipple and lock mandrel as is available from Otis Engineering Corp. of Dallas, Texas.

The lock mandrel 218 with the attached shut-in tool 224, recorder/master controller 226, and sampler 228 are lowered down into the production tubing string 206 on a slick line (not shown) and locked in place in the landing nipple 216. The assembly just described may also be assembled with the production tubing string and run into place with the production tubing string if the assembly is intended to be a permanent installation, which as further described below is possible with this embodiment.

The assembly may of course be retrieved by running a slick line into the well and engaging the lock mandrel 218 in a known manner to pull the same out of engagement with the landing nipple 216.

The shut-in tool 34 described above with regard to FIGS. 1–7 is capable of acting only one time. That is the shut-in tool 34 is run into the well in an open position, and it closes once to record a single shut-in test and then must be retrieved from the well.

It is often desirable to run multiple drawdown and build-up tests in succession. This cannot be done with the shut-in tool 34 of FIGS. 1–7.

Multiple drawdown and buildup tests have been performed with slick line actuated shut-in tools of the prior art. That is accomplished, however, only by manipulating the slick line from the surface. There is no real time feedback to the surface of any downhole parameter indicating what is actually going on in the well, thus it is difficult to know how long to keep the well shut in or how long to allow the well to flow. Accordingly, typical prior art methods will shut in the well for many hours and make certain that the shut-in bottom hole pressure has peaked, then the well will be open to flow for many hours, then it will again be shut in for many hours, and so forth. Ultimately, the shut-in tool is removed from the well after the test is complete.

Such drawdown and buildup tests are often performed on producing wells at regularly scheduled intervals to monitor the performance of the producing formations in the well. Such regularly scheduled testing requires a regular mobilization of the equipment and personnel necessary for running conventional prior art slick line actuated shut-in tools.

The embodiment disclosed herein in FIGS. 10A–10H shows an automatically controlled multiple shut-in tool 224 which is capable of repeated operation without the use of a slick line actuator. The multiple shut-in tool may be utilized in a number of ways. It can be utilized with a simple timing type controller similar to that described above for the single action shut-in tool 34 but being more sophisticated so as to allow multiple operation. Also, the multiple shut-in tool 224 can utilize a control system which monitors one or more downhole parameters and operates the multiple shut-in tool 224 in response to the monitored parameter.

Most preferably, the shut-in tool 224 and the associated recorder/master controller 226 can monitor the formation pressure or any other formation parameter or feedback, and automatically open and close the multiple shut-in valve 224 when the controlling parameter undergoes a specific pattern of change, or reaches a critical value. One preferred technique of control is to maintain the shut-in valve 224 closed until downhole pressure has stabilized and built up substantially to a peak value. Then the shut-in valve 224 is promptly opened so as to minimize the time interval over which the well is shut in. The opening of the shut-in tool 224 starts a draw-down period which is also monitored. When the bottom hole pressure has substantially reached a minimum value, the shut-in tool 224 can again be closed to promptly start another buildup period. Such a scenario provides very efficient methods of automatic drawdown and buildup testing which minimize the time required to complete the test.

Also, in suitable situations the multiple shut-in tool 224 and related apparatus may be left in the well on a semi-permanent basis and programmed to conduct regularly scheduled drawdown buildup tests without the need for mobilizing equipment and personnel. The data collected by the recorder/master controller 226 can be periodically retrieved in any one of a number of ways which are further described below.

Figure 9:
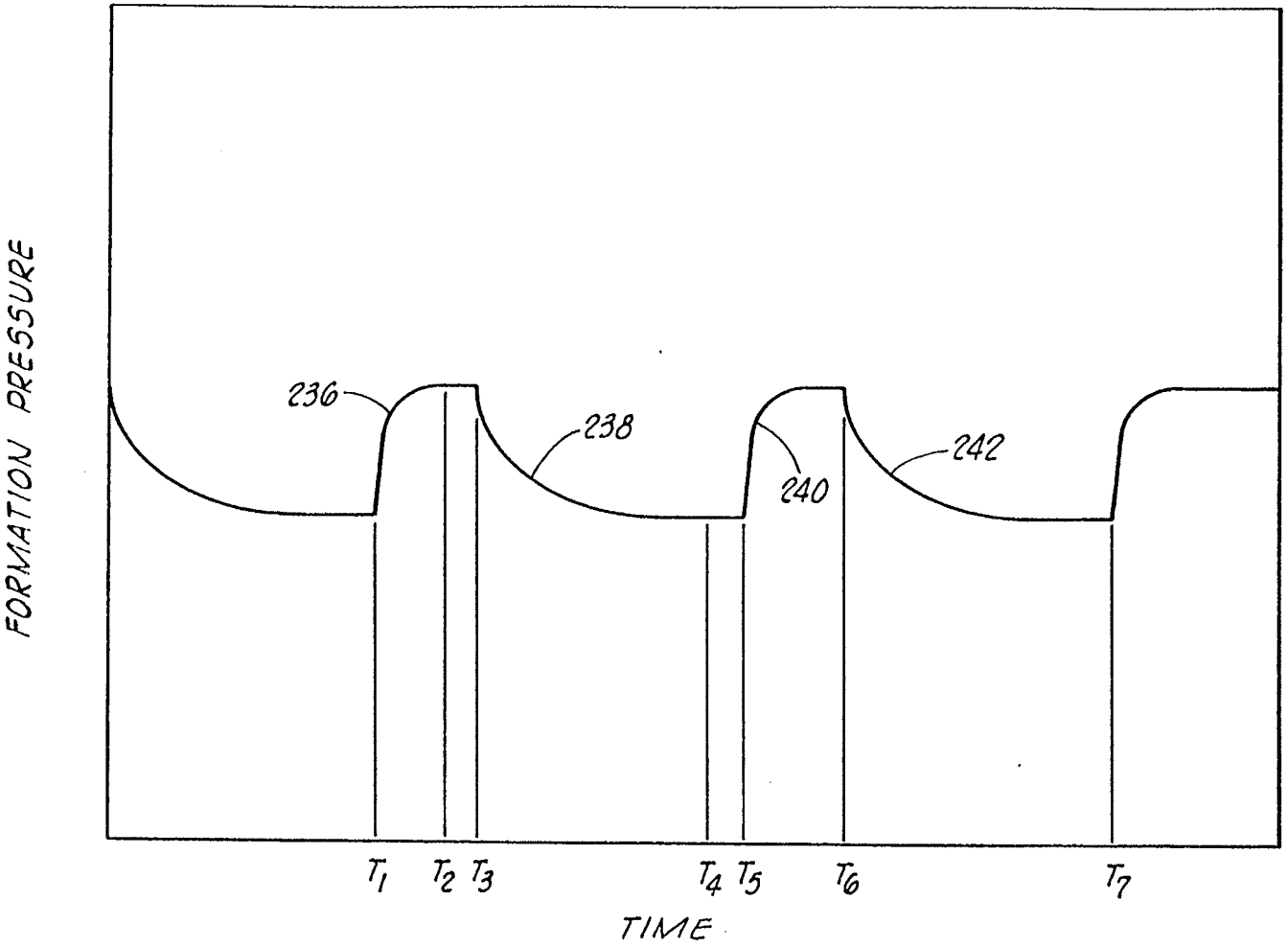
FIG. 9 is a graphical illustration of formation pressure versus time for a typical multiple drawdown and buildup test sequence.

FIG. 9 illustrates a typical pressure versus time plot as recorded by the recorder/master controller 226 during a multiple drawdown buildup test. Time $T_1$ represents the closing of shut-in tool 224 to begin a buildup test. Curve 236 represents the buildup of pressure in the lower portion of the production tubing string below shut-in tool 224. In the time interval from $T_2$ to $T_3$ it can be seen that the pressure is substantially stabilized. The recorder/master controller 226 is preferably programmed to recognize the stabilization in pressure and to promptly terminate the build- up test by opening shut-in tool 224 at time $T_3$ to start a drawdown test as represented by the curve 238. Similarly, the time interval from $T_4$ to $T_5$ represents an interval in which the pressure has again substantially stabilized at a minimum level. The recorder/master controller 226 may be programmed to recognize this stabilization and to promptly reclose shut-in tool 224 at time $T_5$ to start yet another buildup period as indicated by the curve 240. This can be repeated as often as necessary. In the curve shown in FIG. 9 at $T_6$, the shut-in tool is again opened to begin another drawdown interval represented by the curve 242. At time $T_7$, the shut-in tool 224 is again closed to begin yet another buildup interval.

The recorder/master controller 226 can also be programmed to operate the sampler apparatus 228 at a desired optimum time during the buildup drawdown testing represented in FIG. 9. As is further described below, there may be various preferred times for taking the sample. The recorder/master controller 226 can recognize the desired sampling time and actuate the sampler 228. Additionally, there can be multiple samplers like sampler 228 connected therebelow, and multiple samples can be taken at different selected times during a test sequence.

As stated earlier, this system can be programmed to test and sample a well at widely spaced intervals; for instance monthly testing and/or sampling.

Also it should be noted that although the present invention is disclosed in the context of drawdown and buildup testing in a producing well, some aspects of the invention may be applied to drill stem testing and exploratory well testing on uncompleted wells.

A number of advantages are provided by the use of the automatically controlled multiple shut-in tool. It allows periodic multiple drawdown and buildup testing of formations without multiple trips into the well. It allows well tests to be performed as efficiently as possible by monitoring formation responses or changes in formation conditions or parameters and setting test times accordingly. It allows for samplers or other devices to be operated automatically at optimum times during a test. It also allows for the automation of well testing programs even for long periods of time without the need for surface equipment and/or personnel mobilization to the well site.

The monitored bottom hole pressure may be generally referred to as a downhole parameter. It will be understood that the sensed value of the downhole parameter may be that value naturally produced by the well or it may be an artificial value such as that created when a pressure pulse is introduced to the well from the surface.

Detailed Description of the Multiple Shut-In Tool of FIGS. 10A–10H

FIGS. 10A–10H comprise an elevation sectioned view of the multiple shut-in tool 224 . The tool 224 includes a housing generally designated by the numeral 244. The housing 244 includes a number of tubular components threadedly connected together by conventional threaded connections with O-ring seals therebetween. From top to bottom the components of the housing 244 include flow port housing 246, intermediate adapter 248, high pressure chamber housing 250, spool valve body 252, low pressure chamber housing 254, actuator housing 256, motor housing 258, electronics housing 260 and lower adapter 262 .

The flow port housing section 246 of housing 244 has a housing bore 264 defined therein. Flow port housing section 246 also has the flow ports 230 defined laterally through a side wall thereof communicating the housing bore 264 with the lower interior 214 of production tubing string 206 to allow fluid flow inward through the flow ports 230 and up through the housing bore 264 and then up through the upper tubing interior 234.

Flow port housing 246 has an internally threaded upper end 266 for connection to the lock mandrel 218 or to an auxiliary equalizing sub (not shown) which may be located between the lock mandrel 218 and the flow port housing 246.

Figure 10A:
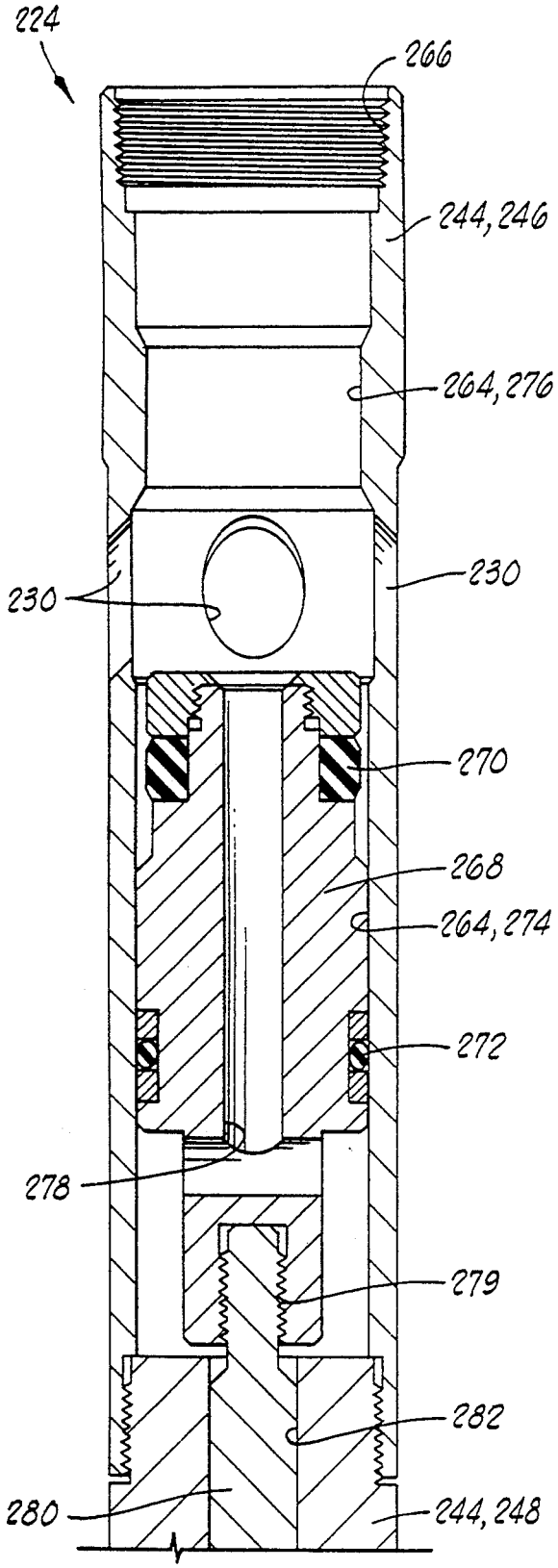
FIGS. 10A–10H comprise an elevation sectioned view of the multiple acting shut-in tool of FIGS. 8A–SB.
Figure 10B:
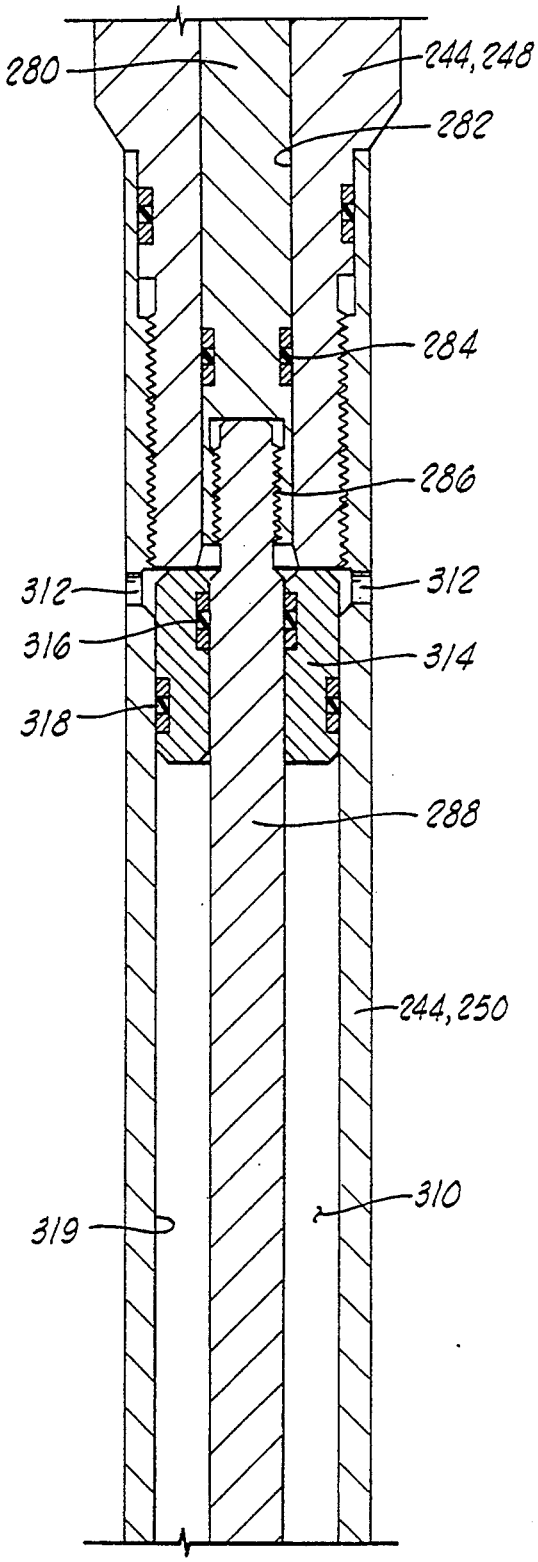
Figure 10C:
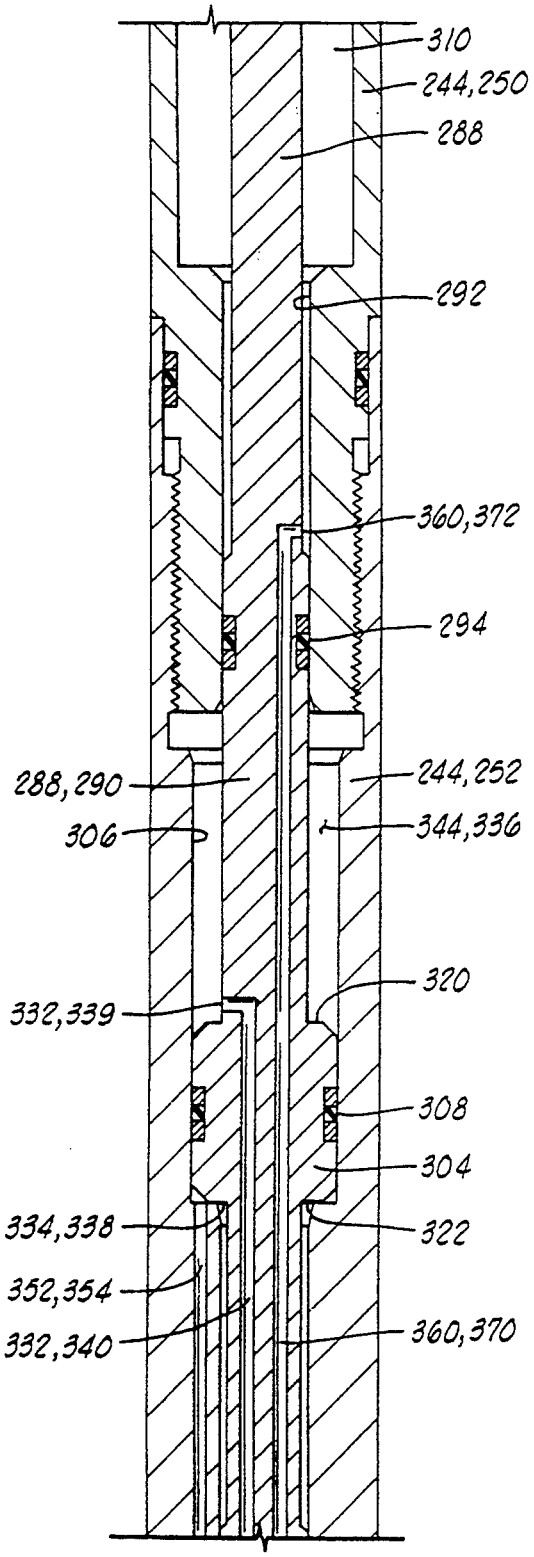

A shut-in valve element 268 is disposed in the housing bore 264 and is movable between an open position as shown in FIG. 10A wherein the flow ports 230 are opened and a closed position wherein the flow ports 230 are closed. Shut-in valve element 268 carries upper and lower annular seals 270 and 272, respectively. The lower seal 272 slidingly engages an enlarged diameter lower portion 274 of housing bore 264. When the shut-in valve element 268 moves upward relative to flow port housing 246 from the position shown in FIG. 10A, the upper seal 270 will move into and sealingly engage an upper portion 276 of housing bore 264 so that the flow ports 230 are closed between the seals 270 and 272.

Flow valve element 268 includes a balancing passage 278 defined therethrough for preventing hydraulic lockup as the shut-in valve element 268 slides within the housing bore 264.

The lower end of shut-in valve element 268 is threadedly connected at 279 to an upper actuating shaft 280 which is closely slidingly received within a bore 282 of intermediate adapter 248 with a sliding O-ring seal 284 provided therebetween. Upper actuating shaft 280 is threadedly connected at 286 to lower actuating shaft 288. Lower actuating shaft 288 has an enlarged diameter portion 290 which is closely slidably received within a lower bore 292 of high pressure chamber housing 250 with a sliding O-ring seal 294 provided therebetween.

A lowermost portion 296 of lower actuating shaft 288 is closely slidably received within a bore 298 of spool valve body 252 with upper and lower sliding O-ring seals 300 and 302 being provided therebetween.

An enlarged diameter differential pressure actuating piston 304 is integrally formed on lower actuating shaft 288 and is closely slidably received within a piston bore 306 of spool valve body 252 with a sliding O-ring piston seal 308 provided therebetween.

An annular high pressure zone or chamber 310 is defined between lower actuating shaft 288 and high pressure chamber housing 250. A plurality of high pressure ports 312 are disposed through the side wall of high pressure chamber housing 250 for communicating the high pressure zone 310 with the interior 214 and particularly with the annular space 232 of production tubing string 206. An annular floating piston 314 is slidably received within the annular high pressure zone 310. It carries an inner O-ring 316 which seals against the outside diameter of lower actuating shaft 288 and it carries an outer O-ring 318 which seals against a cylindrical inner surface 319 of high pressure chamber housing 250. The floating piston 314 separates clean hydraulic fluid which fills the high pressure zone 310 therebelow from well fluids which enter the high pressure ports 312 thereabove. From the description just given, it will be apparent that the high pressure zone 310, and particularly the clean hydraulic fluid contained therein below annular piston 314 will provide a supply of clean hydraulic fluid at a relatively high pressure which is equal to the pressure of well fluid within the interior 214 of production tubing string 206 surrounding the high pressure ports 312.

The differential pressure actuating piston 304 can be described as having first and second sides 320 and 322 which may also be referred to as upper and lower sides 320 and 322. The actuating piston 304 is operably associated with the shut-in valve element 268 through the upper and lower actuating shafts 280 and 288 so that the actuating piston 304 moves the shut-in valve element 268 between its open and closed positions as the actuating piston 304 reciprocates within the cylindrical bore 306.

The housing 244 also has defined therein a low pressure chamber 324 which upon assembly is filled with air at atmospheric pressure. As is further described below, the pressure differential between the high pressure chamber 310 and the low pressure chamber 324 is selectively applied across the differential area of the actuating piston 304 to move it up or down as desired to close and open the shut-in valve element 268. The differential area of actuating piston 308 is the annular area defined on the outside diameter by O-ring 308 and on the inside diameter by O-rings 294 and 300 which are of equivalent diameters.

Figure 10D:
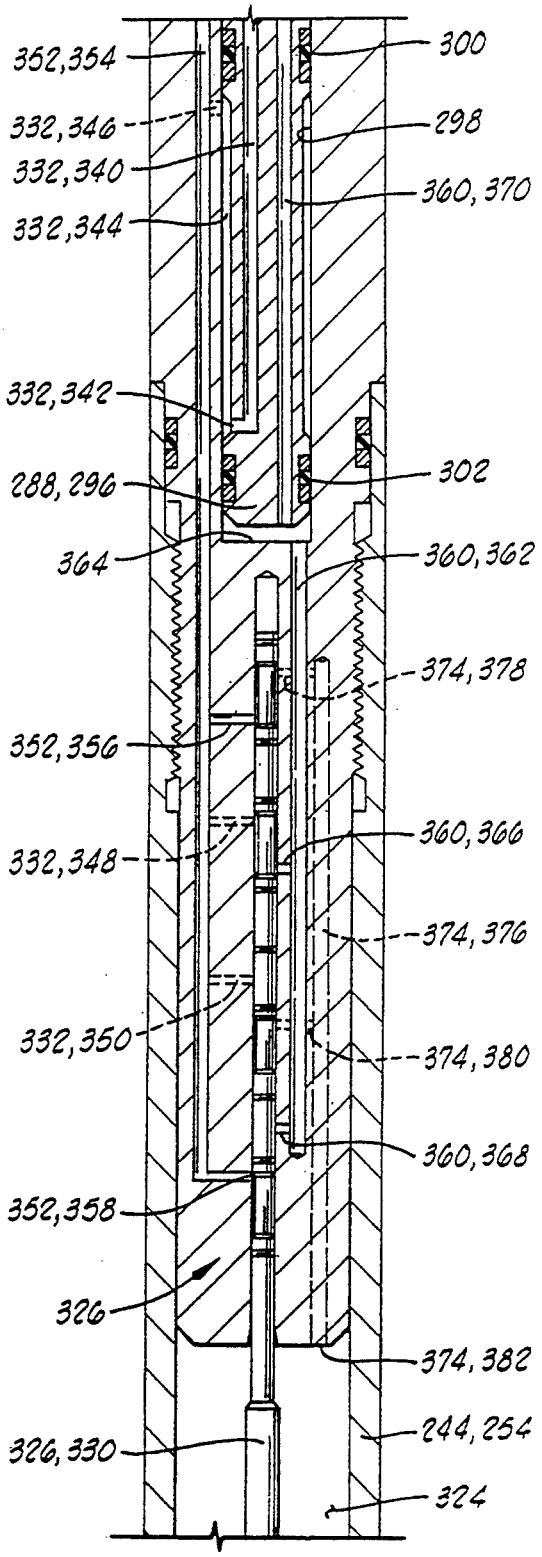

The control over communication of the high and low pressure zones 310 and 324 with the actuating piston 304 is provided by a pilot valve means generally designated by the numeral 326 in the lower portion of FIG. 10D. That portion of the apparatus 224 is shown in enlarged view in FIG. 11. The pilot valve means 326 can selectively communicate one of the first and second sides 320 and 322 of actuating piston 304 with the interior 214 of tubing string 206 through the high pressure zone 310, and simultaneously communicate the other of the first and second sides 320 and 322 with the low pressure zone 324 so that a pressure differential between the interior of the tubing string 206 and the low pressure zone 324 moves the actuating piston 304 and thus moves the shut-in valve element 268 between its open and closed positions.

The pilot valve means 326 includes a spool valve bore 328 defined in spool valve body 252 and includes a spool valve element 330 slidably received in the spool valve bore.

The housing 244 has a number of passages defined therein whereby the pilot valve means 326 can selectively communicate the upper and lower sides 320 and 322 of actuating piston 304 with the desired ones of high pressure zone 310 and low pressure zone 324. These include a first passage 332 communicating the first or upper side 320 of actuating piston 304 with the spool valve bore 328. The annular cavity 334 defined between bore 306 and the lower actuating shaft 288 can be described as having upper and lower portions 336 and 338, respectively, which are communicated with the upper and lower sides 320 and 322 of actuating piston 304.

The first passage 332 includes a radial port 339 which communicates upper chamber portion 336 with shaft passage 340 formed downward through the lower actuating shaft 288 and includes a lower lateral port 342 which communicates with a thin annular chamber 344 defined between bore 298 and lower actuating shaft 288 between seals 300 and 302.

A radial port 346 shown in dashed lines in FIG. 10D communicates annular chamber 344 with another longitudinal passage (not shown) which may be visualized as lying behind passage number 354 and leading downward to a lateral port 348 which communicates with the spool valve bore 328. That hidden passage also leads further downward to another lateral port 350. The arrangement of the lateral ports 348 and 350 may be better understood by viewing the schematic illustration in FIGS. 12 and 13.

A second passage 352 is provided through housing 244 for communicating the lower or second side 322 of actuating piston 304 with the spool valve bore 328. Second passage 352 includes an elongated bore 354 which is communicated with the lower portion 338 of chamber 334 and extends downward through the spool valve body 252 to lateral ports 356 and 358 which communicate the longitudinal passage 354 with spool valve bore 328.

A third passage 360 is defined in housing 244 and in part through actuating shaft 288 to communicate the spool valve bore 328 with the high pressure zone 310. Third passage 360 includes a longitudinal bore 362 extending through spool valve body 252 downward from a blind end 364 of bore 298 to two lateral ports 366 and 368 which communicate with spool valve bore 328. Third passage 360 also includes a longitudinal bore 370 extending upward through lower actuating shaft 288 and terminating in a lateral port 372 which is communicated with the high pressure zone 310.

A fourth passage 374 is defined in the housing 244 and communicates the spool valve bore 328 with the low pressure zone 324. Fourth passage 374 includes a longitudinal bore 376 defined in spool valve body 252 and intersecting first and second lateral ports 378 and 380 which are communicated with spool valve bore 328. An open lower end 382 of longitudinal bore 376 is in open communication with the low pressure zone 324.

Figure 12:
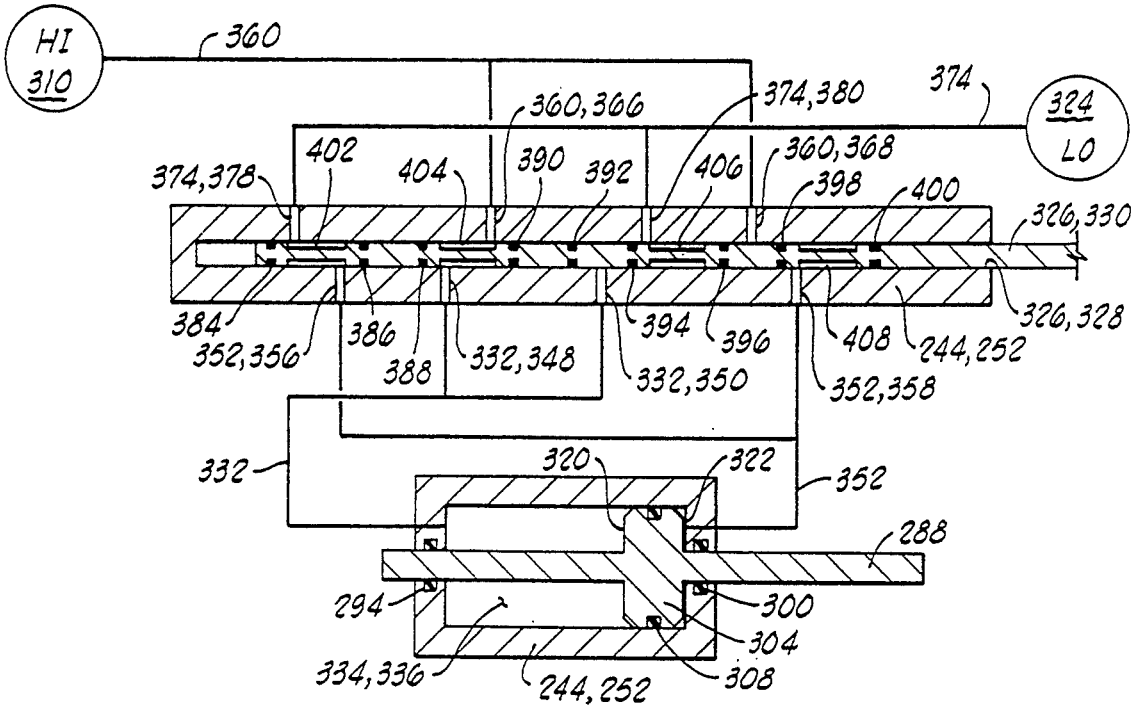
FIG. 12 is a hydraulic schematic illustration of the apparatus of FIGS. 10A–10H with the spool valve in a first position corresponding to an open position of the shut-in tool.
Figure 13:
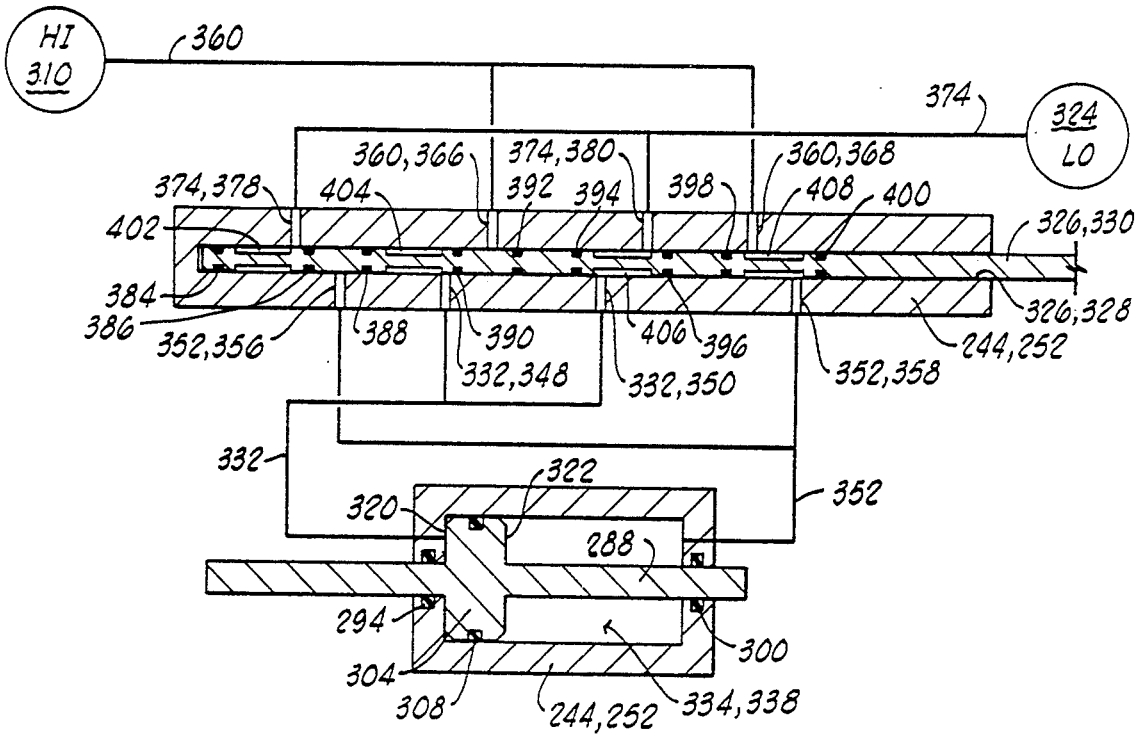
FIG. 13 is similar to FIG. 12 and shows the spool valve in a second position corresponding to a closed position of the shut-in tool.
Figure 11:
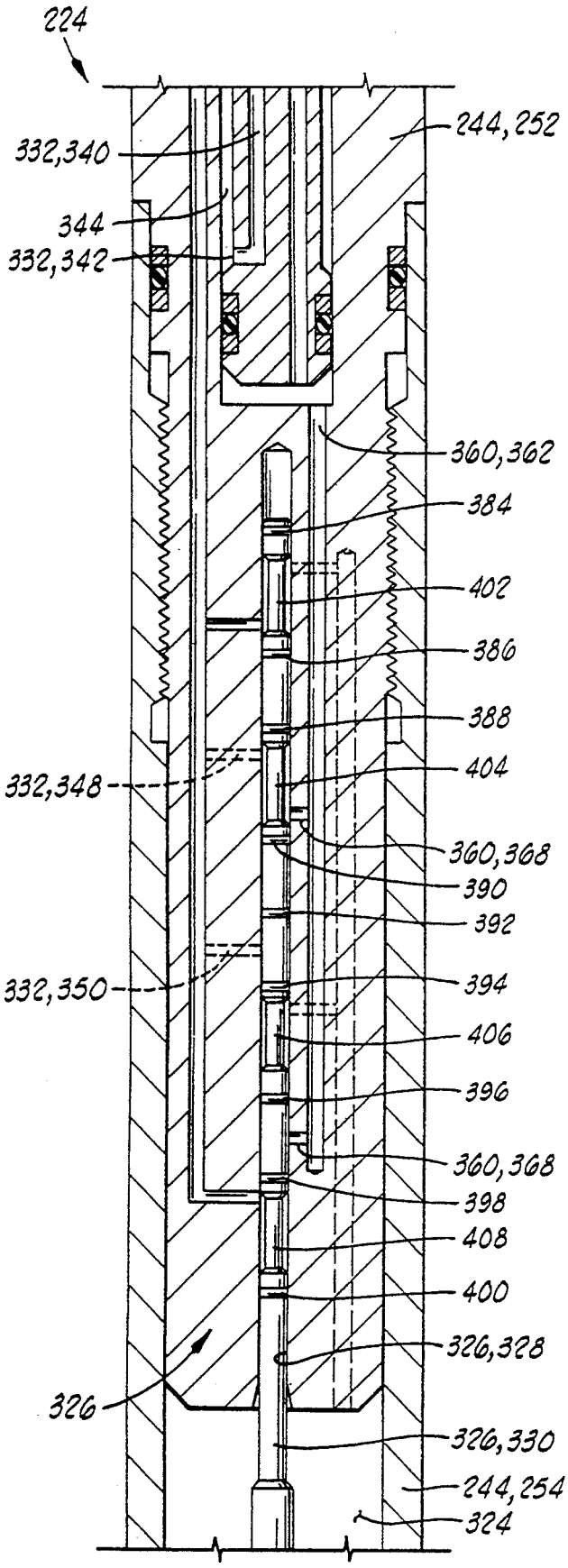
FIG. 11 is an enlarged elevation sectioned view of the lower portion of FIG. 10D showing more clearly the details of construction of the spool valve and related porting.

The manner in which the spool valve element 330 controls communication of high and low pressure to the selected sides of actuating piston 304 is best understood with reference to the schematic illustrations of FIGS. 12 and 13. In FIG. 12, the spool valve element 330 is illustrated in a first position relative to the spool valve bore 328 wherein the first passage 332 is communicated with the third passage 360 to communicate high pressure to the top side 320 of actuating piston 304, and wherein the second passage 352 is communicated with fourth passage 374 to communicate low pressure to the bottom side 322 of actuating piston 340 so as to move the actuating piston 304 to the position illustrated in FIG. 10C and FIG. 12 corresponding to the open position of the shut-in valve element 268.

In FIG. 13, the spool valve element 330 is shown in a second position relative to the spool valve bore 328. The spool valve element 330 has moved upward or from right to left from the position of FIG. 12 to the position of FIG. 13. In the second position illustrated in FIG. 13, the spool valve element 330 causes the first and fourth passages 332 and 374 to be communicated with each other and the second and third passages 352 and 360 to be communicated with each other so that low pressure is above actuating piston 304 and high pressure is below actuating piston 304 to move the actuating piston 304 upward or from right to left to the position of FIG. 13 corresponding to the closed position of the shut-in valve element 268.

The spool valve element 330 carries first, second, third, fourth, fifth, sixth, seventh, eighth and ninth O-rings 384, 386, 388, 390, 392, 394, 396, 398 and 400, respectively.

A first necked down portion 402 of spool valve element 330 is located between first and second seals 384 and 386 and can be described as forming a first annular chamber 402. A second necked down area forms a second annular chamber 404 between third and fourth seals 388 and 390. A third necked down area forms a third annular chamber 406 between sixth and seventh annular seals 394 and 396. A fourth necked down area forms a fourth annular chamber 408 between eighth and ninth O-rings 398 and 400.

When the spool valve element 330 is in the first position shown in FIG. 12, the first chamber 402 communicates second passage 352 with fourth passage 374. The second chamber 404 communicates first passage 332 with third passage 360.

In the second position of FIG. 13, the third chamber 406 communicates first passage 332 with fourth passage 374, and the fourth chamber 408 communicates second passage 352 with third passage 360.

By moving the spool valve element 330 back and fourth between its first and second positions of FIGS. 12 and 13, respectively, the shut-in valve element 268 can be moved between its open and closed positions, respectively, to perform multiple drawdown and buildup tests on the subsurface formation 204.

The shut-in tool 224 may operate as many times as the oil capacity in oil chamber 310 allows and as the capacity of the dump chamber 324 will accommodate.

The spool valve element 330 is reciprocated within the spool valve bore 328 by means of an electric motor driven lead screw type actuator apparatus 410 similar to the actuator apparatus 130 described above with reference to FIGS. 2C–2D. Actuator apparatus 410 includes an electric motor 412 which rotates a motor shaft 414.

Figure 10E:
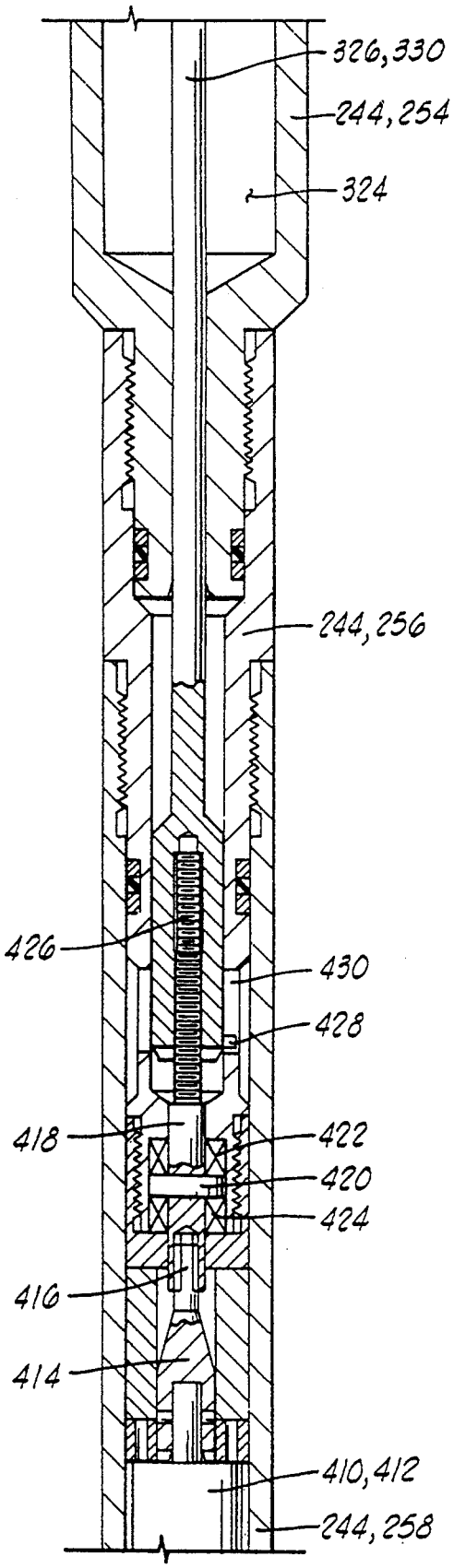

Motor shaft 414 is splined at 416 to lead screw 418. Lead screw 418 carries a radially outward extending flange 420 which is sandwiched between thrust bearings 422 and 424. Lead screw 418 engages an internal thread 426 of a bore in the lower end of spool valve element 330 so as to cause the spool valve element 330 to reciprocate as the lead screw 418 rotates. Spool valve element 330 carries a radially outward extending lug 428 which is received within a slot 430 defined in actuator housing section 256 to prevent rotation of spool valve element 330. Upward and downward movement of spool valve element 330 is limited by engagement of lug 428 with the upper and lower ends of slot 430. Abutment of lug 428 with the lower end of slot 430 as illustrated in FIG. 10E corresponds to the first position of spool valve element 330 as seen in FIG. 12. Abutment of lug 428 with the upper end of slot 430 corresponds to the second position of spool valve element 330 seen in FIG. 13.

An electronics package 432 controls flow of power from batteries 434 to the motor 412 to control the operation of motor 412. In the preferred embodiment illustrated, the electronics package 432 is a slave unit which operates in response to a command signal from a master control system contained in recorder/master controller 226 via electrical conductors 436 extending downward through bore 438 in lower housing adapter 262. The electronics package 432 is designed to provide power in the appropriate direction to motor 412 to cause it to rotate so as to move the spool valve element 330 either upward or downward in response to closing and opening command signals, respectively, received from the master control system in recorder/master controller 226. Electronics package 432 is constructed in a manner similar to the electronics package 164 of FIG. 7 in that it is designed to sense when the lug 428 abuts against an end of slot 430 thus stalling out motor 412. Upon sensing such a stalled condition, the electronics package 432 terminates power to the motor 412 until an appropriate command signal is received from master controller 226 to restart the motor 412 and rotate it in the opposite direction.

FIG. 16 is a flow chart of the algorithm performed by electronics package 432.

Upon assembly of the power supply 434 with electronics package 432 the system is initialized. Then the motor 412 is started running in a first direction so as to pull the spool valve element 330 downward toward its open position. When the spool valve element 330 has moved downward until lug 428 bottoms out against the bottom end of slot 430, the motor 412 will stall which is sensed by control package 432. The motor 412 is then shut down.

Upon receiving a command from master controller 226 to close the shut-in valve, the motor 412 is started up in a second direction to move the spool valve element 330 upward thus closing the shut-in valve element 268. When the lug 428 abuts the upper end of slot 430, the motor 412 will again stall. This is sensed and the motor 412 is again shut down.

Upon receiving an opening command from the master controller 226, the electric motor 412 is again started up in its first direction to reopen the shut-in valve element 268. When the motor again stalls out this is sensed and the motor is shut down.

This process can be repeated to conduct multiple draw-down and shut-in tests by sending additional closing commands and opening commands from the master controller 226 to the slave controller 432. When the testing sequence is completed and it is desired to pull the tool 224 from the well, the shut-in valve element 268 will typically be left in its open position and the control package 432 will be powered down.

This sequence of operations can be implemented with circuitry similar to that of FIG. 7 except that the timer means 176 is deleted and replaced by a control signal from the master controller 226. Other preferred modifications readily understood in the art include (1) modifying the original circuit of FIG. 7 so that it returns to the set state (A=O, B=O) after each open/close cycle to be prepared for the next such cycle, and (2) connecting the A and B signals to the motor power switching means as needed to obtain proper directional movement of the motor for opening or closing the shut-in valve.

Figure 14:
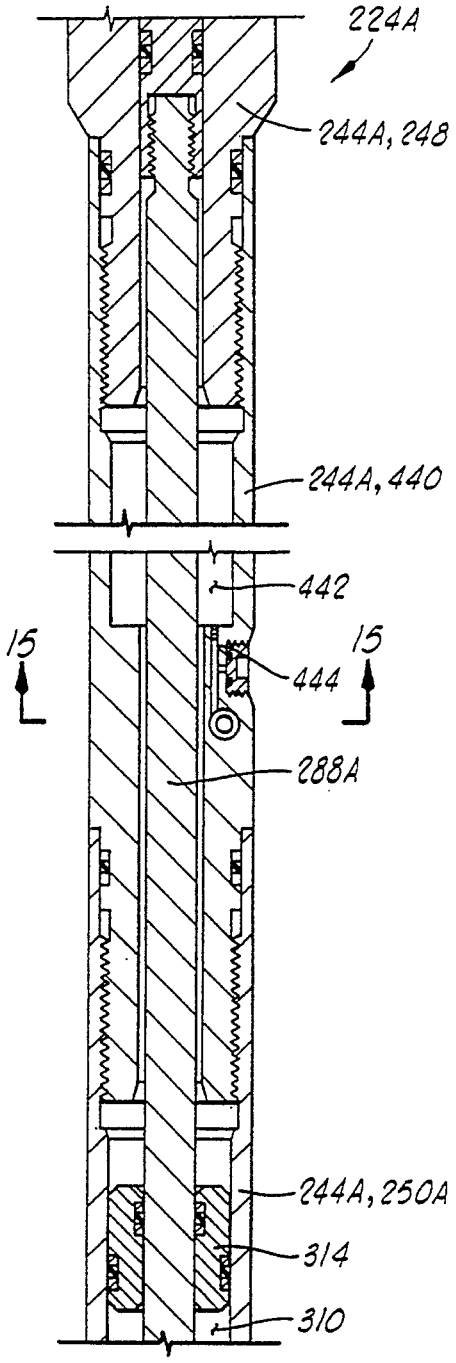
FIG. 14 is an elevation sectioned view of a modification applicable to the tool of FIGS. 10A–10H for providing a compressed gas high pressure source in situations where well fluid pressure within the production tubing is insufficient to provide actuating power for the tool.
Figure 15:
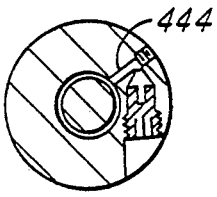
FIG. 15 is a sectioned view taken along line 15—15 of FIG. 14.
Figure 18:
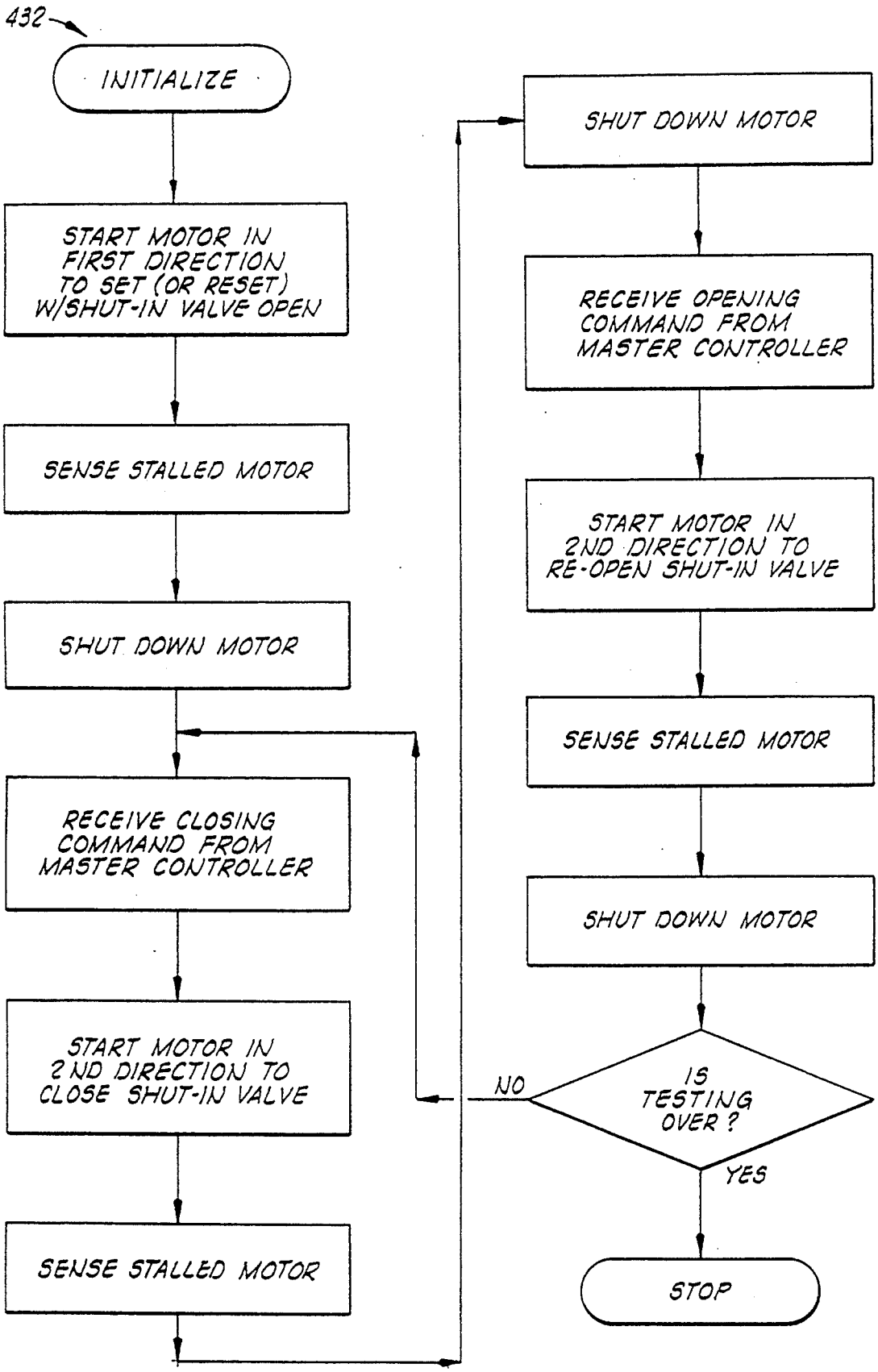
FIG. 18 is a flow chart of the functions performed by the electronic control package of the automated sampler of FIGS. 17A–17H.

Alternative Embodiment Of FIGS. 14 And 15

In some situations the well fluid pressure present in the interior 214 of production tubing string 206 may not be sufficient to operate the apparatus 224. FIG. 14 illustrates a modified portion of an alternative embodiment designated as 224A.

In the embodiment of FIG. 14, a gas chamber housing section 440 has been added between intermediate adapter 248 and high pressure chamber housing 250A. The lower actuator shaft 288A has been lengthened.

Within the gas chamber housing section 440 there is defined a high pressure gas chamber 442 which is filled with nitrogen gas under high pressure upon assembly of the apparatus 224A. FIG. 15 is a cross-sectional view which shows a fill passage 444 by means of which gas is placed in the chamber 442.

The high pressure chamber housing 250A has been modified in that the high pressure ports 312 have been eliminated or plugged. Thus high pressure from the gas in gas chamber 442 is transferred across floating piston 314 to the clean hydraulic fluid in chamber 310. The remaining portions of the tool 224A are the same as the tool 224 of FIGS. 10A–10H.

The Automated Sampling Device

FIGS. 17A–17H comprise an elevation sectioned view of the automated sampling apparatus 228 of FIG. 8B.

The sampler 228 includes a sampler housing generally designated by the numeral 444. Sampler housing 444 is made up of a plurality of individual components which are connected together by conventional threaded connections with O-rings seals therebetween. From top to bottom the sampler housing 444 includes an upper adapter 446, an electronics housing section 448, a drive housing section 450, a low pressure chamber housing 452, a blocking valve housing 454, a metering housing 456, an oil chamber housing 458, an intermediate adapter 460, a sample chamber housing 462, an air chamber coupling 464, and a lower adapter 466.

Within the electronics housing 448, there is a battery or power supply 468, an electronic control package 470, and an electric motor 472. An electrical conduit 474 leads from the master controller 226 through a passage 476 in upper adapter 446 down to the electronic control package 470. In a manner similar to that described above for the automated shut-in tool 224, the automated sampler 228 will receive command signals from master controller 226, and the electronic control package 470 will control operation of the sampler 228 in response to those command signals.

The electric motor 472 rotates a shaft 478 carrying lead screw 480 which threadedly engages an internal thread 482 of an actuating shaft 484 in a manner very similar to that described above for the lead screw arrangement shown in FIG. 10E for the shut-in tool 224.

Figure 17A:
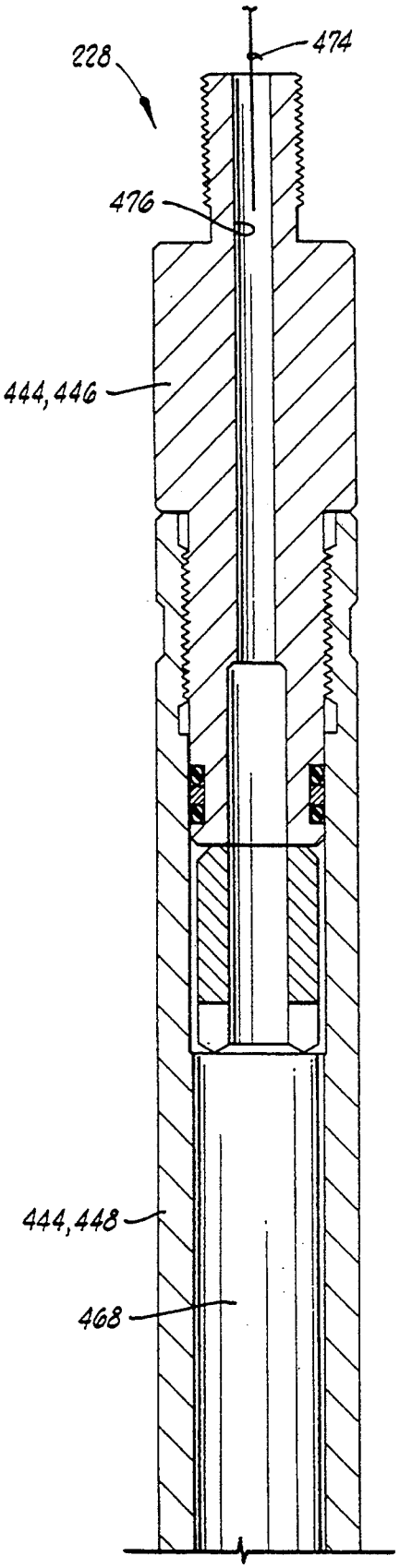
FIGS. 17A–17H comprise an elevation sectioned view of the automated sampler of FIGS. 8A–SB.
Figure 17B:
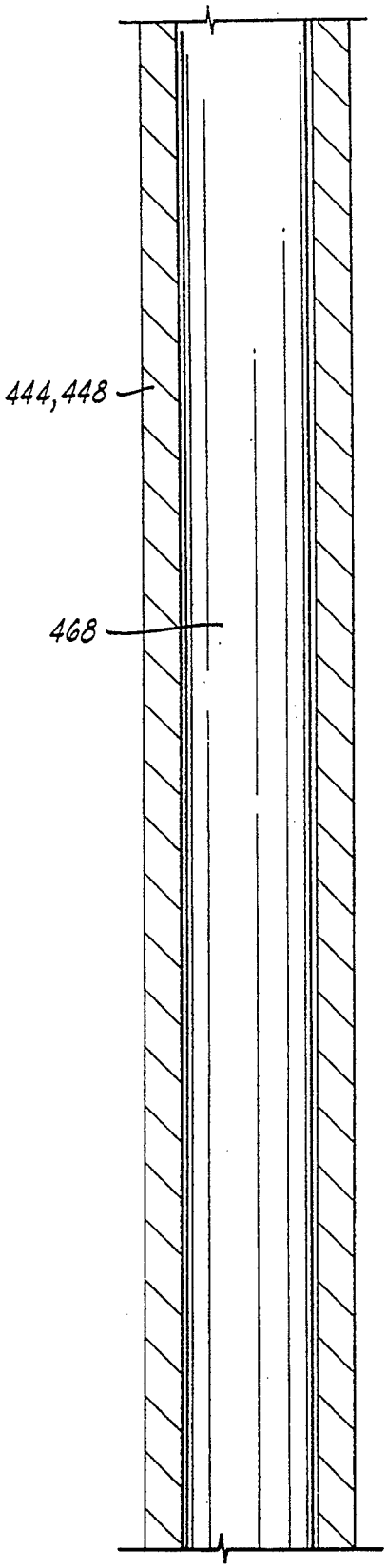
Figure 17C:
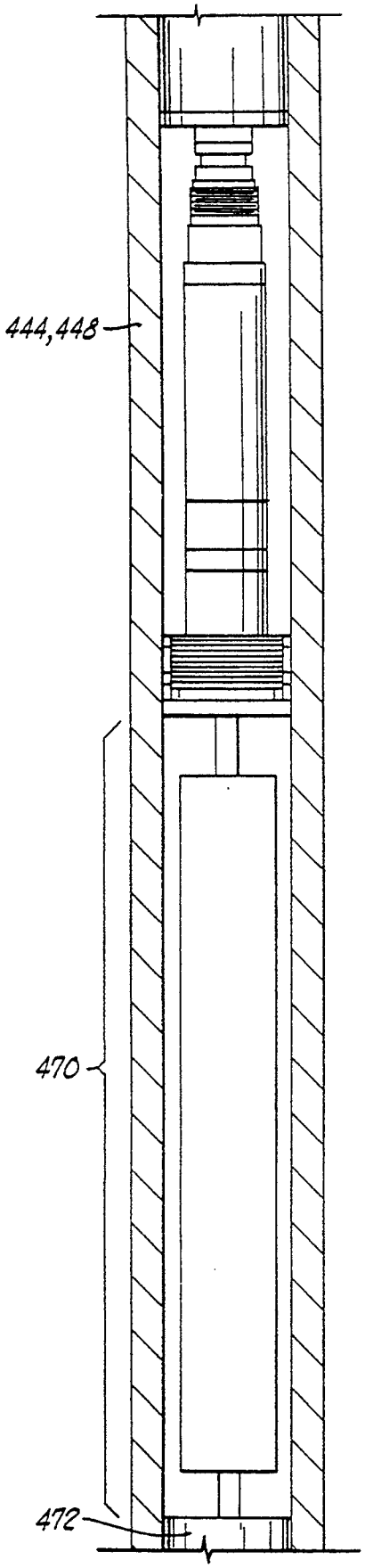
Figure 17D:
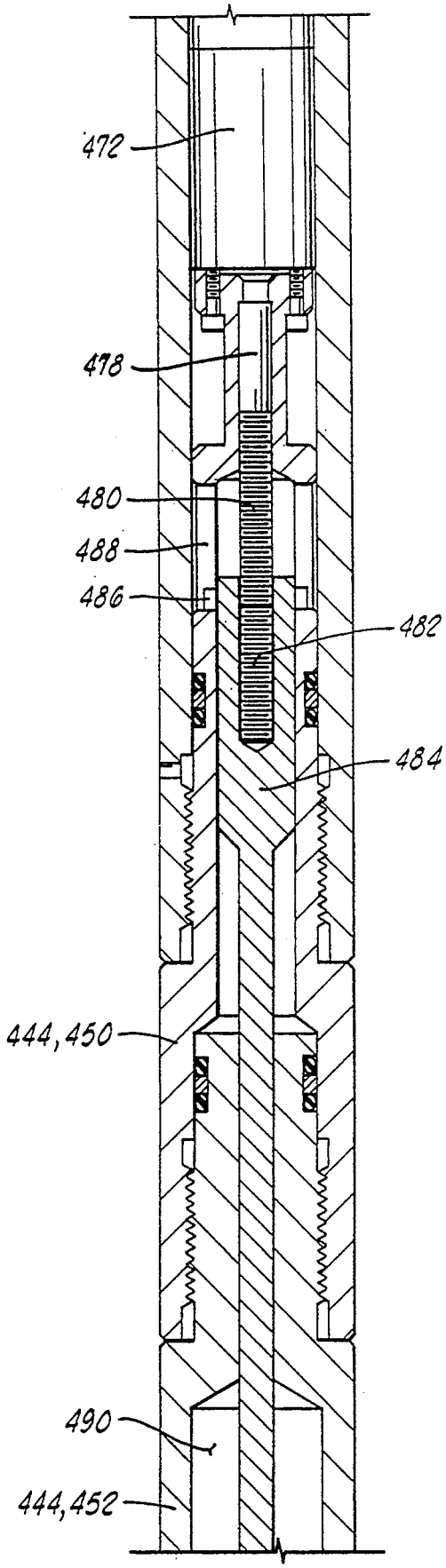
Figure 17E:
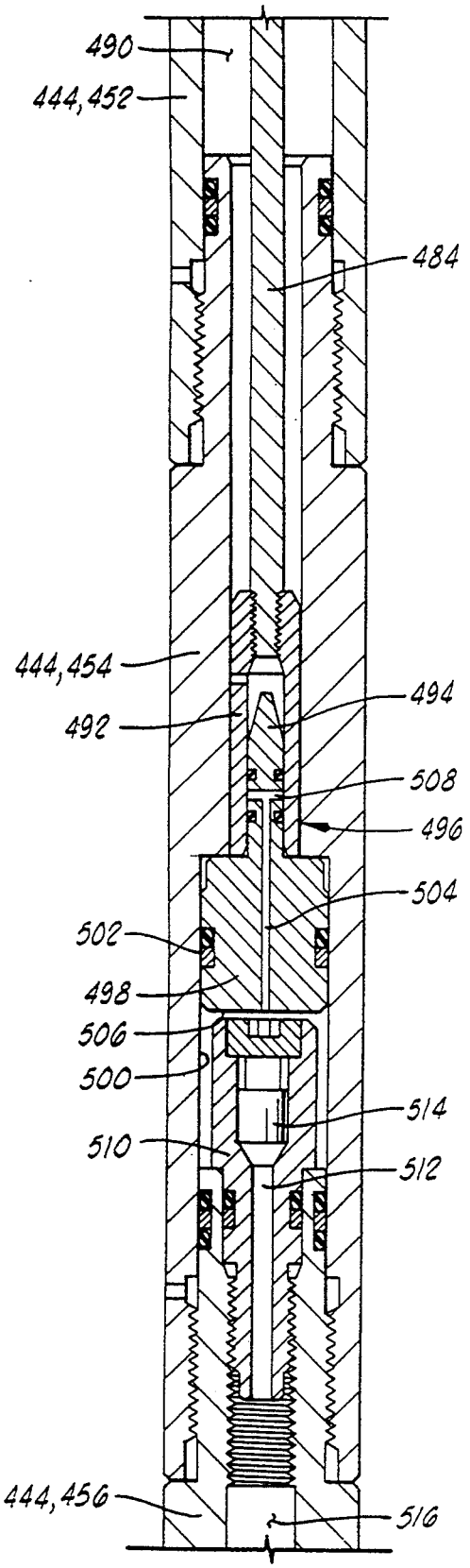

The actuating shaft 484 carries a radially outward extending lug 486 received in a slot 488 defined in the drive housing section 450. The apparatus is shown in FIG. 17D with the lug 486 bottomed out on a bottom end of slot 488 thus defining a downwardmost position of actuating shaft 484. As is further described below, the motor 472 will upon command rotate the lead screw 480 to cause the actuating shaft 484 to be translated upward to actuate the sampler. The actuating shaft 484 will move upward until lug 486 abuts the upper end of slot 488, which abutment will be sensed by electronic control package 470 which will then shut down the motor 472 in a manner like that previously described.

The actuating shaft 484 extends through a low pressure chamber 490 which is preferably filled with air at atmospheric pressure during assembly of the apparatus 228. For reasons which will become apparent, the low pressure chamber 490 may be described as a dump chamber 490.

The lower end of actuating shaft 484 carries a valve sleeve 492. In the position shown in FIG. 17E, the valve sleeve 492 is concentrically received about a neck portion 494 of a blocking valve assembly 496. The valve sleeve 492 may also be considered to be a part of the blocking valve assembly 496.

The neck portion 494 extends upward from a blocking valve body 498 which is received within a bore 500 of blocking valve housing 454 with an O-ring seal 502 provided therebetween.

A narrow elongated blind bore 504 extends upward into blocking valve body 498 and into neck portion 494 from a lower end 506 of blocking valve body 498. A lateral port 508 communicates bore 504 with the cylindrical outer surface of neck portion 494. When the valve sleeve 492 is in the position shown in FIG. 17E, the valve sleeve 492 blocks the lateral port 508 to prevent fluid flow therethrough. As is further described below, when the actuating shaft 484 is pulled upward it will pull the valve sleeve 492 out of engagement with neck portion 494 so as to allow flow of hydraulic fluid through bore 504 and lateral port 508 into the dump chamber 490.

Located below blocking valve body 498 is a metering cartridge 510 having a central passage 512 extending completely therethrough from top to bottom. Disposed in the passage 512 is a metering orifice means 514 which is preferably a device such as a Viscojet® element of a type well known to the art.

Figure 17F:
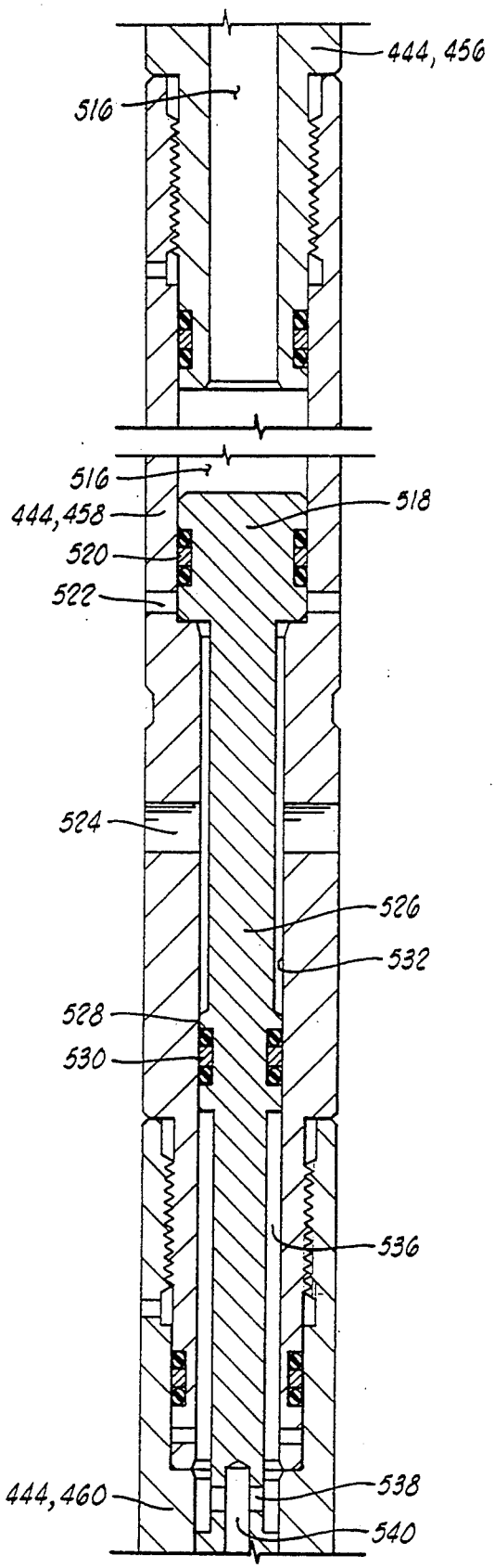
Figure 17G:
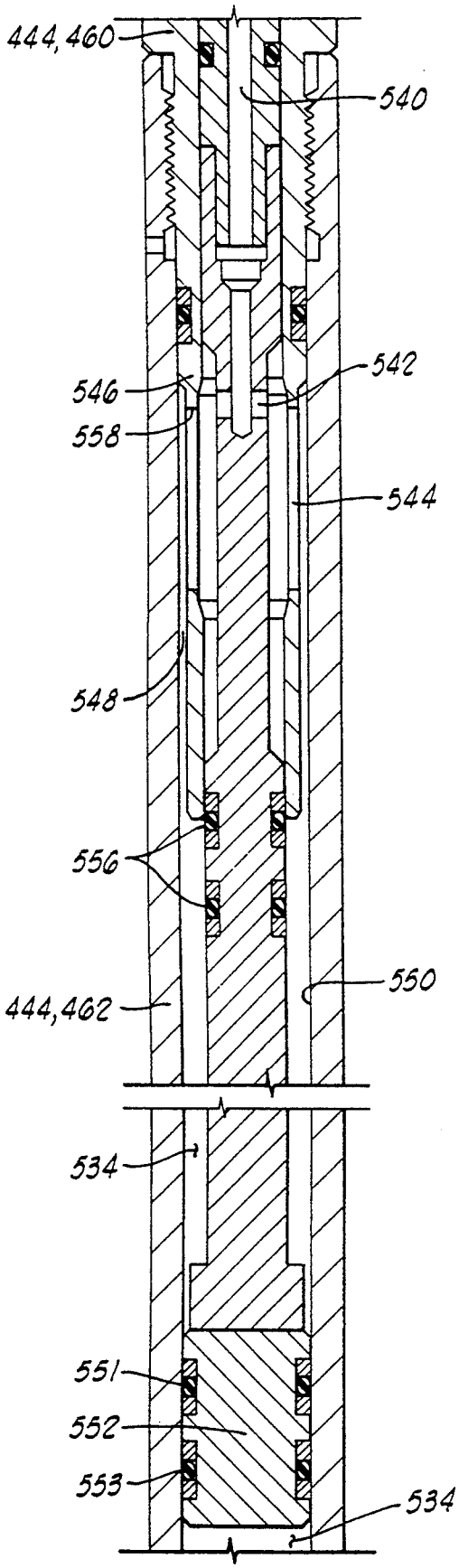
Figure 17H:
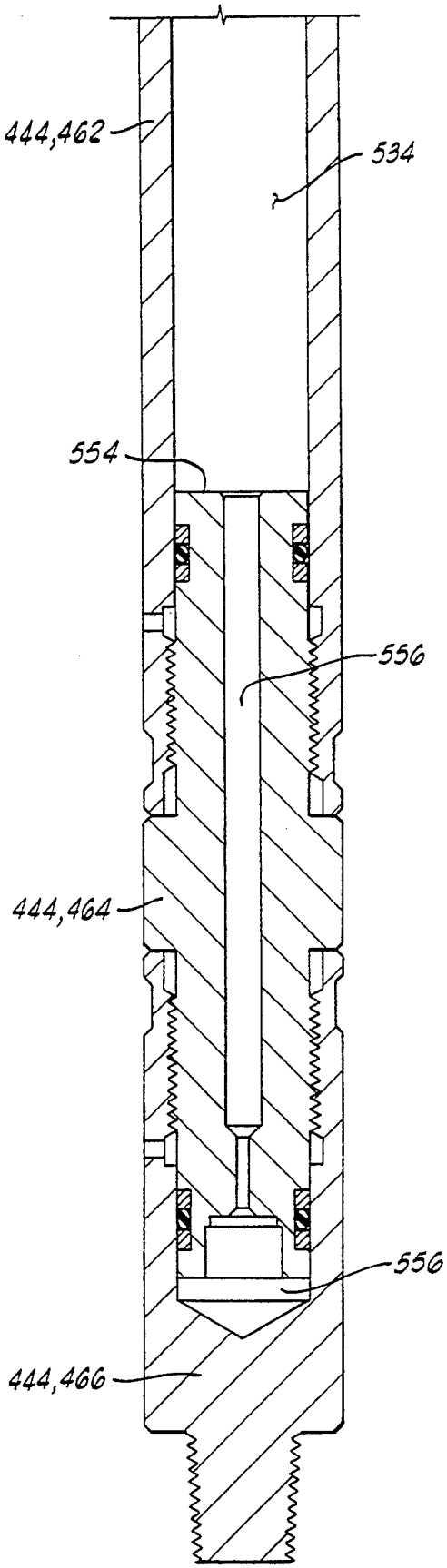
Figure 18:
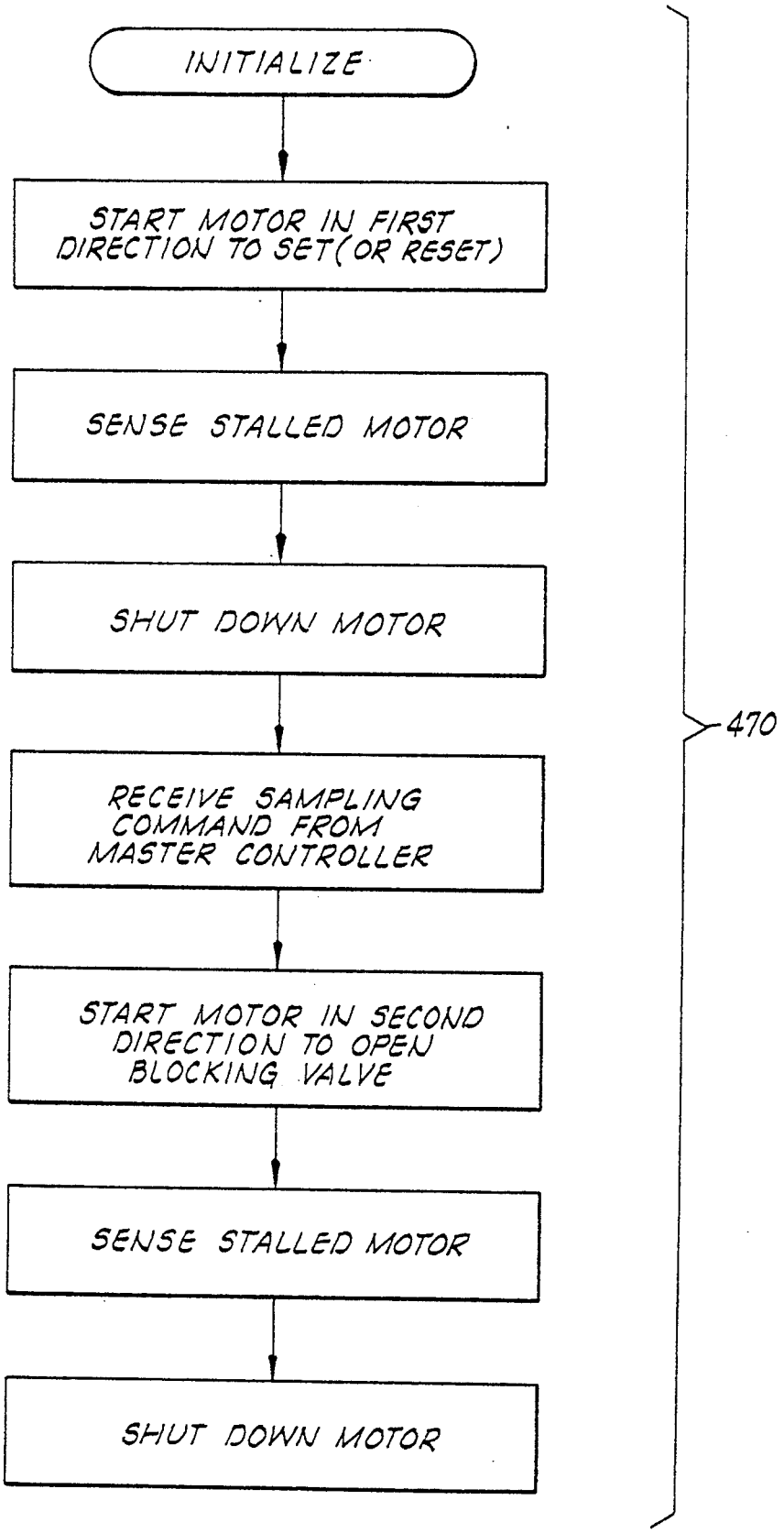

An oil chamber 516 filled with clean hydraulic fluid is defined in the housing 444 below metering cartridge 510. A differential pressure actuating piston 518 is slidably disposed in the oil chamber 516. In FIG. 17F the actuating piston 518 is shown in its initial position abutting a bottom end of the oil chamber 516. A sliding O-ring seal 520 is provided in the piston 518. The oil chamber 516 above the actuating piston 518 and up to the blocking valve 496 is substantially completely filled with clean hydraulic fluid such as hydraulic oil upon assembly of the tool.

A lower side of actuating piston 518 is communicated with well fluid in the interior 214 of production tubing string 206 through a pair of power ports 522 and 524.

When the actuating shaft 484 is pulled upward by motor 472 to open the blocking valve 496, an upward pressure differential will be created across actuating piston 518 due to the difference in pressure between the well fluid entering port 522 and the substantially atmospheric pressure in dump chamber 490. This will move the actuating piston 518 upward. Upward movement of actuating piston 518 occurs rather slowly over a period of time due to the metering of the hydraulic oil through the metering orifice means 514.

Integrally constructed with the actuating piston 518 is an elongated sampler valve element 526 which extends downwardly from piston 518. The sampler valve element has an enlarged diameter portion 528 which carries an O-ring seal 530 that seals within a bore 532 of oil chamber housing 458. In the initial position of actuating piston 518 shown in FIG. 17F, the seal 530 is located below ports 522 and 524 thus preventing flow of well fluid therethrough into a sample chamber 534 defined within sample chamber housing 462.

As sampler valve element 526 moves upward the O-ring 530 will move above port 524 which will allow well fluid to enter port 524 and flow downward into the sample chamber 534 to fill the sample chamber 534 with a sample of well fluid. The well fluid flows in port 524 below O-ring 530, then through a thin annular space 536 defined between bore 532 and sample chamber element 526, then radially inward through port 538, then downward through central bore 540 of sampler valve element 526, then radially outward through port 542, then through a plurality of slots 544 defined in a downward extending annular skirt 546 of intermediate adapter 460, then through a thin annular space 548 defined between a bore 550 of intermediate adapter 460 and skirt 546, then into the sample chamber 534 above a floating piston 552. Floating piston 552 carries O-ring seals 551 and 553. Well fluid will rapidly fill the sample chamber 534 moving the floating piston 552 downward until the floating piston 552 abuts an upper end 554 of air chamber coupling 464. Air initially located in sample chamber 534 below floating piston 552 will be compressed into an air space 556 defined in air chamber coupling 464 and lower end adapter 466.

After the sample chamber 534 has filled with well fluid, the actuating piston 518 and sampler valve element 526 will continue to move upward until a pair of O-ring seals 556 carried thereby pass above an upper end 558 of slots 544 thus closing off the passageway into sample chamber 534 and trapping the sample of well fluid within the sample chamber 534 between the seals 556 and the floating piston 552.

The electronic control package 470 of sampler apparatus 228 operates in a manner similar to that described above for the electronic control package 432 of shut-in tool 224. Electronic control package 470 functions as a slave controller to control operation of the sampler valve apparatus 228 in response to sampling command signals received from the master controller 226. The functions performed by the electronic control package 470 are set forth in the flow chart of FIG. 18. Upon connection of the power supply 468 to electronic control package 470, the control circuitry will initialize. It will start the motor 472 to run in a first direction so as to make certain that the control shaft 484 is in its downwardmost position as illustrated in FIG. 17D. When lug 486 bottoms out against the bottom end of slot 488, the circuitry of control system 470 will sense that the motor 472 has stalled and will shut down the motor 472.

The electronic control package 470 will then await receipt of a sampling command from master controller 226. Upon receiving that sampling command, it will start the motor 472 running in a second direction so as to pull the actuating shaft 484 upward to open the blocking valve means 496 and allow a sample to be received and trapped within the sampling chamber 534. As the actuating shaft 484 moves upward the lug 486 will abut the upper end of slot 488 and will again stall the motor 472 which will be sensed by control system 470 which will again shut down the motor 472. Since the sampling apparatus 228 functions only to take a single sample that will complete the activities of the sampling apparatus 228.

It will be appreciated that if multiple samples are desired, one or more additional sampling apparatus can be connected below the sampling apparatus 228 and can be connected to the master controller 226 so as to take additional samples upon command from the master controller 226.

The electrical circuitry of electronic control package 470 is similar to that of FIG. 7 except that the timer means 176 and associated circuitry are removed and in place thereof the master controller 226 is connected so as to provide input B. The sampling command signal is provided by input B going from low to high to cause the drive motor 472 to be turned on to open the blocking valve 496.

The Master Controller

Figure 19A:
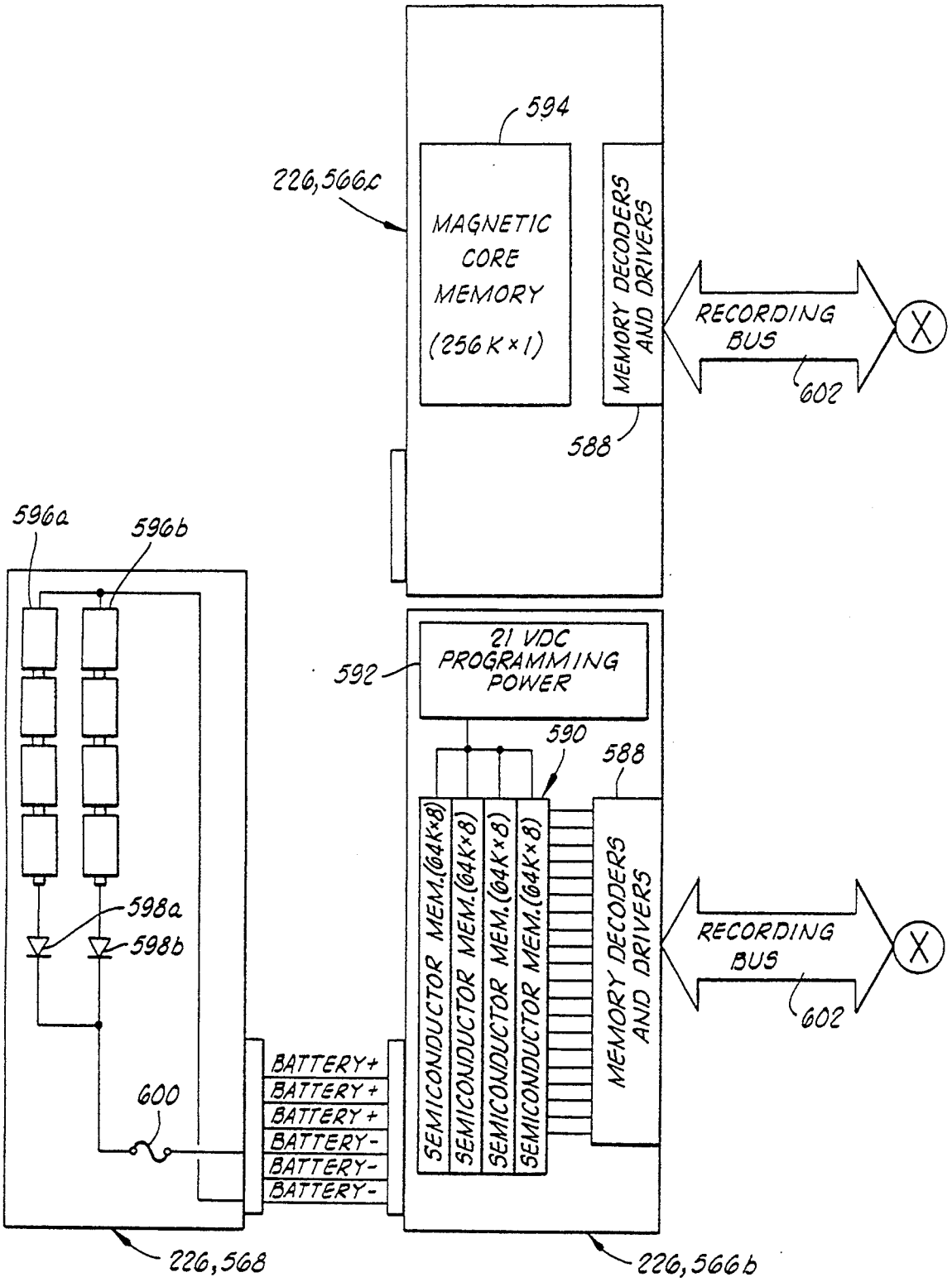
FIGS. 19A–19C comprise a block diagram of the recorder/master controller, automated shut-in tool, automated sampler, and surface computer system of the apparatus of FIGS. 8A–SB.

FIGS. 19A, B and C comprise a block diagram of the master controller 226, a surface computer system 560, an interface 562 between master controller 226 and surface computer system 560, the shut-in tool slave controller system 432 and sampler slave controller system 470.

Figure 19B:
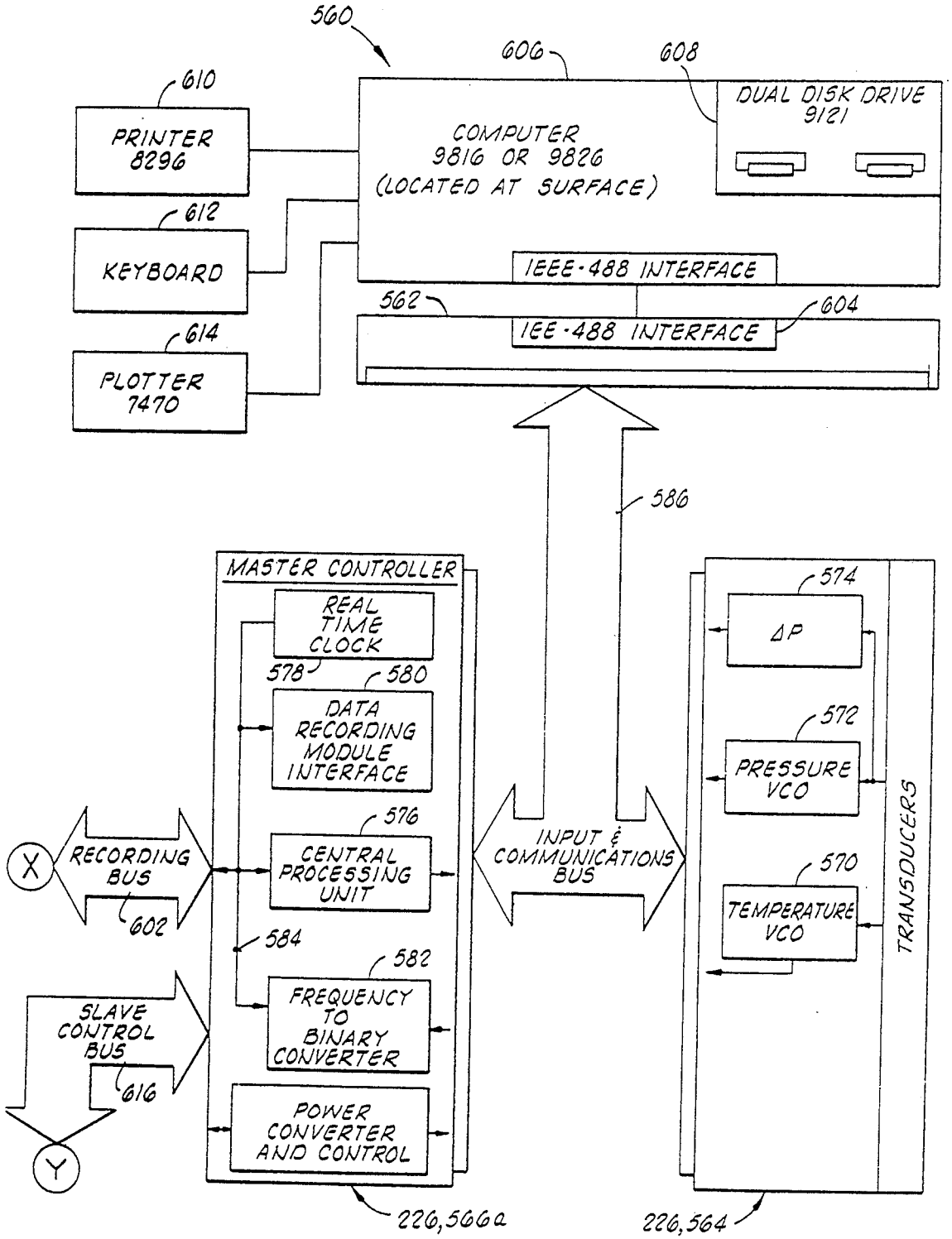
Figure 19C:
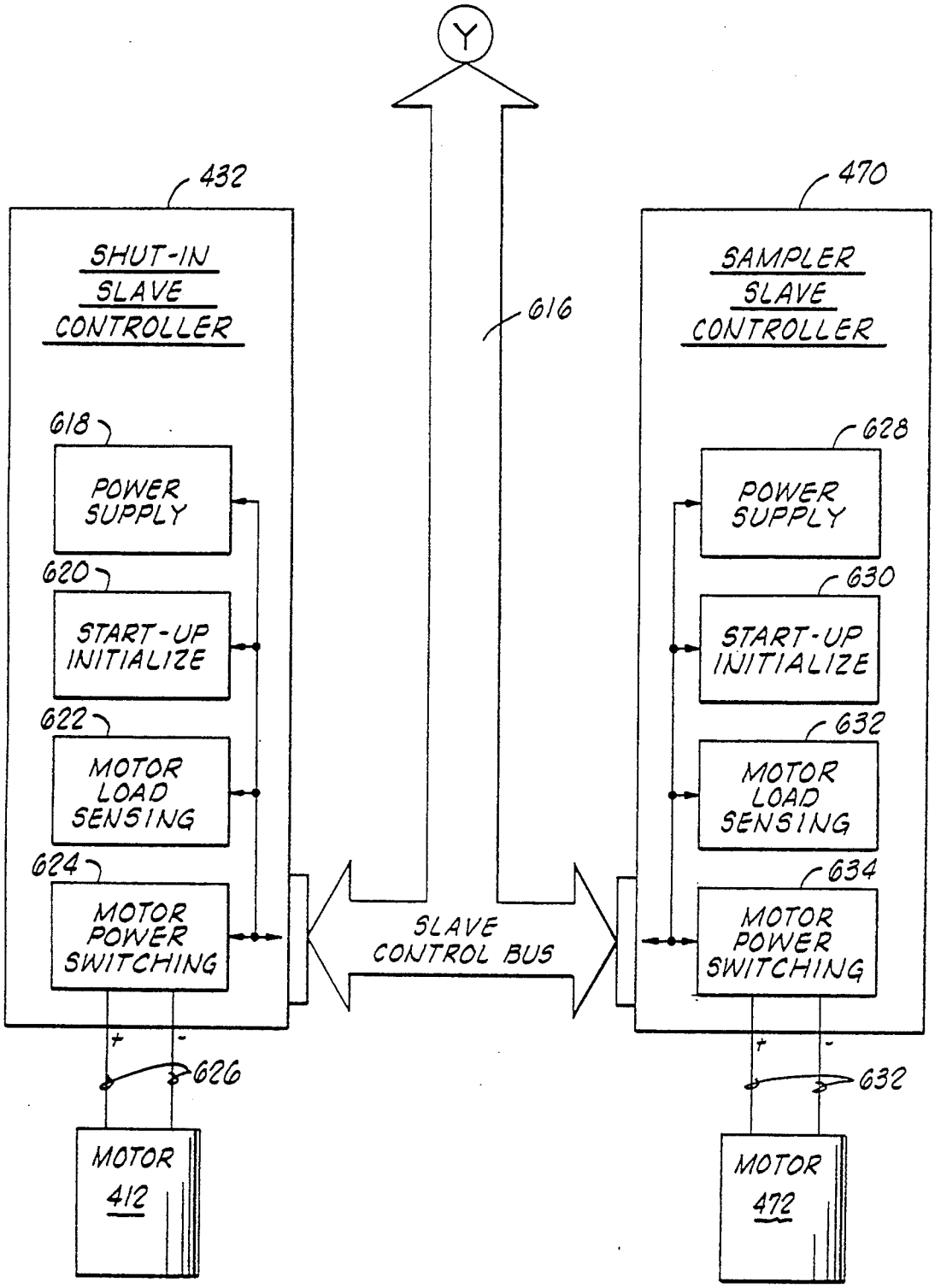

Particularly, FIGS. 19A and 19B show in block diagram format the arrangement of the recorder/master controller 226 and associated surface computer system 560 and interface 562 all as is further described in detail in U.S. Pat. No. 4,866,607 to Anderson et al., entitled SELF-CONTAINED DOWNHOLE GAUGE SYSTEM, and assigned to the assignee of the present invention, all of which is incorporated herein by reference. The Anderson et al. patent describes a self-contained downhole gauge system which continuously monitors downhole pressure and temperature and records appropriate data. The interface with surface computer system 560 allows programming of the system prior to running the tool in the well, and permits subsequent retrieval of data after retrieval of the tool from the well. The Anderson et al. system is described primarily in the context of a system for monitoring and recording pressure and temperature readings, but it is also disclosed at column 33, line 61 through column 34, line 8 as being suitable for the control of other instruments such as the apparatus for sampling fluids and the like which are involved in the present application.

FIGS. 19A and 19B show, in block diagram format, elements comprising the preferred embodiment of the recorder/master controller 226, the interface 562 and the surface computer system 560. The preferred embodiment of the recorder/master controller 226 is made of three detachable segments or sections which are electrically and mechanically interconnectable through multiple conductor male and female connectors which are mated as the sections are connected. These three sections are contained within respective linearly interconnectable tubular metallic housings of suitable types as known in the art for use in downhole environments. As shown in FIGS. 19A and 19B, the three sections of the recorder/master controller 226 include (1) a transducer section 564, (2) a master controller/power converter and control/memory section 566 comprising master controller and power converter and control portion 566*a* and a data recording module including an interchangeable semiconductor memory portion 566*b* or magnetic core memory portion 566*c*, and (3) a battery section 568.

Various types of a plurality of specific embodiments of the transducer section 564 can be used for interfacing the recorder/master controller 226 with any suitable type of transducer, regardless of type of output. Examples of suitable transducers include a CEC pressure-sensing strain gauge with a platinum RTD, a Hewlett-Packard 2813B quartz pressure probe with temperature sub, a Geophysical Research Corporation EPG-520H pressure and temperature transducer, and a Well Test Instruments 15K-001 quartz pressure and temperature transducer. However, regardless of the specific construction used to accommodate the particular output of any specific type of transducer which may be used, the preferred embodiment of the transducer section 564 includes a temperature voltage controlled oscillator circuit 570 which receives the output from the particular type of temperature transducer used and converts it into a suitable predetermined format (such as an electrical signal having a frequency proportional to the magnitude of the detected condition) for use by the controller portion in the section 566 of the recorder/master controller 226. The preferred embodiment of the transducer section 564 also includes a pressure voltage controlled oscillator circuit 572 for similarly interfacing the specific type of pressure transducer with the controller portion of the section 566. Associated with the pressure voltage controlled oscillator circuit 572 in the preferred embodiment is a delta pressure (ΔP) circuit 574 which provides hardware monitoring of rapid pressure changes and which generates a control signal in response to positive or negative pressure changes which pass a predetermined threshold. These three circuits, along with a voltage reference circuit contained in the transducer section 564, are described in detail in Anderson et al. U.S. Pat. No. 4,866,607 with reference to FIGS. 3–9 thereof, all of which is incorporated herein by reference.

The monitoring and control system for the shut-in tool could be designed to be responsive to many other downhole parameters other than pressure.

One alternative is to monitor flow rate in the well and have the shut-in tool operate in response to the monitored flow rate. For example it might be desired to shut in the well when the flow rate reaches a certain level.

Another alternative is to monitor the compressibility of the oil being produced. As will be understood by those skilled in the art, when a well is freely flowing most of the gas in the produced oil comes out of solution once the gas enters the production string. When the well is shut in, this free gas starts being dissolved back into the oil. It may be desirable in some instances to take flowing oil samples but to take those samples at a relatively high pressure so that most of the gas is in solution as it is in the natural environment of the subsurface formation. This can be accomplished by monitoring compressibility of the oil, since compressibility of course is directly related to the amount of gas in solution in the oil.

Another alternative is to monitor downhole temperature and to operate the shut-in and/or sampler tool in response to monitored temperature. The transducer section 564 illustrated in FIG. 19B illustrates one suitable means for monitoring temperature.

The controller portion of the controller/power converter and control/memory section 566 includes a central processing unit circuit 576, a real time clock circuit 578, a data recording module interface circuit 580 and a frequency-to-binary converter circuit 582, which elements generally define a microcomputer means for receiving electrical signals in the predetermined format from the transducer section 564, for deriving from the electrical signals digital signals correlated to a quantification of the magnitude of the detected parameter, for storing the digital signals in the memory portion of the section 566, and for sending command signals to the shut-in slave controller 432 and the sampler slave controller 470. These four circuits communicate with each other over a suitable bus and suitable control lines generally indicated in FIG. 19B by the reference numeral 584. The central processing unit circuit 576 also communicates with the surface computer system 560 through the interface 562 over input and communications bus 586. The central processing unit 576 also communicates, through a part of the circuitry contained on the circuit card on which the data recording module interface circuit 580 is mounted, with the transducer section 564 over bus 586 to receive an interrupt signal generated in response to the ΔP signal from the ΔP circuit 574. The frequency-to-binary converter circuit 582 also communicates with the transducer section 564 over bus 586 by receiving the temperature and pressure signals from the circuits 570, 572, respectively. The circuit 582 converts these signals into digital signals representing numbers corresponding to the detected magnitudes of the respective environmental condition. The real time clock circuit 578 provides clocking to variably control the operative periods of the central processing unit 576. The data recording module interface circuit 580 provides, under control by the central processing unit 576, control signals to the memory portion of the section 566. Each of the circuits 576, 578, 580 and 582 are more particularly described in Anderson et al. U.S. Pat. No. 4,866,607 with reference to FIGS. 10, 11, 12 and 13 thereof, respectively, all of which is incorporated herein by reference.

The power converter and control portion of the section 566 includes circuits for providing electrical energy at variously needed DC voltage levels for activating the various electrical components within the recorder/master controller 226. This portion also includes an interconnect circuit for controlling the application of at least one voltage to respective portions of the recorder/master controller 226 so that these portions of the recorder/master controller 226 can be selectively powered down to conserve energy of the batteries in the battery section 568. The specific portions of the preferred embodiment of the power converter and control portion are described in Anderson et al. U.S. Pat. No. 4,866,607 with reference to FIGS. 14–17 thereof, all of which is incorporated herein by reference.

The data recording module or memory portion of the section 566 includes either the semiconductor memory portion **566*b* or the magnetic core portion 566*c* or a combination of the two. Each of these portions includes an addressing/interface, or memory decoders and drivers, section 588. The semiconductor memory portion 566*b* further includes four 64K×8 (K=1024) arrays of integrated circuit, solid state semiconductor memory. These are generally indicated by the reference numeral 590 in FIG. 19A. A 21-VDC power supply 592 is contained within the portion 566*b* for providing a programming voltage for use in writing information into the memory 590. The magnetic core memory portion 566*c* includes a 256K×1 array of magnetic core memory generally identified in FIG. 19A by the reference numeral 594. These elements of the memory portion are described in Anderson et al. U.S. Pat. No. 4,866,607 with reference to FIGS. 18–23** thereof, the details of which are incorporated herein by reference.

The battery section 568 shown in FIG. 19A includes, in the preferred embodiment, a plurality of lithium-thionyl chloride or lithium-copper oxyphosphate, C-size cells. These cells are arranged in six parallel stacks of four series-wired cells. Two of these stacks are shown in FIG. 19A and identified by the reference numerals **596*a*, 596*b*. Each series is protected by a diode, such as diodes 598*a*, 598*b* shown in FIG. 19A, and each parallel stack is electrically connected to the power converter and control portion through a fuse, such as fuse 600 shown in FIG. 19A. In the preferred embodiment the parallel stacks are encapsulated with a high temperature epoxy inside a fiber glass tube. These battery packs are removable and disposable, and the packs have wires provided for voltage and ground at one end of the battery section. The batteries are installed in the recorder/-master controller 226 at the time of initialization of the recorder/master controller 226**.

The memory sections 566*b* and 566*c* communicate with master controller 566*a* over recording bus 602.

The interface 562 through which the recorder/master controller 226 communicates with the surface computer system 560 comprises suitable circuitry as would be readily known to those skilled in the art for converting the signals from master controller 566*a* into the appropriate format recognizable by the surface computer system 560. In the preferred embodiment this conversion is from the input signals from bus 586 at the inputs of the interface 562 to suitable IEEE-488 standard interface format output signals at the outputs of the interface 562. The IEEE-488 output is designated by the block marked with the reference numeral 604. The preferred embodiment is also capable of converting the input signals into RS-232 standard format. Broadly, the interface 562 includes an eight-bit parallel data bus and four hand shake lines, which are further described in Anderson et al. U.S. Pat. No. 4,866,607, the details of which are incorporated herein by reference.

The surface computer system 560 of the preferred embodiment with which the interface 562 communicates is a Hewlett-Packard Model 9816 or Model 9826 microcomputer with a Hewlett-Packard Model 2921 dual disk drive. The microcomputer is labeled in FIG. 19B with the reference numeral 608. Suitably associated with the microcomputer 606 in a manner as known to the art are a printer 610, a keyboard 612 and a plotter 614. The computer 560 can be programmed to perform several functions related to the use of the recorder/master controller 226. An operator interface program enables an operator to control the operation of the computer through simple commands entered through the keyboard 612. A test mode program is used to test the communication link between the computer 560 and the interface 562. A tool test mode program provides means by which the operator can test the recorder/master controller 226 to verify proper operation. A received data mode program controls the interface 562 to read out the contents of the memory of the recorder/master controller 226; after the memory has been read into the interface 562, the information is transmitted to the computer 560 with several different verification schemes used to insure that proper transmission has occurred. A write data mode program within the computer 560 automatically writes the data received from the interface 562 to one or both of the disks as an ASCII file so that it may be accessed by HPL, Basic, Pascal, or Fortran 77 programming languages. A set-up job program allows the operator to obtain various selectable job parameters and pass them to the interface 562. A monitor job program allows the operator to monitor any job in progress.

Under control of the aforementioned programs in the surface computer 560, several programs can be run on a microprocessor within the interface 562. A core memory test program in the recorder/master controller 226 reads and writes, under control from the interface 562, a memory checkerboard pattern to read and verify proper operation of the magnetic core memory in the recorder/master controller 226 when it is connected to the interface 562 and to maintain a list of any bad memory locations detected. A processor check program checks the status of a microprocessor within the recorder/master controller 226, and a battery check program checks the voltage of the power cells in the recorder/-master controller 226 to insure proper voltage for operation. A tool mode select program places the recorder/-master controller 226 in the proper mode for the test being run, and a set-up job program further configures the recorder/master controller for the job to be run. A core memory transfer program reads the contents of the memory of the recorder/master controller 226 and stores that information in memory within the interface 562 prior to transfer to the surface computer 560.

Through the use of the foregoing programs, the tool operator initializes the recorder/master controller 226 prior to lowering the recorder/master controller 226 into the well 200. In the preferred embodiment the operator initializes the recorder/master controller 226 using a pre-defined question and answer protocol. The operating parameters, such as sampling mode, test delay times, serial numbers of the individual instruments, estimated testing time and a self-test or confidence test, are established at initialization and input through the question and answer protocol. The sampling rates for sampling the pressure and temperature and the corresponding resolution control information are entered in a table by the operator at this initialization; the specific sampling rate and resolution used by the gauge at any one time are automatically selected from this table. The sampling mode to be selected is either a fixed time interval mode, wherein the sampling occurs at a fixed time interval, or a variable time interval mode, wherein the particular sample rate is selected from the table based upon a software detected change in the pressure sensed by the pressure transducer.

After the downhole test has been run and the recorder/master controller 226 removed from the well 200, the tool operator connects the memory portion 566*b* or 566*c* with the interface 562 to read out the temperature, pressure and time data stored within the memory section 566*b* or 566*c*. Through another question and answer protocol and other suitable tests, the operator insures that the recorder/master controller 226 is capable of outputting the data without faults. When the data is to be read out, it is passed through the interface 562 to the surface computer system 560 for storage on the disks within the disk drive 608 for analysis.

The master controller 566*a* communicates with the shut-in slave controller 432 and sampler slave controller 470 over slave control bus 616.

The shut-in slave controller 432 as previously described performs the functions set forth in the flow chart of FIG. 16, and those functions are implemented by circuitry very similar to that of FIG. 7. The circuitry of shut-in slave controller 432 includes a power supply 618, start-up initialize means 620, motor load sensing means 622, and motor power switching means 624, all of which are constructed in a similar fashion to the power supply 168, start-up initialize means 178, motor load sensing means 174, and motor power switching means 179, respectively, described above with regard to FIG. 7. The motor power switching means 624 controls flow of electrical power over electrical conduits 626 to the electric motor 412 which moves the shut-in valve element 268 to open and close the shut-in tool 224 upon command.

As previously mentioned, the timer means 176 of FIG. 7 and associated circuitry is deleted and a command signal from master controller 566*a* is received over slave control bus 616 to provide the input B to the motor power switching circuit 624. In general, sequential command signals from the master controller 566a and operation of the shut-in slave controller 432 cause the A and B signals shown in FIG. 7 to be generated in proper sequence to drive the motor 412 first in one direction, then the other and then reset to repeat another cycle. In the preferred embodiment, the command signals are generated by the master controller 566a in response to sensed pressure meeting a predetermined criterion or a plurality of predetermined criteria programmed into the master controller 566a. Such criteria can include one or more absolute pressure values or relative pressure differentials between consecutive pressure readings, for example. The selection of the one or more criteria, the programming of them into the master controller, and the programming of the master controller to use them and to generate command signals are readily known in the art (e.g., a simple comparison to determine if two consecutive pressure readings are within a predetermined range of each other to indicate steady state).

Similarly, the sampler slave controller 470 includes power supply means 628, start-up initialize means 630, motor load sensing means 632, and motor power switching means 634 which controls supply of current over electrical conduit 636 to electric motor 472 which operates the sampler apparatus 228. Again, the timer means 176 and associated circuitry of FIG. 7 have been deleted and in place thereof a sampling command signal is received from master controller 566a over 516 at input B of the motor power switching means 634.

Methods Of Efficient Automatic Draw-Down And Buildup Testing

The tool string shown in FIGS. 8A–8B, and particularly the automated multiple shut-in tool apparatus 224, the recorder/master controller apparatus 226, and the automated sampler 228 can be utilized to perform methods of efficient drawdown and buildup testing of a completed producing well in a manner like that briefly described above with regard to the pressure versus time curves of FIG. 9. The preferred methods of utilizing the system of FIGS. 8A–8B will now be described in further detail.

A system like that shown in FIGS. 8A–8B is run into the well 200 on a wire line or the like and set in place within the production tubing string 206. This is preferably accomplished by setting a lock mandrel such as 218 within a landing nipple such as 216 so that the packing 220 of lock mandrel 218 seals within the seal bore 222 of landing nipple 216.

The shut-in tool apparatus 224 will typically be run into the well 200 with the shut-in valve element 268 in the open position as shown in FIG. 10A.

When it is desired to begin a buildup test such as at time $T_1$ as shown in FIG. 9, the shut-in valve element 268 is moved to a closed position to shut in the well 200. This function is accomplished in response to a shut-in command transmitted by master controller 566a over slave control bus 616 to the shut-in slave controller 432 which will cause power to be applied over electrical conduit 626 to electric motor 412 to move the actuating shaft 330 upward thus closing shut-in ports 230 with the shut-in valve element 268.

Between times $T_1$ and $T_3$ as seen in FIG. 9, the downhole pressure will be monitored by means of the transducer section 564 of recorder/master controller 226 until it is determined that the downhole pressure has achieved a predetermined criteria as programmed in the central processing unit 576. Preferably this predetermined criteria is a stabilized level at which there is no significant further change in the monitored parameter. This can also be described as a buildup of the shut-in downhole pressure to a substantially constant peak value.

As seen in FIG. 9, after about time $T_2$, there is no significant further change in pressure and this situation is recognized by the central processing unit 576 which sends an open command signal at time $T_3$ over slave control bus 616 to the shut-in slave controller 432 to cause the motor 412 to move the shut-in valve element 268 back to an open position. This is automatically performed when the shut-in downhole pressure has substantially peaked thereby minimizing the time period over which the well 200 is shut in.

Similarly, after the shut-in valve has been reopened at time $T_3$, the flowing downhole pressure is monitored by transducer section 564 and master controller 566a, and that system will sense when the flowing downhole pressure has been drawn down to a substantially constant minimum value.

For example, with reference to FIG. 9, it is seen that after about time $T_4$, there is no significant further reduction in flowing downhole pressure. This situation is recognized by the central processing unit 576 which will then generate a second command, which may also be referred to as a closing command, which is transmitted over bus 616 to shut-in slave controller 432 at time $T_5$ to again reclose the shut-in valve element 268 and start another buildup test such as that shown between times $T_5$ and $T_6$ in FIG. 9.

This process is repeated to perform multiple buildup and drawdown tests to whatever extent desired, as programmed into the central processing unit 576. The multiple drawdown and buildup tests are performed in an efficient manner in that once the well has been drawn to substantially a minimum flowing downhole pressure or once the well has built up to a substantially maximum shut-in pressure, the position of the shut-in valve 268 will be promptly changed so as to conduct the desired tests over the minimum possible period of time.

The determination of whether the stabilized portions of the pressure versus time curve of FIG. 9 have been reached can be made in several ways.

In some instances the properties of the formation will be well known and the maximum shut-in bottom hole pressure will be well known. In those situations the control system can be programmed to open the shut-in valve once the shut-in pressure reaches a certain level. Similarly, the flowing pressure of the well may be well known and the control system can be designed to reclose the shut-in valve when the pressure in the well is drawn down to some absolute pressure which is very close to the known ultimate open flowing pressure. For example, in a typical well in the Middle East flowing pressure may be 1,000 psi and a shut-in bottom hole pressure may be 2,500 psi. In such a situation where it is known that the open flowing pressures and shut-in pressures will ultimately reach these values within a very small variation, the control system might be programmed to shut in the well when the pressure has been drawn down to 1,010 psi and it may be programmed to reopen the well to begin another drawdown test when the shut-in pressure reaches 2,490 psi.

Another technique which may be utilized when the expected maximum and minimum pressures are not so well known is to simply take periodic pressure readings and to compare the latest reading to the previous reading to determine the change over time from one data point to the next. A criteria can be set for a low level of change over time which will be taken as an indication that the well pressure has substantially stabilized.

At any desired time during the drawdown, buildup testing represented in FIG. 9, the sampler apparatus 228 can be actuated to take a sample of well fluid. As will be appreciated by those skilled in the art, it may be desirable to take the well fluid sample at some particular point on the drawdown and/or buildup curve. For example, it may be desired to take a flowing sample or it may be desired to take a shut-in sample. This can be accomplished by appropriate programming of master controller 566*a* so that it will recognize the desired point on the pressure versus time curve and send a sampling command over slave control bus 616 to the sampler slave controller 470 at the appropriate time.

For example, it may be desired to trap a well fluid sample while the well is shut in and after downhole pressure has substantially peaked. In that instance, the master controller 566*a* is programmed to send the sampling command after time $T_2$ and before time $T_3$ on the first pressure buildup curve as represented in FIG. 9.

Also, throughout the testing represented in FIG. 9, the recorder/master controller 226 will be recording the value of downhole pressure and temperature at programmed intervals, which data is recorded in the recorder portion 566*b* or 566*c*.

The master controller 566*a* may begin the testing procedure in any of a number of ways. For example the testing procedure may begin after a certain elapsed time after initialization of the recorder/master controller 226. Typically this elapsed time is set so as to allow time for the tool string to be set in place within the well.

Also, the recorder/master controller 226 can be programmed to recognize a command signal such as a pressure pulse introduced into the well 200 by an operator at the surface. Such a pressure pulse will be sensed by the transducer section 564 and can be recognized by an appropriately programmed master controller 566*a*.

The transducer section 564 may be generally described as a monitoring means for monitoring a downhole parameter such as pressure and generating an input signal representative of said downhole parameter. The master controller 566*a* may be generally described as a processor means 566*a* for receiving the input signal from monitoring means 564. The processor means 566*a* has program criteria stored therein for receiving the input signal and for generating shut-in valve closing and opening commands and sampling commands when the input signal meets the program criteria. The shut-in slave controller 432 and associated motor and mechanical actuating system can be described as a control means for moving the shut-in valve element 268 between its open and closed positions in response to the shut-in valve opening and closing commands, and similarly the sampler slave controller 470 and associated apparatus can be described as a control means for operating the sampler 228 in response to a sampling command.

The master controller 566*a* can be programmed to conduct such drawdown and buildup tests on a scheduled periodic basis, for example monthly. In such case after the drawdown and buildup testing represented in FIG. 9 is completed, the well 200 is placed back in production while leaving the entire apparatus including lock mandrel 218, shut-in tool 224, recorder/master controller 226 and sampler 228 in the well. Although this is not possible in all wells due to the impedance of fluid flow resulting from the presence of the shut-in valve, in many wells there is sufficient excess flow capacity that the presence of the shut-in valve will not significantly affect production flow rates and thus the shut-in valve can be left in place during normal production.

At the next scheduled interval, for example one month later, the master controller 226 will cause another sequence of drawdown buildup tests to be performed. If it is desired to take another sample, it is necessary that multiple sampling devices 228 be initially placed in the well, and if that is done, additional samples can be taken at each of the scheduled sampling times.

In the preferred embodiment illustrated, the data recorded in recording section 566*b* or 566*c* can ultimately be recovered by surface computer 560 as previously described after the tool string is retrieved from the well 200 and the recorder/master controller 226 is connected to the surface computer 560 through interface 562.

The test string may also be equipped so that recorded data can be retrieved electronically with wire line or electric line, or by removing a replaceable memory module from the tool string via a wire line or electric line.

Figure 20:
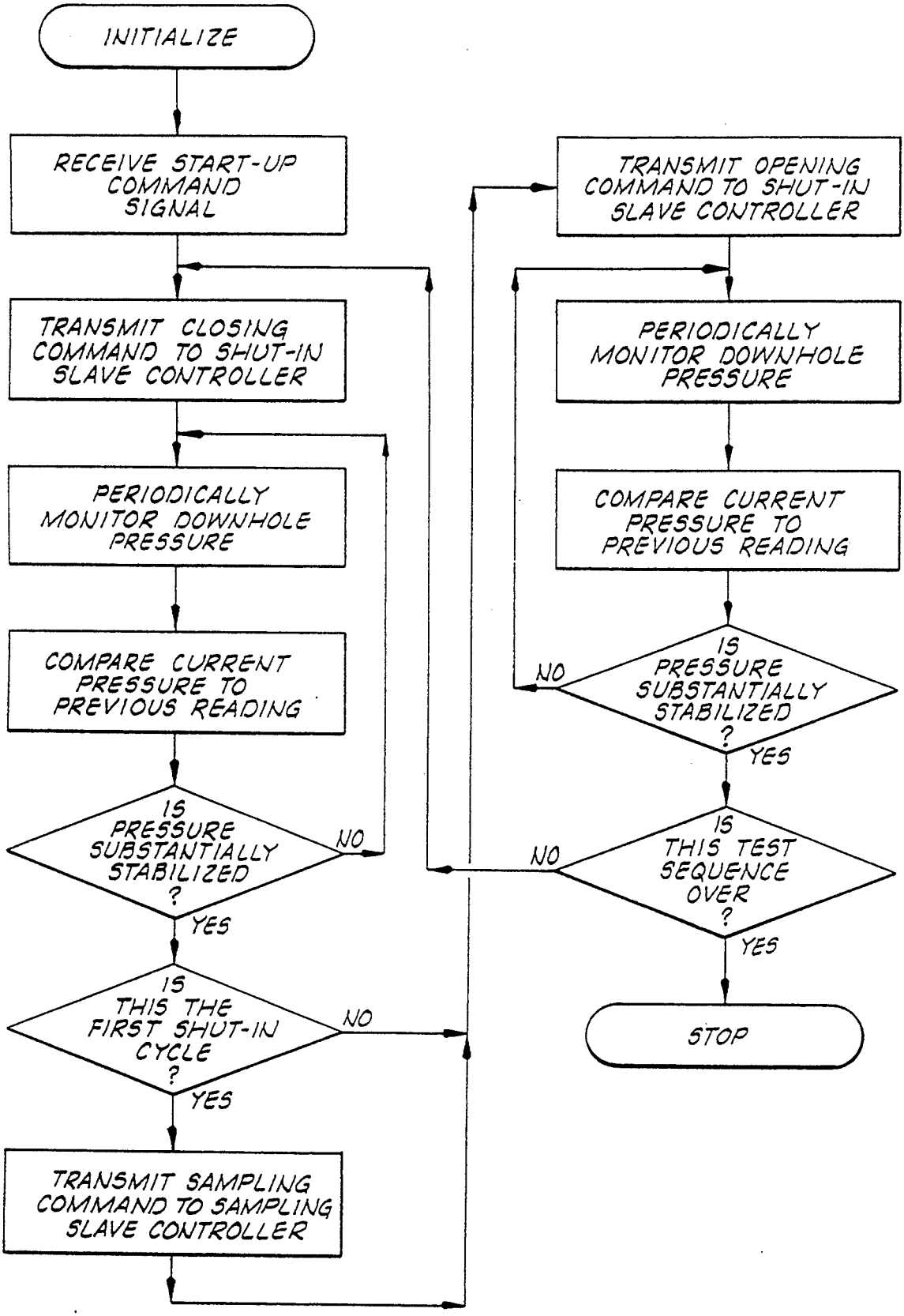
FIG. 20 is a flow chart illustrating the functions performed by the master controller and slave controllers of FIGS. 19A–19C in conducting methods of efficient automatic drawdown and buildup testing in accordance with the invention.

FIG. 20 is a flow chart of the program utilized by master controller 566*a* to perform the efficient methods of automatic drawdown and buildup testing described above and to take a fluid sample when the first shut-in curve substantially peaks.

The controller is initialized before it is placed in the well.

After the controller is placed in the well, it receives a start-up command signal which may be either an elapsed time signal or may be a bottom hole pressure signal which can either be the natural bottom hole pressure or an artificial pressure signal introduced into the well.

The shut-in valve 224 will be in its open position as run into the well so the first command it will receive from the master controller is a closing command which is transmitted from the master controller to the shut-in slave controller 432.

After the shut-in valve 224 is closed, the master controller 226 will periodically monitor the downhole pressure at predetermined time intervals. By comparing a current pressure reading to a previous pressure reading, a determination can be made as to whether the pressure has stabilized. If the pressure has not stabilized, there will be a relatively large difference between successive readings. When the difference between successive readings becomes less than some preprogrammed value, the master controller will determine that the pressure is substantially stabilized.

The program illustrated in FIG. 20 will activate the sampler 228 the first time the pressure is stabilized. After the sample is taken, the master controller will transmit an opening command to the shut-in slave controller 432 to reopen the shut-in valve 224.

After the shut-in valve 224 is opened, the master controller 226 will periodically monitor the downhole pressure at predetermined intervals. It will again compare current pressure readings to previous pressure readings in order to determine when the drawdown pressure has substantially stabilized. So long as the pressure is not stabilized, the master controller 226 will continue to periodically monitor downhole pressure and compare current pressure to the previous reading.

Once the master controller 226 determines that the drawdown pressure has substantially stabilized it then must determine whether this particular test sequence is over.

As previously mentioned, a typical test sequence will include several cycles of opening and closing.

If the test sequence is not over, the program returns to the portion thereof which causes another closing command to be transmitted to the shut-in slave controller. Thus, the shut-in drawdown cycle will be repeated. Of course, in the second and all subsequent shut-in drawdown cycles, the sampler will not be activated since it only operates once.

After the preprogrammed number of shut-in drawdown cycles have been performed, the master controller will determine that the test sequence is in fact over and will terminate operation.

One skilled in the art could write a program to carry out this scheme. The program would be placed in the microprocessor in a known manner.

Alternative Master Controller *226a*

Figure 23B:
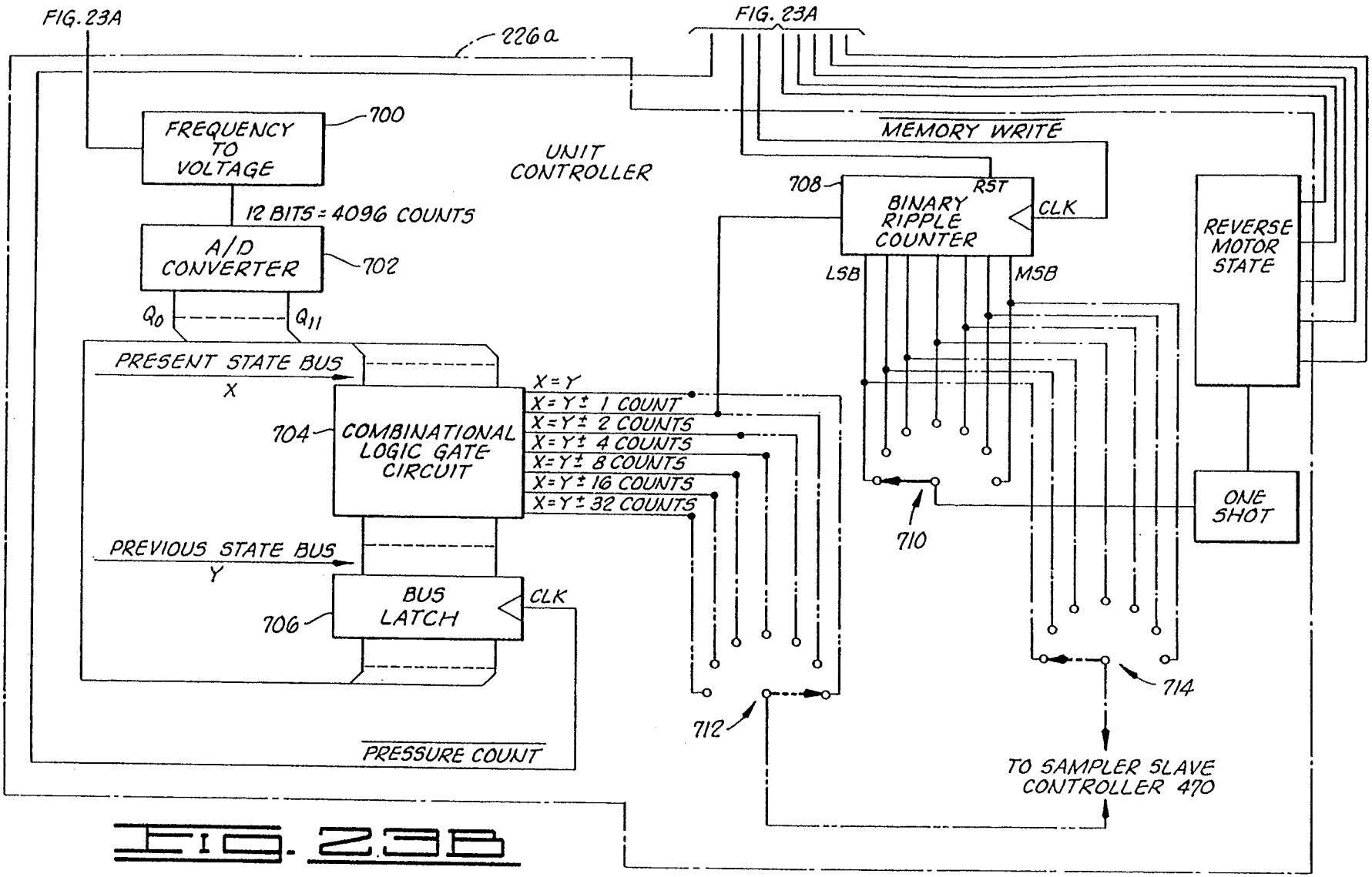
Figure 24:
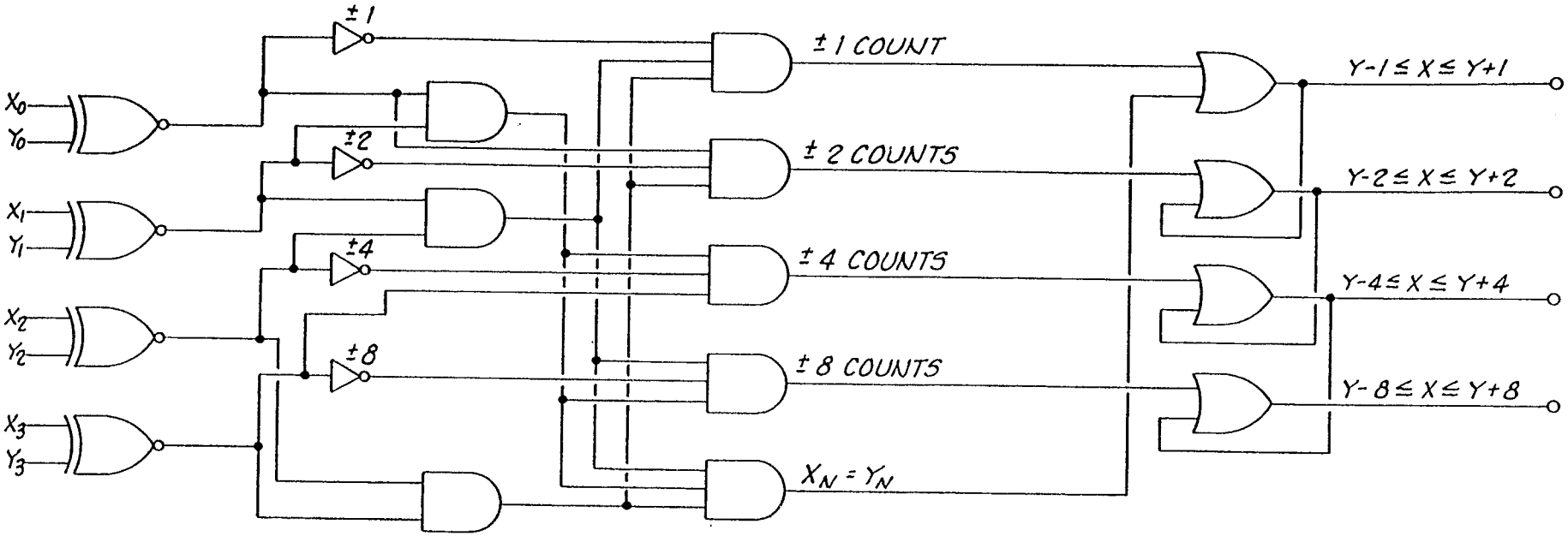
FIG. 24 is a schematic diagram of a partial implementation of the combinational logic gate circuit identified in FIG. 23B.

Another embodiment for a controller by which both shut-in valve and sampler valve control signals can be generated is shown in FIGS. 23 and 24. This embodiment can be used in place of the controller 566 or in conjunction therewith. Controller 566 will be used if data are to be recorded for later retrieval, and controller 566 is shown in FIGS. 23A and 23B as providing timing or operating control signals to alternative embodiment *226a* shown in FIG. 23B.

Temperature and pressure are sensed with suitable sensors as previously described (see FIG. 23A illustrating implementations of temperature and pressure transducer circuits *570a* and *572a*). The signals generated by these parameter monitoring circuits are provided to a data recording device as also previously described with regard to master controller 226. The pressure signal is, however, further provided as an input signal to the hardware implemented master controller *226a* shown in FIGS. 23B and 24.

In the preferred embodiment, the input signal represents sensed pressure designated by the frequency of the signal. This frequency is converted to a voltage in a conventional frequency-to-voltage converter 700 (FIG. 23B). The output of the frequency-to-voltage converter 700 is provided to an analog-to-digital converter 702 which converts the analog voltage from the frequency-to-voltage converter 700 to a multiple-bit digital signal used in a combinational logic gate circuit 704 (specifically, an electronically programmable logic device in a particular implementation of the preferred embodiment). The digital signal represents or defines a value of the sensed pressure.

The combinational logic gate circuit 704 compares the present state of the analog-to-digital converter 702 output to a previous state of the analog-to-digital converter 702. The present state represents the current value of sensed pressure, and the previous state represents the most recent value of sensed pressure prior to the current value. The prior value is obtained from a memory device, such as a latch 706, which is appropriately clocked to temporarily retain the most recent "present state" of the analog-to-digital converter 702 prior to the current "present state" (thus, a comparison is made between the later, current value and the earlier, most recent prior value). The combinational logic gates of the circuit 704 have inputs connected to the output lines or terminals of the analog-to-digital converter 702 and inputs connected to the output lines or terminals of the memory device 706 so that the combinational logic gates receive both a present state (i.e., present value of pressure) from the analog-to-digital converter 702 and a previous state (i.e., previous value of pressure) of the analog-to-digital converter 702 from the memory device 706. This receiving and processing of signals in the circuit 704 and the latch 706 repeats continually over time so that different current pressure values and different most recent prior pressures (each of which had been the respective prior current value) are compared in respective sequential pairs over time. Determinations are made as to whether the current and prior values in each pair are within the various predetermined ranges of each other as indicated by the output signals from the circuit 704.

A partial particular implementation of the combinational logic gate circuit 704 is shown in FIG. 24. This is shown for four bits, but it can be readily expanded to accommodate the twelve bits (or other number) output by the analog-to-digital converter 702. As illustrated, the four bits of present state X are effectively compared to the four bits of previous state Y. Four outputs are provided to indicate when the value of the presently sensed pressure is within 1, 2, 4 and 8 bits of the last previously sensed pressure. Selecting one of these comparison ranges defines, for its use in controlling a drawdown and buildup test, "steady state." For the illustrated embodiment, such "steady state" can have some variance between the prior pressure and the current pressure, but this difference (as selected by the operator) is considered to be sufficiently small or simply disregarded so that control proceeds when the current value is within the selected range of the prior value. The following table gives an example of selectable ranges and their corresponding pressure range variances for a maximum pressure of 15,000 psi and a twelve-bit analog-to-digital converter:

Example: maximum pressure=15000 psi

A/D conversion = 12 bits, $2^{12}$, or 4096

$$\text{resolution} = \frac{15000\ \text{psi}}{4096\ \text{bits}} = 3.66\ \text{psi/bit}$$

| logic gate range | | maximum pressure differential |
|---|---|---|
| ±1 bit | = | ±3.66 psi |
| ±2 bits | = | ±7.32 psi |
| ±4 bits | = | ±14.65 psi or 1 atm |
| ±8 bits | = | ±29.29 psi or 2 atm |

Although the selected output from the circuit 704 can be directly used as the control or command signal to actuate the shut-in valve, it is used in the preferred embodiment to drive a binary ripple counter 708 for defining a window or time period during which one or more "steady state" events occur (i.e., one or more output pulses provided from the selected output of the circuit 704, indicating one or more occurrences of one or more previous and present state comparisons within the selected range). The count input of the counter 708 is connected to the selected "range" or "steady state" output of the circuit 704. A switch 710 is used to select the counter 708 output with which to generate the command signal that actuates the motor control circuit for moving the shut-in valve as previously described. For example, if the least significant bit of the counter 708 output is selected via the switch 710, the control signal is provided upon one "steady state" event occurring as determined by the circuit 704. If the next least significant bit of the counter 708 output is selected by the switch 710, then two "steady state" events must occur before the control signal is generated, etc.

The controller 226a shown in FIGS. 23B and 24 can be more generally described as including means for comparing a first input signal to a second input signal and for determining when the first and second input signals are within a predetermined range of each other, and means for generating a shut-in command signal when the first input signal is within the predetermined range of the second input signal. The generating means of the preferred embodiment includes the counter 708 so that, if so selected, a predetermined number of comparisons within the selected predetermined range have to occur before the command signal is generated.

The controller 226a shown in FIGS. 23B and 24 can also be used to generate a sampler command signal in response to the comparing and determining means. The sampler command signal is used for controlling a sampling tool to automatically trap a well fluid sample in the sampling tool. This is implemented either by selecting one of the outputs of the combinational logic gate circuit 704 or by selecting one of the outputs of the counter 708.

If the former, the sampling command signal is generated when a value of a current input signal from the analog-to-digital converter 702 is within a predetermined range of a value of a prior input signal from the analog-to-digital converter 702 as stored in the latch 706. In the preferred embodiment, this is at a different range than used for the shut-in valve control signal (e.g., a +/−1 bit range for shut-in control and a +/−4 bit range for sampling control). Typically this different range for the sampling control is greater than the range for the shut-in control so that sampling occurs prior to shut-in control (i.e, prior to "steady state" being reached as defined by the range selected for shut-in control). Such a selection can be made using a switch 712 shown in FIG. 23B. Thus, through the switch 712 there is provided means for generating a sampling control signal in response to a selected one of the outputs of the combinational logic gates.

If sampling control is via the counter 708, this occurs in the preferred embodiment at a count less than the count used for shut-in control so that sampling control occurs before shut-in control. For example, if four "steady state" events were needed to generate a shut-in control signal via switch 710 selection of the third least significant bit of the counter 708 output, two such events might be selected as the trigger for the sampling control signal via a switch 714 selection of the second least significant bit of the counter 708 output. Thus, through the switch 714 there is provided means for generating a sampling command signal during a time period when a value of a current input signal from the analog-to-digital converter 702 is within the selected predetermined range of a value of a prior input signal from the analog-to-digital converter 702. In this embodiment, the same "range" or "steady state" signal is used for both shut-in control and sampling control since in the preferred embodiment a single output of the combinational logic gate circuit 704 is connected to the input of the counter 708 during any one trip into the well. It is contemplated that other switching and combinational logic arrangements for both shut-in control and sampling control can be devised and yet remain within the scope of the present invention.

Alternative Non-Digital Control System For Monitoring Downhole Pressure

Although the microprocessor based control system and the hardware implement control system described above are the preferred manners of monitoring downhole pressure to determine when the shut-in bottom hole pressure has peaked, it is also possible in some situations to utilize mechanical or other analog type sensors and control systems to accomplish this function. For example, U.S. Pat. No. 5,056,600 to Surjaatmadja et al., the details of which are incorporated herein by reference, discloses a control apparatus and method responsive to a changing stimulus such as pressure which increases at a decreasing rate of change during a closed-in period of a drill stem test in an oil or gas well. Two mechanical components are moved in different directions, but in a net first direction, until the rate of change of pressure is sufficiently low (e.g., near steady state), at which time the rates of movement of the two components produce net movement in a second direction. The change in direction of the net movement may move a control valve which communicates a pressure control signal to commence a drawdown period of the test. The change in direction of the net movement may also trigger a switch so that further control is performed by electrical means.

Self-Contained Multiple Shut-In Tool With Timer

The multiple shut-in tool 224 may also be constructed to be self-contained so that it can be operated without the master controller 226. Such a modified shut-in tool can be constructed to operate based upon a simple timing circuit or it may have a pressure transducer incorporated therein and include a control system appropriate to conduct the methods of efficient drawdown and buildup testing in response to monitored pressure similar to that described above, but with the control system directly incorporated in the shut-in valve assembly 224 rather than having a separate master controller.

Such a system utilizing a timer has an electronic control package similar to that illustrated in FIG. 7 but with the timer means 176 modified so as to provide multiple opening and closing signals so that the shut-in tool 224 will perform the desired number of tests. The timer may also be programmed to perform such tests periodically, e.g., on a monthly basis. Any one of a number of known recording devices may be utilized with such a system.

An example of a strictly timer based multiple drawdown and buildup test is an isochronal test. An isochronal test includes multiple cycles, e.g., four complete drawdown and buildup cycles. Each drawdown period (e.g., from $T_3$ to $T_5$ in FIG. 9) except for the last has a duration in the range of from four to six hours. Each buildup period (e.g., from $T_5$ to $T_6$ in FIG. 9) except for the last has a duration in the range of from four to six hours. The last drawdown period has a duration in the range of from twelve to seventy-two hours. The last buildup period has a duration of as long as two weeks.

Figure 21:
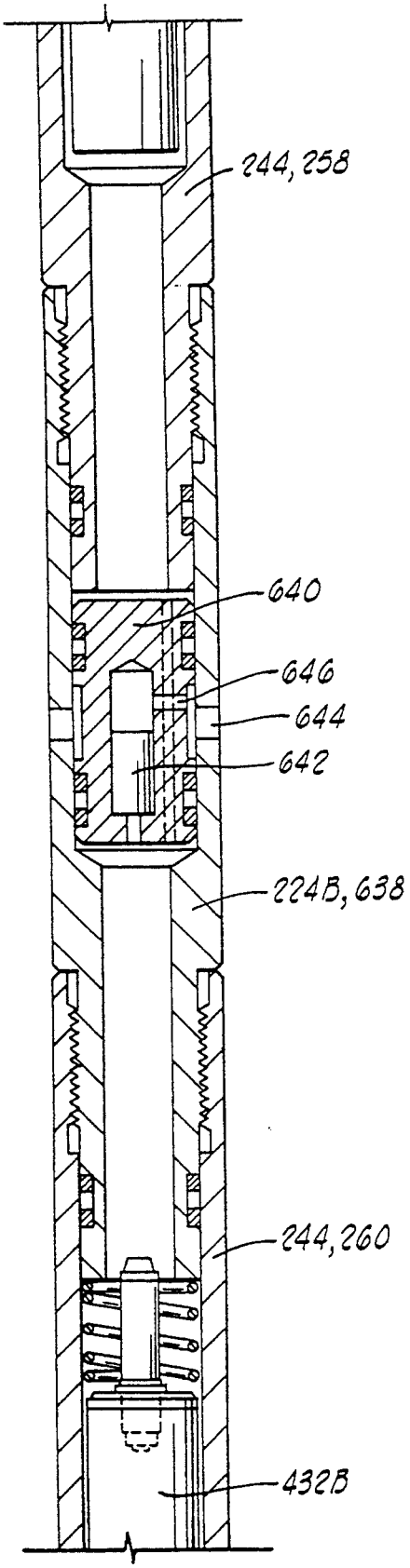
FIG. 21 is a view similar to FIG. 10F showing a modified version of the automated shut-in tool which has a self-contained pressure monitoring device therein.

If it is desired to directly incorporate a pressure monitoring means in the automated multiple shut-in tool 224, this can be accomplished in a manner like that shown in FIG. 21.

Figure 10F:
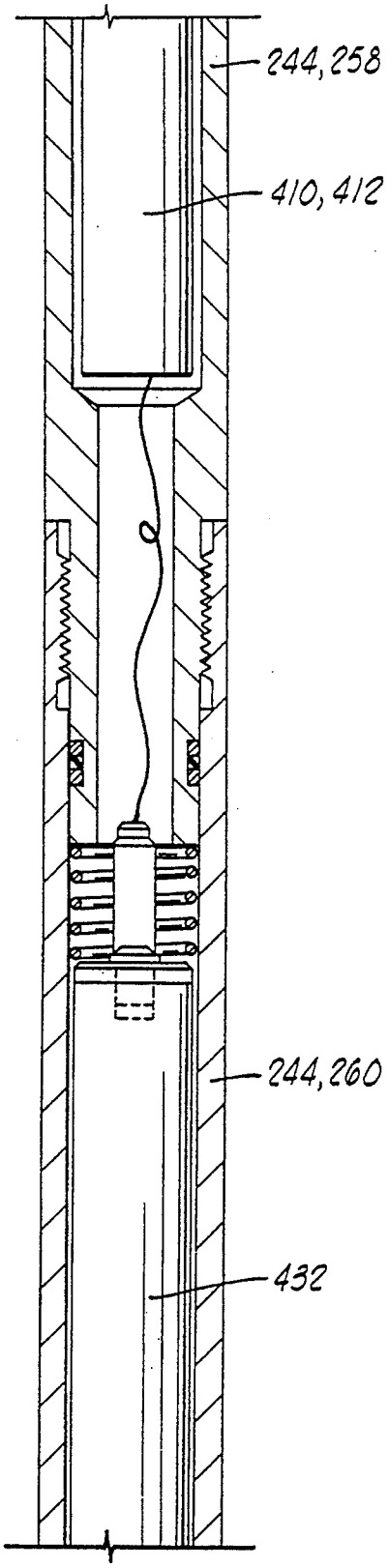
Figure 10G:
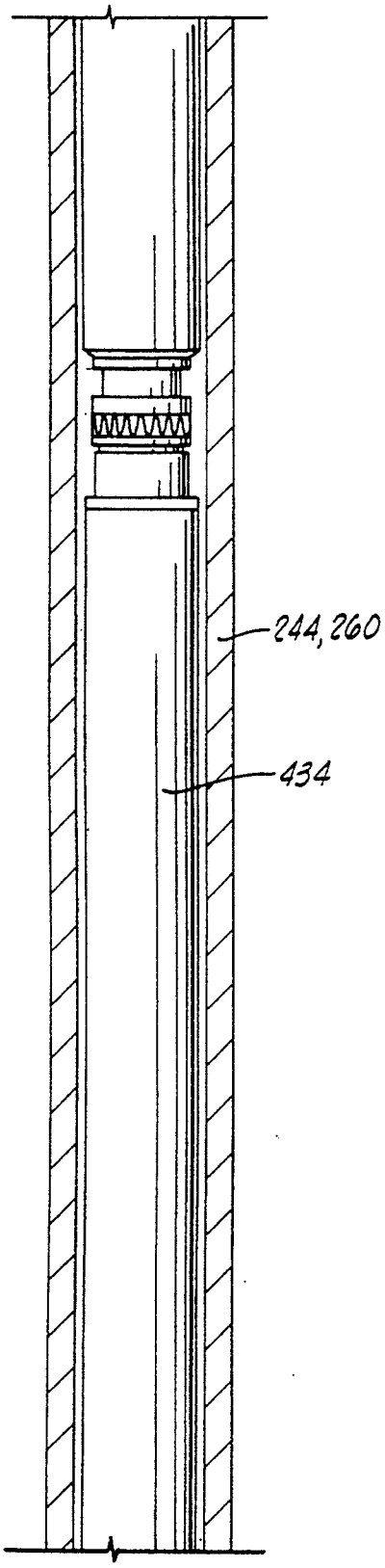
Figure 10H:
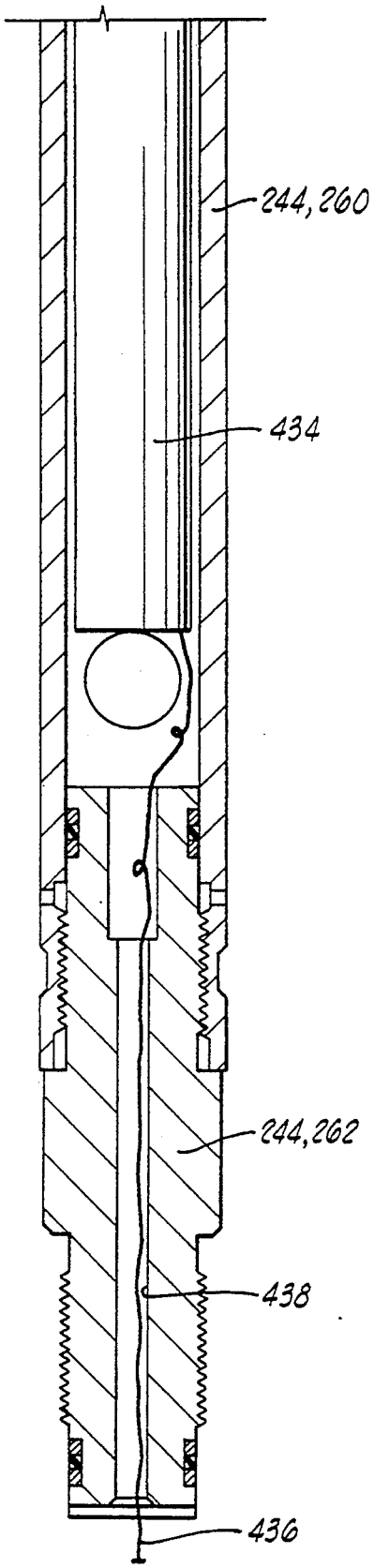

FIG. 21 is a view similar to FIG. 10F of a modified version of the shut-in tool 224 which is designated as 224B. The shut-in tool has been modified in that a pressure transducer housing section 638 has been added between motor housing 258 and electronics housing 260. A transducer carrier 640 is contained in pressure transducer housing 638 and contains a pressure transducer 642 therein.

A port 644 in housing 638, and a port 646 in carrier 640 communicate the transducer 642 with well fluid in the production tubing string 206.

The pressure transducer 642 provides an input signal which is processed by electronic control package 432B. The electronic control package 432B is modified to incorporate circuitry like that described with regard to the master controller 226 of FIGS. 19A–19B or master controller **226*a* of FIGS. 23B and 24 to recognize predetermined pressure criteria and to generate the appropriate drive signals to motor 412** in response thereto.

Alternative Techniques For Remote Control

As described above, the system set forth in FIGS. 8A–8B including the automated shut-in tool 224, the recorder/master controller 226, and the automated sampler 228 is controlled by the microprocessor based control system in master controller 226 which monitors downhole pressure. The master controller 226 may be programmed to begin operation in response to an internal timer or in response to sensed downhole pressure conditions which may be natural conditions or which may be a coded pressure pulse or the like introduced into the well at the surface by the operator of the well. The alternative controller **226*a*** may begin operation in a similar fashion.

Suitable systems describing in more detail the nature of such coded pressure pulses are described in U.S. Pat. Nos. 4,712,613 to Nieuwstad, 4,468,665 to Thawley, 3,233,674 to Leutwyler and 4,078,620 to Westlake.

As just described with regard to FIG. 21, the shut-in tool apparatus 24 or the sampler 228 may be utilized alone and can also be constructed to work on an internal timer and/or an internal pressure sensing device like that shown in FIG. 21.

Thus, any of the tools described above may utilize a control system which is completely internally contained and operates on a timer system, or which monitors some external condition and operates in response to either sensed natural conditions or artificial command signals which are introduced into the well.

Figure 22:
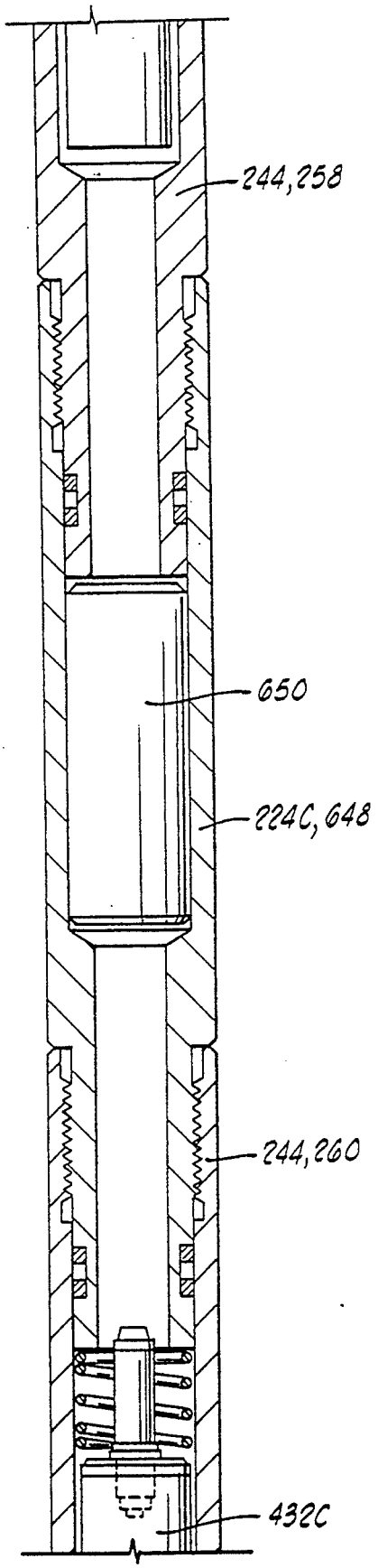
FIG. 22 is another view similar to FIG. 10F showing yet another modification of the automated shut-in tool, which in this instance includes an acoustic sensor for receiving acoustic remote command signals.

There are of course a number of other techniques for remote control which may be utilized to introduce command signals into the well and to receive those command signals in the control system for any of the tools disclosed. For example, FIG. 22 illustrates another modified form of shut-in tool 224 which in this case is designated as 224C.

In this situation, an acoustic transducer housing 648 has been included in housing 224C between the motor housing 258 and electronics housing 260. An acoustic transducer 650 is contained in housing 648 and is connected to the electronic control package 432C which is constructed so as to be responsive to acoustic signals received by transducer 650. One suitable system for the transmission of data from a surface controller to a downhole tool utilizing acoustic communication is set forth in U.S. Pat. Nos. 4,375,239; 4,347,900; and 4,378,850 all to Barrington and assigned to the assignee of the present invention, all of which is incorporated herein by reference. The Barrington system transmits acoustical signals down a tubing string such as production tubing string 206. Acoustical communication may include variations of signal frequencies, specific frequencies, or codes of acoustical signals or combinations of these. The acoustical transmission media may include the tubing string as illustrated in the above-referenced Barrington patents, casing string, electric line, slick line, subterranean soil around the well, tubing fluid, and annulus fluid.

There are of course many other remote control schemes which may be utilized if it is desired to have direct operator communication with the downhole tool to send command signals or receive data.

A third remote control system which may be utilized is radio transmission from the surface location or from a subsurface location, with corresponding radio feedback from the downhole tools to the surface location or subsurface location.

A fourth possible remote control system is the use of microwave transmission and reception.

A fifth type of remote control system is the use of electronic communication through an electric line cable suspended from the surface to the downhole control package.

A sixth suitable remote control system is the use of fiber optic communications through a fiber optic cable suspended from the surface to the downhole control package.

A seventh possible remote control system is the use of acoustic signaling from a wire line suspended transmitter to the downhole control package with subsequent feedback from the control package to the wire line suspended transmitter/receiver. Communication may consist of frequencies, amplitudes, codes or variations or combinations of these parameters.

An eighth suitable remote communication system is the use of pulsed X-ray or pulsed neutron communication systems.

As a ninth alternative, communication can also be accomplished with the transformer coupled technique which involves wire line conveyance of a partial transformer to a downhole tool. Either the primary or secondary of the transformer is conveyed on a wire line with the other half of the transformer residing within the downhole tool. When the two portions of the transformer are mated, data can be interchanged.

All of the systems described above may utilize an electronic control package that is microprocessor based.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A controller for a downhole apparatus, comprising:

means for providing signals representing values of a downhole parameter changing over time;

means, responsive to said signals, for comparing a later one of said values with an earlier one of said values and for providing a plurality of output signals indicating when said later value is within different predetermined ranges of said earlier value; and means for providing a control signal to the downhole apparatus in response to a selected one of said output signals.

2. The controller of claim 1, further comprising:

means for providing a second control signal in response to a different selected one of said output signals.

3. The controller of claim 1, wherein said means for providing a control signal includes means for determining that said selected one of said output signals indicates a predetermined number of respective later values have been within the respective predetermined range of respective earlier values for said selected one of said output signals.

4. The controller of claim 3, further comprising:

means for providing a second control signal in response to said means for determining that said selected one of said output signals indicates a second predetermined number of respective later values have been within the respective predetermined range of respective earlier values for said selected one of said output signals.

5. The controller of claim 4, wherein said second predetermined number is less than said first predetermined number.

6. The controller of claim 4, wherein said means for providing signals includes:

means for sensing downhole pressure;

an analog-to-digital converter; and means for connecting said analog-to-digital converter to said means for sensing downhole pressure.

7. The controller of claim 6, wherein said means for comparing and providing includes combinational logic gates having inputs connected to said analog-to-digital converter and having outputs through which said output signals are provided.

8. The controller of claim 7, wherein:

said means for comparing and providing further includes memory means for temporarily storing a previous state from said analog-to-digital converter as said earlier value; and said combinational logic gates have other inputs connected to said memory means so that said combinational logic gates receive both a present state from said analog-to-digital converter as said later value and said previous state of said analog-to-digital converter as said earlier value.

9. The controller of claim 8, wherein said means for providing a control signal includes a counter having an input connected to a selected one of said outputs of said combinational logic gates and having a plurality of outputs.

10. The controller of claim 9, wherein said means for providing a control signal further includes switch means for selecting one of said outputs of said counter for generating said control signal.

11. The controller of claim 10, further comprising means for generating a second control signal in response to a selected one of said outputs of said counter.

12. The controller of claim 10, further comprising means for generating a second control signal in response to a selected one of said outputs of said combinational logic gates.

* * * * *

UNITED STATES PATENT AND TRADEMARK OFFICE

CERTIFICATE OF CORRECTION

PATENT NO. : 5,332,035

DATED : July 26, 1994

INVENTOR(S) : Roger Schultz et al

It is certified that error appears in the above-indentified patent and that said Letters Patent is hereby corrected as shown below:

On the title page, Inventors delete --Craig L. Zitterich and Harold K. Beck--

Signed and Sealed this

Eighteenth Day of October, 1994

*Attest:*

Bruce Lehman

BRUCE LEHMAN

*Attesting Officer*

*Commissioner of Patents and Trademarks*